US011566426B2

(12) United States Patent
Boss et al.

(10) Patent No.: US 11,566,426 B2
(45) Date of Patent: Jan. 31, 2023

(54) ROOFING PANELS WITH WATER SHEDDING FEATURES

(71) Applicant: Building Materials Investment Corporation, Dallas, TX (US)

(72) Inventors: Daniel E. Boss, Morris Township, NJ (US); Trieu Nguyen, Plano, TX (US); Kevin A. Pollack, Dallas, TX (US); David Gennrich, Fitchburg, WI (US); Eric R. Anderson, Montclair, NJ (US); Matthew J. Poster, Madison, WI (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 17/103,998

(22) Filed: Nov. 25, 2020

(65) Prior Publication Data

US 2021/0156150 A1 May 27, 2021

Related U.S. Application Data

(60) Provisional application No. 62/962,298, filed on Jan. 17, 2020, provisional application No. 62/951,252,
(Continued)

(51) Int. Cl.
*E04D 3/34* (2006.01)
*E04B 7/18* (2006.01)
(Continued)

(52) U.S. Cl.
CPC ..... *E04D 3/34* (2013.01); *E04B 7/18* (2013.01); *E04D 3/40* (2013.01); *E04D 13/0481* (2013.01);
(Continued)

(58) Field of Classification Search
CPC ..... E04D 2013/0436; E04D 2013/045; E04D 2013/0468; E04D 2013/0486;
(Continued)

(56) References Cited

U.S. PATENT DOCUMENTS 550,325 A 11/1895 Kinnear
1,329,794 A 2/1920 Moomaw
(Continued)

FOREIGN PATENT DOCUMENTS

AU 2018200682 A1 8/2018
CH 346993 A 6/1960
(Continued)

OTHER PUBLICATIONS

Boral Steel Stone Coated Roofing; Batten-Less Installation Guidelines; BoralRoof.com; pp. 1-40; dated Oct. 2018.
(Continued)

*Primary Examiner* — Jessica L Laux
(74) *Attorney, Agent, or Firm* — Womble Bond Dickinson (US) LLP

(57) ABSTRACT

Roofing panels with water shedding features may be installed on the roof of a house or other structure in lieu of or as an underlayment for traditional roofing materials. The water shedding features can be built into a base of the roofing panels, as part of a frame for the roofing panels, or formed as part of a waterproofing layer applied to the base of the roofing panels, or which can be configured as a roofing panel. The roofing panels also can be installed in overlapping courses along a roof with water shedding features applied thereto or incorporated along one or more peripheral edges. The water shedding features of adjacent roofing panels will collect and divert water away from the upper surfaces and/or away from headlap and/or sidelap joints defined between the roofing panels.

21 Claims, 34 Drawing Sheets

Related U.S. Application Data filed on Dec. 20, 2019, provisional application No. 62/940,448, filed on Nov. 26, 2019.

(51) Int. Cl.
*E04D 3/40* (2006.01)
*E04D 13/04* (2006.01)

(52) U.S. Cl.
CPC ..... *E04B 2103/04* (2013.01); *E04B 2103/06* (2013.01); *E04D 2013/0486* (2013.01)

(58) Field of Classification Search
CPC ..... E04D 13/0404; E04D 13/0409; E04D 13/0445; E04D 13/0459; E04D 13/0481; E04D 3/24; E04D 3/30; E04D 3/32; E04D 3/34; E04D 3/40
See application file for complete search history.

(56) References Cited

U.S. PATENT DOCUMENTS 1,484,166 A * 2/1924 Wolk ..... E04D 15/003 30/169
1,539,632 A 5/1925 Belding
1,732,368 A 10/1929 Lane
1,743,206 A 1/1930 Fulenwider et al.
2,042,890 A 6/1936 Fulenwider et al.
3,347,001 A 10/1967 Cosden
3,363,380 A 1/1968 Merrill
3,412,517 A 11/1968 Ellis et al.
3,720,031 A 3/1973 Wilson et al.
3,760,546 A 9/1973 Martin et al.
3,848,383 A * 11/1974 Wilson ..... E04D 3/36 52/533
4,010,590 A 3/1977 Reinke
4,021,981 A 5/1977 Van Wagoner
4,079,561 A 3/1978 Vallee
4,135,342 A 1/1979 Cotter
4,163,351 A * 8/1979 Ishikawa ..... E04D 3/24 52/542
4,189,889 A 2/1980 Yanoh
4,343,126 A 8/1982 Hoofe, III
4,464,215 A 4/1984 Cogliano
4,445,305 A 5/1984 Orie, Sr.
4,453,349 A * 6/1984 Ryan ..... E04B 5/40 52/220.4
4,468,903 A 9/1984 Eaton et al.
4,499,700 A 2/1985 Gustafsson
4,580,383 A * 4/1986 Pittman ..... E04D 1/08 52/520
4,592,183 A 6/1986 See
4,643,080 A 2/1987 Trostle et al.
4,683,697 A * 8/1987 Gregg ..... E04D 3/30 52/534
4,775,567 A 10/1988 Harkness
4,856,236 A * 8/1989 Parker ..... E04D 3/358 52/11
4,932,184 A 6/1990 Waller
4,986,744 A 1/1991 Weisweiler et al.
5,038,535 A 8/1991 Van Praag, III
5,074,093 A 12/1991 Meadows
5,092,099 A 3/1992 Valente
5,245,803 A 9/1993 Haag
5,295,338 A 3/1994 Guffey et al.
5,345,740 A 9/1994 Huang
5,349,801 A 9/1994 Verbofsky
5,465,543 A 11/1995 Seifert
5,469,680 A 11/1995 Hunt
5,535,567 A 7/1996 Cahoon
5,557,896 A 9/1996 Imeokparia et al.
5,598,677 A 2/1997 Rehm, III
5,613,337 A 3/1997 Plath et al.
5,636,481 A 6/1997 De Zen
5,642,596 A 7/1997 Waddington
5,743,059 A 4/1998 Fifield
5,752,355 A 5/1998 Sahramaa
5,768,844 A 6/1998 Grace, Sr. et al.
5,881,501 A 3/1999 Guffey et al.
D414,568 S 9/1999 Hedges et al.
6,105,314 A 8/2000 Stocksieker
6,272,807 B1 8/2001 Waldrop
6,282,858 B1 * 9/2001 Swick ..... E04D 1/2916 52/533
D449,121 S 10/2001 Hunter et al.
6,298,619 B1 10/2001 Davie
6,314,704 B1 11/2001 Bryant
RE38,210 E 8/2003 Plath et al.
6,606,823 B1 8/2003 McDonough et al.
6,647,687 B2 11/2003 Kern
6,772,569 B2 8/2004 Bennett et al.
6,907,701 B2 6/2005 Smith
6,928,781 B2 8/2005 Desbois et al.
6,990,779 B2 1/2006 Kiik et al.
7,246,474 B2 7/2007 Dombek et al.
7,444,782 B2 11/2008 Crowell
7,513,084 B2 * 4/2009 Arguelles ..... E04D 1/045 52/469
7,658,038 B2 2/2010 Mower et al.
7,739,848 B2 6/2010 Trout
7,748,191 B2 7/2010 Podirsky
7,877,936 B2 2/2011 Uffner et al.
7,921,619 B2 4/2011 Snyder et al.
7,984,591 B2 7/2011 Cashin et al.
D643,133 S 8/2011 Steffes et al.
8,074,417 B2 12/2011 Trabue et al.
8,132,372 B2 3/2012 Mower et al.
8,158,450 B1 4/2012 Sheats et al.
8,171,689 B2 5/2012 Pierson et al.
8,206,539 B2 6/2012 Kalanoglu
8,215,083 B2 7/2012 Toas et al.
8,316,609 B2 11/2012 Ben-Zvi
8,323,770 B2 12/2012 Mehta et al.
8,426,017 B2 4/2013 Paradis et al.
8,470,436 B1 6/2013 Paradis et al.
8,476,523 B2 7/2013 Bennett
8,516,744 B2 8/2013 Dubner
8,567,149 B2 10/2013 Kuzmin
8,590,267 B2 11/2013 Jaffee
8,713,882 B2 5/2014 Kalkanoglu et al.
D707,856 S 6/2014 Cochrane
8,869,478 B2 10/2014 Gianolio
8,875,454 B2 * 11/2014 Arguelles ..... H02S 20/25 52/173.3
8,910,428 B2 12/2014 Rule et al.
9,027,298 B1 5/2015 Martinez
9,032,679 B2 5/2015 Propst
9,181,704 B2 11/2015 Rasmussen et al.
D754,885 S 4/2016 Rasmussen et al.
9,404,261 B2 8/2016 Johnson et al.
9,611,647 B2 4/2017 Yang
9,636,892 B2 5/2017 Albert et al.
9,689,164 B2 6/2017 Rasmussen et al.
9,783,995 B2 10/2017 Meersseman et al.
9,840,851 B2 12/2017 Propst
9,876,132 B2 1/2018 Morad et al.
9,890,537 B2 2/2018 Martin et al.
9,970,197 B2 5/2018 Maurer et al.
10,027,274 B2 7/2018 Van Giesen et al.
10,087,634 B2 10/2018 Johnson et al.
10,240,338 B2 3/2019 Durst et al.
10,259,199 B2 4/2019 Beuchel et al.
10,294,669 B2 5/2019 Prygon
10,415,245 B2 9/2019 Bennett et al.
10,538,905 B2 1/2020 Pirrung
10,749,460 B2 8/2020 Guo
2003/0159379 A1 8/2003 Pickler
2005/0170720 A1 8/2005 Christiansen et al.
2005/0210808 A1 9/2005 Lawson et al.
2006/0019598 A1 1/2006 Rotter
2007/0137132 A1 6/2007 Plowright
2007/0181174 A1 8/2007 Ressler
2009/0258972 A1 10/2009 Illiuta et al.
2009/0293864 A1 12/2009 Augenbraun et al.

(56) References Cited

U.S. PATENT DOCUMENTS

| | | | |
|---|---|---|---|
| 2010/0186334 | A1 | 7/2010 | Seem |
| 2010/0313506 | A1 | 12/2010 | Schoell |
| 2011/0009024 | A1 | 1/2011 | Clark |
| 2012/0225603 | A1 | 9/2012 | Trinch |
| 2012/0227343 | A1 | 9/2012 | Curtin et al. |
| 2013/0186028 | A1 | 7/2013 | Resso et al. |
| 2014/0165480 | A1 | 6/2014 | Jenkins et al. |
| 2014/0190096 | A1 | 7/2014 | Kacandes |
| 2014/0190104 | A1 | 7/2014 | Nicholson |
| 2015/0267409 | A1* | 9/2015 | Rasmussen ..... E04D 13/0404 52/579 |
| 2015/0354224 | A1 | 12/2015 | Maurer et al. |
| 2015/0372635 | A1 | 12/2015 | Praca et al. |
| 2016/0123013 | A1* | 5/2016 | Rasmussen ..... E04D 1/265 52/302.1 |
| 2017/0019061 | A1 | 1/2017 | Van Giesen et al. |
| 2017/0058523 | A1 | 3/2017 | Kennedy |
| 2017/0145697 | A1 | 5/2017 | Anthony |
| 2017/0298614 | A1 | 10/2017 | Gaudio et al. |
| 2018/0002939 | A1 | 1/2018 | Harve et al. |
| 2018/0038109 | A1 | 2/2018 | Kennedy |
| 2019/0078332 | A1 | 3/2019 | Khajani et al. |
| 2020/0040582 | A1 | 2/2020 | Boss et al. |
| 2020/0149264 | A1 | 5/2020 | Pirrung |
| 2020/0274483 | A1 | 8/2020 | Sanglap et al. |

FOREIGN PATENT DOCUMENTS

| | | | |
|---|---|---|---|
| CN | 107514088 | A | 12/2017 |
| CN | 108060733 | A | 5/2018 |
| CN | 108149849 | A | 6/2018 |
| CN | 106665317 | B | 4/2020 |
| EP | 0550800 | A1 | 7/1993 |
| EP | 1989366 | B1 | 7/2009 |
| FR | 2569218 | A1 | 2/1986 |
| RU | 2185959 | C1 | 7/2002 |
| RU | 116808 | U1 | 6/2012 |
| RU | 2015107299 | A | 10/2016 |
| RU | 2605910 | C2 | 12/2016 |
| WO | WO2005/078209 | A1 | 8/2005 |
| WO | WO2005/098168 | A2 | 10/2005 |
| WO | WO2012/120208 | A2 | 9/2012 |
| WO | WO2012/136194 | A2 | 10/2012 |
| WO | WO2018/023147 | A1 | 2/2018 |
| WO | WO2021/146567 | A1 | 7/2021 |

OTHER PUBLICATIONS

Cost Comparison Helper; http://costcomparisonhelper.com/compare-prices/roofing/steel-roofing.html; Compare Average Cost of Steel Roofing InstallationISteel Roofing Price Quotes;; pp. 1-4; available as of Nov. 20, 2014.

Guilford's Seamless Gutters; http://guilfordsllc.com/metal-roof-proflle-style-options/; Metal Roof Profile—Style Options Guilford's Metal Roofing;; pp. 1-3; available as of Nov. 20, 2014.

Windows of Michigan; http://windowsofmichigan.com/products/metal-roofing/permanent-metal-shakes.html; Permanent Metal Shake; pp. 1-3; Nov. 20, 2014.

AMR-Advantage Metal Roofs; http://www.advantagementalroofs.com/country_manor_shake.html: Austin Texas Metal Roofing Professionals—Advantage Metal Roofs; pp. 1-2; available as of Nov. 20, 2014.

International Search Report and the Written Opinion of the International Search Authority for PCT/US2020/062150 dated Feb. 11, 2021.

* cited by examiner

ROOFING PANELS WITH WATER SHEDDING FEATURES

REFERENCE TO RELATED APPLICATIONS

The present Patent Application claims the benefit of U.S. Provisional Patent Application No. 62/940,448, filed on Nov. 26, 2019; U.S. Provisional Patent Application No. 62/951,252, filed on Dec. 20, 2019; and U.S. Provisional Patent Application No. 62/962,298, filed Jan. 17, 2020.

INCORPORATION BY REFERENCE

The disclosures made in U.S. Provisional Patent Application No. 62/940,448, filed on Nov. 26, 2019; U.S. Provisional Patent Application No. 62/951,252, filed on Dec. 20, 2019; and U.S. Provisional Patent Application No. 62/962,298, filed Jan. 17, 2020, are specifically incorporated by reference herein as if set forth in their entireties.

TECHNICAL FIELD

This disclosure relates generally to roofing systems or structures and roofing panels for buildings and more specifically to roofing systems or structures and roofing panels with integrated water shedding features.

BACKGROUND

The application of structural roofing panels to the roof of a building has long been a construction practice, particularly in commercial roofing. More recently, interest in applying this construction practice to sloped residential roofs has grown. Issues with traditional roofing panels include the fact that they must be sealed along the junctions of individual panels after application. This can be done in a variety of ways including, for example, applying a roofing membrane over the panels, taping the junctions of the panels, applying a traditional shingled roof over the panels, and combinations thereof. All of these sealing options are labor intensive and subject to human error and deterioration over time.

A need exists for roofing panels for sloped roofs that, upon installation, collect and/or shed water without the need for ancillary sealing or roofing strategies, and/or which can incorporate design features that inherently provide effective water shedding at critical panel junctions while being easily installable on a roof deck. It is to the provision of such roofing panels that the present disclosure is primarily directed.

SUMMARY

Briefly described, roofing panels are constructed with integral water collection and shedding features. The roofing panels are installed as part of a roof structure, such as for a sloped roof, and the water collection and shedding features of the panels can be configured to align automatically and cooperate to collect rainwater and shed the rainwater down the slope of and off the roof. No ancillary sealing strategies need be employed, but shingles or other aesthetic roofing features can be installed atop the panels if desired.

In one example embodiment, the roofing panels can each include a base, and at least one water shedding feature extending along at least one of an upper surface, a lower surface, and/or a peripheral edge portion of the base. The at least one water shedding feature is configured to receive and direct water along a drainage path away from the base. In some embodiments, a waterproof layer is applied to the base, being applied to at least one of the upper surface and lower surface of the base. The waterproof layer further can include a portion that overlaps an adjacent roofing panel. A drip edge further can be applied along at least one peripheral edge portion of the base. In embodiments, the water shedding feature generally is integrally formed with the base, while in other embodiments, the water shedding feature can be connected or secured to the base so as to be substantially integrated therewith. The water shedding feature further will comprise at least one of a flexible strip, a trough, or a cover strip located along adjacent peripheral edge portions of the bases of adjacent roofing panels.

In another embodiment, the roofing panels can each include a base having a series of side edges; and a water shedding feature extending along at least one side edge of the base. The water shedding feature can comprise a drip edge or lip seal extending along the at least one side edge of the base, and a water trough configured to receive and direct water flows along a drainage path and away from the base. The drip edges or lip seals of adjacent roofing panels further can be engaged in an overlapping arrangement. In addition, a cover strip can be mounted along a seam defined between adjacent roofing panels.

In a further embodiment, each of the roofing panels can include a base having upper and lower surfaces; and a waterproof layer applied to at least one of the upper and lower surfaces of the base, the waterproof layer having a water shedding feature along a peripheral portion thereof that overlaps with a peripheral portion of a waterproof layer of an adjacent roofing panel to define a headlap or sidelap seam between adjacent roofing panels. For example, the waterproof layer can comprise a drip edge.

In a still further embodiment, a plurality of roofing panels can be provided. Each roofing panel can include a body having water shedding features formed adjacent peripheral portions of the body. The water shedding features can be configured to overlap with corresponding water shedding features of adjacent roofing panels to deter migration of water through joints between the adjacent roofing panels. A frame also can be provided. The frame can be configured to extend about the body. A series of water shedding features can be arranged along the frame that are configured to collect and direct water along drainage paths. The water shedding features can comprise troughs and/or drip edges along sides of the frame. A cover can be applied over and can cover the drip edges of adjacent roofing panels.

A method of installing roofing panels with water shedding features also is disclosed. In some aspects, the method can include arranging a plurality of roofing panels in spaced series, and coupling adjacent ones of the roofing panels along sidelap or headlap seams with the water shedding features of the roofing panels in an overlapping or engaging arrangement to collect and direct water flows along a drainage path and away from the roofing panels. In addition, portions of waterproof layers applied to the adjacent ones of roofing panels can be overlapped.

In some aspects, a roof structure comprises a plurality of roofing panels each configured to extend across a section of the roof structure, each of the roofing panels comprising a base having an upper surface, lower surface, and peripheral edge portions; and at least one water shedding feature extending along at least one of the peripheral edge portions of the base and configured to convey water along at least one drainage path away from the base; wherein the at least one water shedding feature of each roofing panel is configured to cooperate with a corresponding water shedding feature of an adjacent roofing panel to reduce migration of water between the roofing panel and the adjacent roofing panel.

In additional embodiments, the roof structure comprises a waterproof layer positioned along at least one of the upper and lower surfaces of the base. The waterproof layer can comprise a polymer membrane, and include at least one projection that overlaps the adjacent roofing panel to define a headlap or sidelap seam between the roofing panel and the adjacent roofing panel.

In some embodiments, the waterproofing layer is positioned along the lower surface of the base, and further comprising a roof deck on which the roofing panels are received, and vapor barrier layer positioned along the roof deck and configured to enable passage of moisture therethrough.

In other embodiments, the roof structure comprises an edge frame positioned about the peripheral edge portions of the base of the panels; and wherein the at least one water shedding feature is at least partially formed by edge frames of the adjacent ones of the roofing panels; wherein each edge frame includes an extension portion defining a water shedding feature configured as a water stop or drip edge.

In some embodiments, the extension portions of the edge frames of the adjacent ones of the roofing panels are configured to overlap along a seam between the adjacent ones of the roofing panels and form the at least one water shedding feature therebetween.

In further embodiments, the base of the roof structure comprises an oriented strand board (OSB), polyisocyanurate (ISD) plywood, foam board, structural foam, polystyrene, polyvinyl chloride (PVC) plastic, concrete, a solar panel, a solar tile, pressed recycled materials, structural insulated panel materials, or combinations thereof.

In other embodiments, the base comprises a waterproof material.

In still other embodiments, the at least one water shedding feature of the roofing panels comprises at least one of a flexible strip, a trough, a ramp, or a cover located along a seam between the adjacent ones of the roofing panels.

In some embodiments, the roofing panels are configured to extend between a ridge of the roof structure and an eave of the roof structure. In addition, the roofing panels further can comprise substantially self-supporting panels each having an upper end mounted to the peak of the roof structure, and a lower end mounted to the eave of the roof structure, and wherein the at least one water shedding feature of each of the adjacent roofing panel extends between the ridge and eave of the roof structure.

In another aspect, a roofing system, comprises a plurality of roofing panels, each roofing panel comprising a base having upper and lower surfaces; and a waterproof layer applied to at least one of the upper and lower surfaces of the base and having at least one projection that overlaps with a portion of a waterproof layer of an adjacent roofing panel to define a sidelap or headlap seam between the roofing panel and the adjacent roofing panel, wherein the waterproof layer includes at least one water shedding feature extending along the sidelap or headlap seam for reducing migration of water through the sidelap or headlap seam.

The at least one water shedding feature further comprises a drip edge or water trough positioned along at least one peripheral edge of the base, and a cover configured to be applied over and cover the drip edge and/or water trough of adjacent roofing panels.

In some embodiments, the roofing panels comprise structural panels configured to be substantially self-supporting panels having a length sufficient to extend between a ridge of the roof structure and an eave of a roof structure, and wherein the at least one water shedding feature extends between the ridge and the eave of the roof structure.

In yet another aspect, a method of forming a roof, comprises arranging a plurality of roofing panels in spaced series across the roof, each of the roofing panels comprising at least one water shedding feature; coupling adjacent ones of the roofing panels along sidelap or headlap seams with the at least one water shedding feature of the adjacent ones of the roofing panels in an overlapping or cooperative arrangement configured to reduce migration of water between the sidelap or headlap seams between the adjacent ones of the roofing panels.

In another embodiment, the roofing panels each include a waterproofing layer, and further comprising overlapping portions of the waterproof layers of the roofing panels with the adjacent ones of the roofing panels.

In other embodiments, the roofing panels comprise substantially self-supporting panels configured to extend across a span of the roof; and wherein arranging the plurality of roofing panels across the roof comprises mounting the substantially self-supporting panels in positions extending between an eave and a ridge of the roof, and attaching end portions of each of the roofing panels to the eave and ridge of the roof.

In additional embodiments, the method further comprises positioning at least a portion of the substantially self-supporting panels along one or more spaced rafters.

In still another aspect, a roof system, comprises a plurality of panels configured to extend across sections of a roof; wherein each of the panels comprises a base having upper and lower surfaces and a plurality of peripheral edges; and at least one water shedding feature positioned adjacent at least one of the plurality of peripheral edges of the base; wherein the at least one water shedding feature of each panel is configured cooperate with a corresponding water shedding feature of an adjacent panel to reduce migration of water between the sidelap or headlap seams between the adjacent ones of the roofing panels; and a cover or trough extending along the sidelap or headlap seams between adjacent panels and configured to overlap the water shedding features of adjacent panels.

In embodiments, the roof system further comprises an edge frame positioned along the peripheral edges of the base, and wherein the at least one water shedding feature comprises at least one upturned or downturned edge portion of the edge frame projecting away from at least one of the peripheral edges of the base; and wherein the cover or trough comprises a channel or strip extending over each of the upturned edge portions of edge frames of the adjacent panels.

In embodiments of the roof system, the at least one water shedding feature of each panel comprises a compressible seal member received in a channel defined along the lower surface of each panel adjacent the peripheral edges of the base, and wherein the cover or trough comprises a water channel strip positioned along the sidelap or headlap seams between the adjacent panels and projecting across the lower surface of adjacent panels sufficient to cover the compressible seal member.

In embodiments of the roof system, each panel further comprises an edge frame, and wherein the at least one water shedding feature and the cover are integrated with the edge frame of each panel.

In embodiments, the roof system further comprises an edge frame positioned along the peripheral edges of the base, and wherein the edge frame of each panel comprises connectors for releasibly coupling the panel to the roof and/or to the adjacent panels such that each panel is removable.

In embodiments of the roof system, the panels comprise interchangeable panels, including solar panels, biologic and vegetative panels, lighting panels, roof access panels, patterned or decorative panels, panels having roofing shingles, or combinations thereof.

In embodiments of the roof system, the connectors comprise hooks, clips, magnets, snap connectors, locking brackets or battens, or combinations thereof.

In other aspects of the present disclosure, a roofing system can be constructed with a plurality of individual roofing panels installable on a roof deck in overlapping courses. Each roofing panel may be molded from a thermo-formable or compression moldable polymer material and can have V-shaped ridges along its side edges, with an upstanding rib extending transversely between the V-shaped ridges near the upper edge of each panel and a nailing flange with a nail zone disposed above the rib. The lower edge of each panel can be downturned to form a drip edge. In use, multiple panels can be installed in courses on a roof with fasteners driven through the nailing flanges of the panels, with the lower edge portion of each roofing panel of an upper course of roofing panels overlapping the nailing flange and the upstanding rib of a roofing panel of a lower course of roofing panels, and with the downturned drip edges of the upper course of roofing panels disposed just forward of the upstanding ribs the roofing panels of the lower course of roofing panels. A lower edge portion of each roofing panel of each upper course also may be secured to a roofing panel in a next lower course, such as with a bead of adhesive or sealant that can be applied behind the downturned drip edge. The arrangement of the roofing panels can thus help define or provide water shedding features or pathways.

In addition, in some embodiments, the roofing panels, or portions or components thereof, can be further configured or provided with water shedding features. For example, an accessory in the form of a drain trough can be attached to the roof deck and extend beneath abutting side edges of horizontally adjacent panels. In another embodiment, a cap can extend along the tops of horizontally adjacent V-shaped ridges and can be secured or fastened in position along a seam or joint (i.e. along a headlap or sidelap seam) between the adjacent panels with a spline. As a result, water is reduced or substantially restricted from seeping between panels and can be effectively shed from the roof structure.

In still a further aspect, a roof system comprises a plurality of panels, each formed from a waterproof material comprising at least one of a thermo-formable polymer, metal, foam, structural insulated panel materials, or combinations thereof; wherein each of the panels comprises an exposure region, a nailing flange extending along a portion of the exposure region, and at least one water shedding feature along at least one peripheral side edge of each panel; and wherein the panels are configured to be installed in overlapping courses of panels along a sloped roof, and wherein the at least one water shedding feature of each of the panels in a higher course of panels is configured to cooperate with corresponding water shedding features of the panels of a lower course of panels to define pathways for directing and reducing migration of water through seams between adjacent panels of the overlapping courses of panels.

In an embodiment of the roof system, the water shedding features comprise V-shaped ridges along the peripheral side edges of the panels flanking the exposure region.

In another embodiment of the roof system, the water shedding features comprise at least one of ridges, drip edges, drain troughs, caps or combinations thereof.

A kit for constructing a roof structure, incorporating any of the foregoing types and/or constructions of roofing panels also can be provided.

The foregoing other aspects and advantages of the roofing panels and roofing systems of the present disclosure will become more apparent upon review of the detailed description set forth below taken in conjunction with the accompanying drawing figures, which are briefly described as follows.

DETAILED DESCRIPTION

General Discussion

Figure 1A:
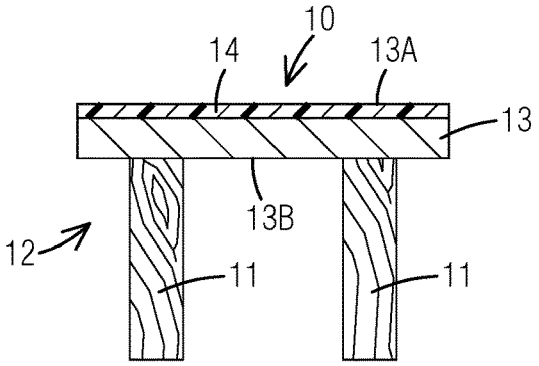
FIGS. 1*a*-1*g* show various examples of how a roofing panel may be installed on a roof according to aspects of the present disclosure.

This disclosure is directed to roofing panels that, once installed, form water shedding features that waterproof and shed water from the roof. The roofing panels are distinct and separate from materials chosen for a roofing system. They can be components that are inherent to the roofing material design, components that are added onto a selected roofing system on the top, bottom, or edge of a chosen roofing material. Since the roofing panels are distinct from the roofing material, the panels can be used with many current and future roofing systems, including roofs designed from panels, tiles, shingles, etc.

The roofing panels include, in numerous embodiments, features for waterproofing and shedding rainwater from sidelap seams of horizontally adjacent roofing panels and headlap seams of roofing panels in vertically adjacent courses. The water shedding features formed when the roofing panels are installed may be applied to the roofing panels at a manufacturing facility (prefab) or they may be applied to roofing panels in the field. The waterproofing and water shedding features disclosed herein can be applied to a variety of roofing systems including but not limited to panels, tiles, or metal roofing just to name a few.

The water shedding features disclosed in the numerous embodiments discussed below may be segregated into a number of main categories. These include (1) roofing panels with top layer water shedding features, (2) roofing panels with bottom layer water shedding features, (3) roofing panels with combination top and bottom layer water shedding features, (4) edge accessory water shedding features, and (5) other water shedding features.

Discussions of Embodiments

Reference will now be made to the drawing figures. Roofing panels according to embodiments of the present disclosure can be configured to be installed on a roof in a variety of configurations. For example, a non-structural roofing panel can be attached atop of a plywood roof deck. Alternatively, a roofing panel can replace the plywood deck if it satisfies applicable structural requirements. A structural roofing panel can replace the plywood deck and supporting rafters and trusses like a structural insulated panel (SIP), or reduce the number of rafters required by supplementing the structural integrity. As also indicated in the figures, the roofing panels can comprise a body or base having upper and lower surfaces and a series of peripheral portions or side edges, and further can be formed with various shapes or configurations.

Figure 1B:
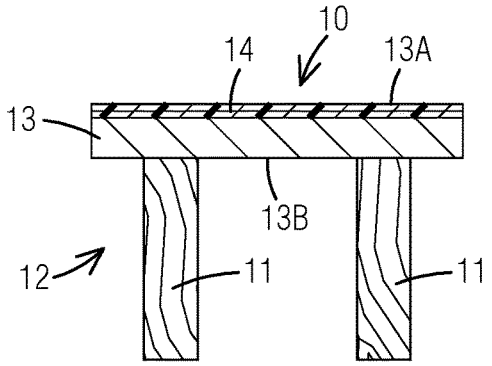
Figure 1C:
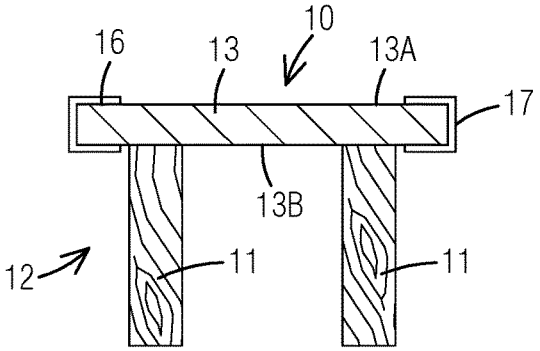
Figure 1D:
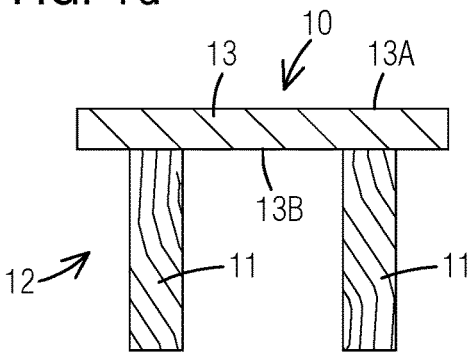
Figure 1E:
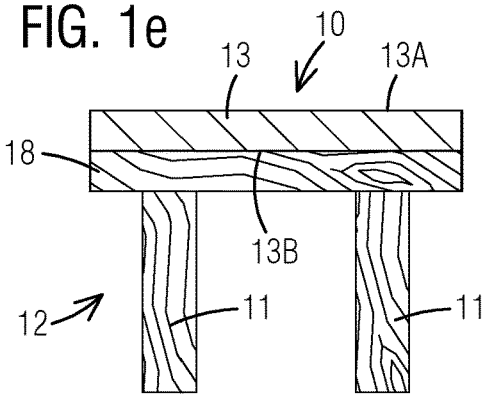

FIG. 1*a* shows an embodiment of a roofing panel 10 that can be placed over and/or mounted to rafters 11 of a roof structure 12, with the roofing panel having a base 13 with a thick upper layer of a waterproof material 14 applied thereto. For example, a thermoplastic polyolefin (TPO) membrane can be applied over an upper surface 13A of the base 13, with a lower surface 13B of the base 13 being configured to engage the rafters 11. In FIG. 1*b*, a roofing panel 10 having a base 13 with a thin upper waterproofing layer 14, including a polymer material that can be melted or fused to the upper surface 13A of the roofing panel, is shown resting atop rafters 11. FIG. 1*c* shows a roofing panel 10 with a base 13 with one or more framed peripheral edges 16, e.g. having a frame formed from a metal, plastic or other substantially rigid waterproof material attached to and protecting the peripheral edges of the base, can be used in a manner wherein the base 13 is resting atop rafters 11. While the roofing panels 10 are shown in FIGS. 1*a*-1*c* as a single roofing panel supported by two rafters 11, the roofing panels 10 can be mounted on the rafters 11 in such a manner that at least an edge portion of two adjacent roofing panels are supported on a common rafter 11. In FIG. 1*d*, a roofing panel 10 meeting required structural requirements is shown resting directly on rafters 11 and replacing at least a portion of a roof deck or substrate. FIG. 1*e* illustrates an embodiment including a non-structural roof panel 10 applied to a traditional roof deck or substrate 18.

Figure 1F:
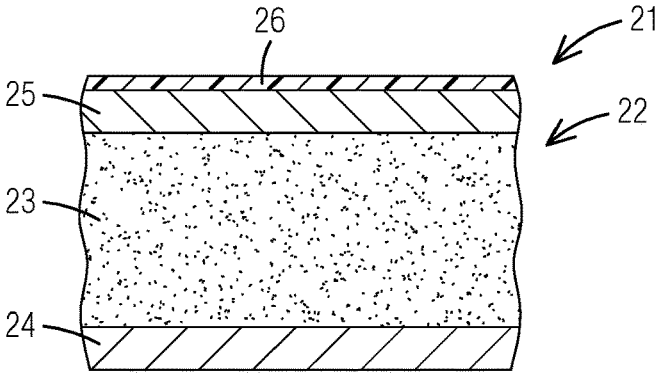
Figure 1G:
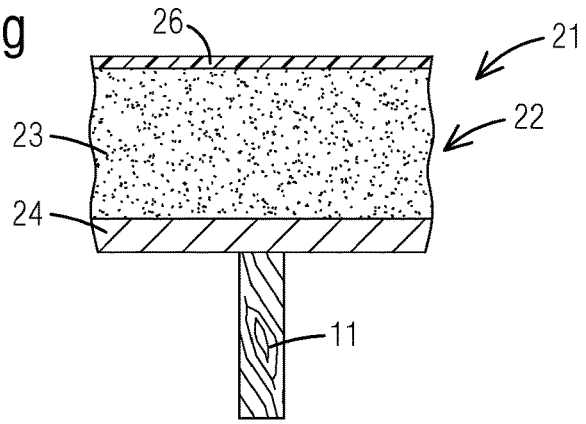
Figure 20:
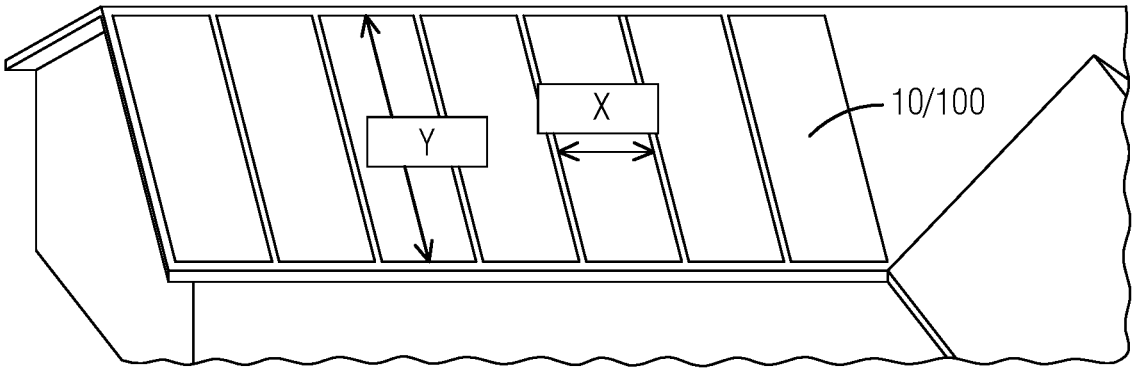
FIG. 20 illustrates the basic concept of using large roofing panels according to the present disclosures on the roof of a home with the roofing panels extending across a roof section or span between the peak or ridge of the roof and an eave of the roof, without requiring a roof deck or supporting rafters or beams.

FIG. 1*f* illustrates a structural insulated panel (SIP) type roofing panel 21 with a base 22 having a core 23, a bottom structural layer 24, mid-top structural layer 25, and a waterproof top layer 26. Here, the SIP type roofing panel can have sufficient strength to replace the rafters and the roof deck or substrate of a roof. For example, such a roofing panel can be extended across a span or roof section between a peak or ridge of a roof and a roof eave or structure wall (e.g. as illustrated in FIG. 20) without rafters or a roof deck or substrate required so as to be substantially self-supporting. Furthermore, FIG. 1*g* shows a structural roofing panel with a core 23, a bottom layer of structural material such as plywood 24, structural foam or other structural material, and which can have a waterproof top layer 26 applied or formed thereon. In this example, the roofing panel may be extended across a roof section or a span, such as extending the full length between the peak or ridge and an eave of the roof, or at least partially therebetween. Such panels may not sufficiently structurally robust to replace the rafters 11, but may allow for the reduction of the number of required rafters by enabling spacing of the rafters wider than the traditional 16 inch on center spacing.

Figure 2A:
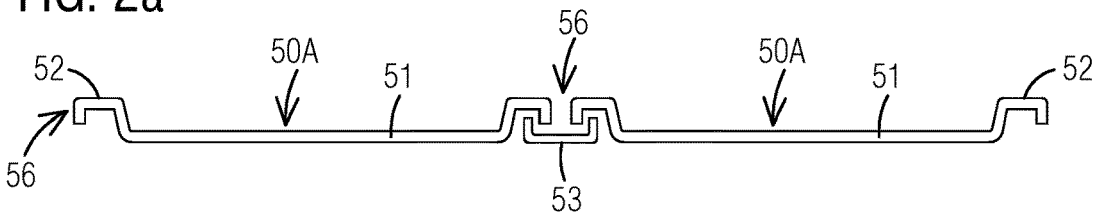
FIGS. 2*a*-2*c* show three general examples of for roofing panels that embody principles of the present disclosure.
Figure 2B:
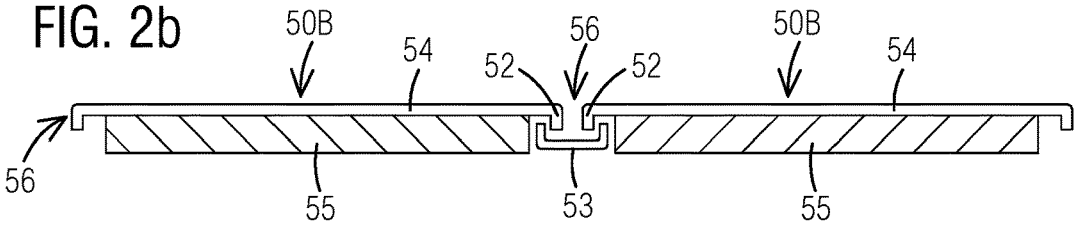
Figure 2C:
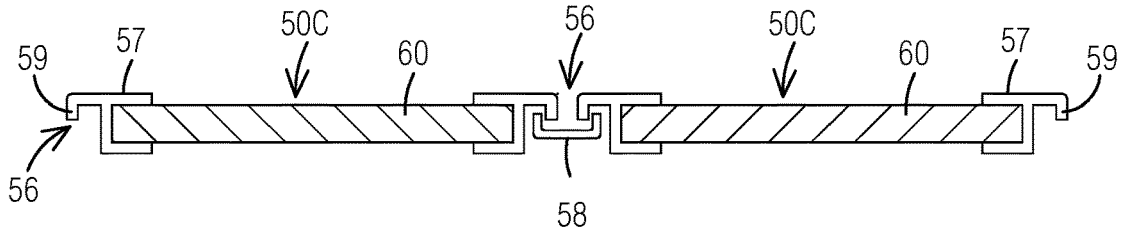

FIGS. 2*a*-2*c* show three general categories or types of roofing panels according to aspects of the present disclosure. The roofing panels can be of varying sizes, configurations and constructions; for example, including structural and/or self-supporting panels adapted to extend along a section of span of the roof such as extending a full length between a peak of the roof and an eave of the roof or to a wall of a building structure as generally illustrated in FIG. 20. FIG. 2*a* shows a roofing panel 50A that consists of a waterproof base 51 with edge features 52 and trough accessories 53 for water shedding. For example, the waterproof base 51 can be formed from a waterproof material such as metal or polymer or synthetic polymer, or composite materials, or can have a core that is encapsulated and/or sealed so as to be substantially waterproof. Such a roofing panel 50 might typically be attached directly to a roof deck or substrate such as shown in FIG. 1*e*. In addition, a vapor barrier also can be applied below the substrate or roof deck.

FIG. 2*b* shows a roofing panel 50B comprising a base 55 with a waterproof layer 54 that can be formed or applied as a top layer or a bottom layer of the base material which roofing panel can be used as a replacement for a portion of a roof deck or substrate. Water shedding features 56 are formed by edge structures 52 and trough accessories 53 to receive and direct water along a drainage path. In FIG. 2*c*, a roofing panel 50C having base is shown that is inherently waterproof and employs a ridged edge frame 57 with trough accessories 58 and/or flexible edge seals 59 for water shedding. In various embodiments, the base of such panels may comprise oriented strand board (OSB), polyisocyanurate (ISD) plywood, foam board including structural foams, polystyrene, polyvinyl chloride (PVC) plastic, concrete, a solar panel, a solar tile, pressed recycled materials, structural insulated panel materials, or other materials and combinations of any of the foregoing. These examples are, of course, not exhaustive, nor are they limiting.

Figure 3:
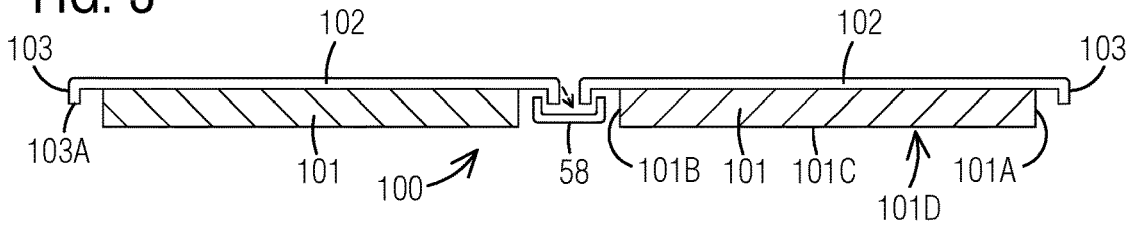
FIG. 3 shows two side-by-side roofing panels with water shedding features incorporated in a top layer of each roofing panel.

FIG. 3 illustrates a further embodiment of roofing panels 100 formed from various materials with top layer waterproofing according to aspects of the present disclosure. The roofing panels 100 may comprise a base or core 101 that can be oriented strand board (OSB), polyisocyanurate (ISD) plywood, foam board including structural foams, polystyrene, polyvinyl chloride (PVC) plastic, concrete, a solar panel, a solar tile, pressed recycled materials, structural insulated panel materials, or other materials and combinations of any of the foregoing. These examples are, of course, not exhaustive, nor are they limiting. The waterproof layer 102 (shown on top here) may be a thermoplastic polyolefin (TPO) membrane, sheet, or layer, a plastic extrusion, rolled aluminum or an aluminum extrusion, bent or rolled sheet metal, a waterproof coating or sealant, shingles of all types including solar shingles, tiles of all types including solar tiles, or any other appropriate material. The term "waterproof layer" should be construed to include all such variations of liquid resistant materials configured to substantially resist or block penetration of liquid there through. Furthermore, roofing accessories such as solar arrays, ventilation fans, attic or plumbing vents, or any other roofing accessory may be pre-installed on a roofing panel to save time and effort in the field.

Water shedding features 103 in this example embodiment can include downturned lips 103A positioned or defined along the peripheral portions or side edges 101A-101D of the waterproof layer 102 or that overlie a water trough accessory 104. The water trough accessory 104 may be a plastic extrusion, an aluminum extrusion, bent or rolled sheet metal, or an appropriate flexible waterproof sheet material, and generally will be configured to receive and direct water along a drainage path. In addition, it should be understood that many of the water shedding features discussed herein may be applied to various configurations and constructions of roofing panels as disclosed herein.

Figure 4:
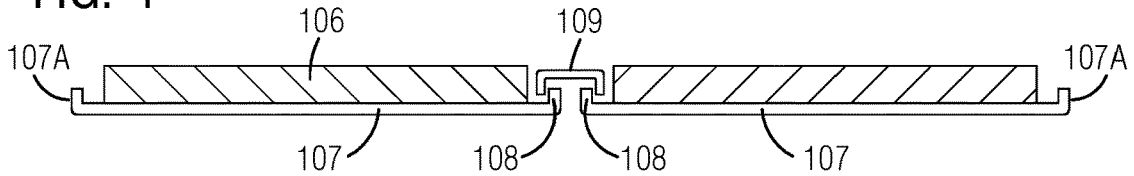
FIG. 4 illustrates two side-by-side roofing panels with water shedding features incorporated in a bottom layer of each roofing panel.

FIG. 4 illustrates a roofing panel 106 with bottom layer waterproofing 107 according to aspects of the present disclosure. Here, the roofing panel 106, which is exposed, may be easily replaceable and/or can be made of a sacrificial protective material and/or any of the various materials discussed herein. The roofing panel may have core or base 108 of a porous and relatively inexpensive material that has aesthetic features and/or energy absorbing features for resisting hail impacts. The roofing panel 106 also may have ultraviolet blocking properties, which can enable the use of less expensive material for the underlying waterproofing layer 107. In this example, the waterproofing layer 107 has upturned edges 107A that are capped between roofing panels by a water shedding cap 109.

Figure 5A:
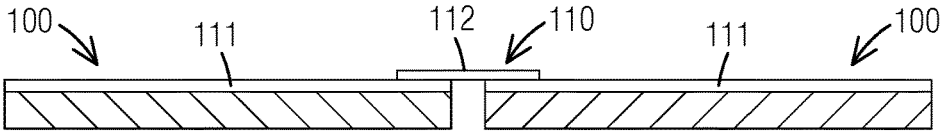
FIGS. 5*a*-5*g* illustrate alternate embodiments of sidelap water shedding features for a roofing panel as shown in FIG. 3.
Figure 5B:
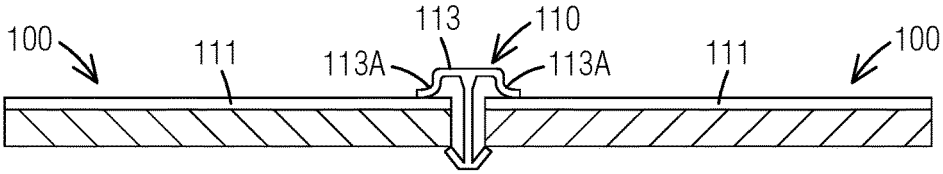
Figure 5C:
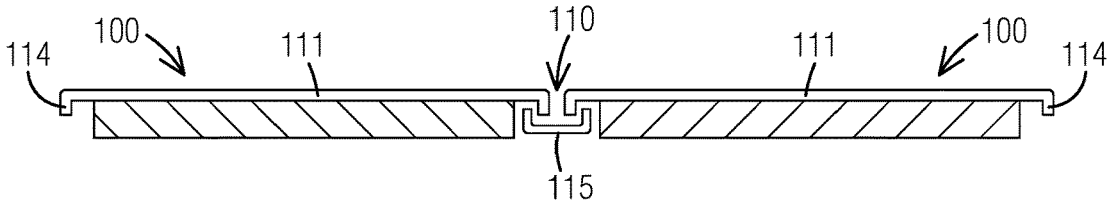
Figure 5D:
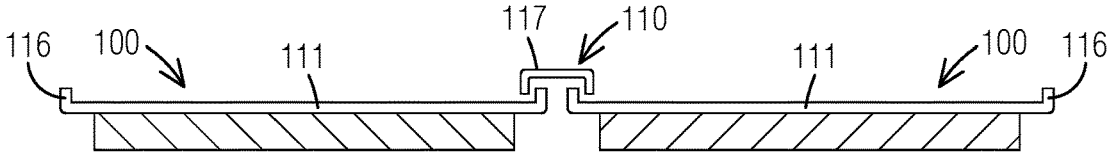

With the forgoing background in mind, FIGS. 5*a*-5*g* show various embodiments of water shedding features 110 for roofing panels 50B (FIG. 2B) and roofing panels 100 (FIG. 3) with top layer waterproofing. FIG. 5*a* shows side-by-side roofing panels with waterproof top layers 111 and with seams 112 between the roofing panels being sealed with a watertight sealing tape. FIG. 5*b* illustrates a T-extrusion 113 with flexible lip seals 113A between adjacent roofing panels, while FIG. 5*c* shows a waterproof top layer 111 with drip edges 114 overlying the peripheral edges of the roofing panels for collecting and directing water into a water trough accessory 115A below. In FIG. 5*d*, the waterproof top layer 111 of each roofing panel has upturned edges 116 forming water stops with ancillary water cap accessories 117 connecting two adjacent upturned edges 116.

Figure 5E:
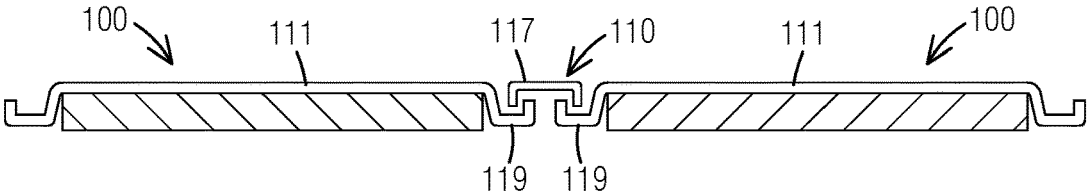
Figure 5F:
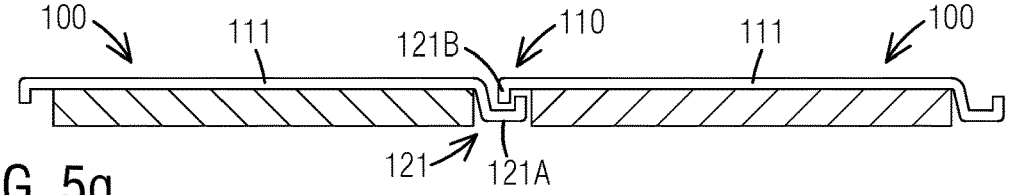
Figure 5G:
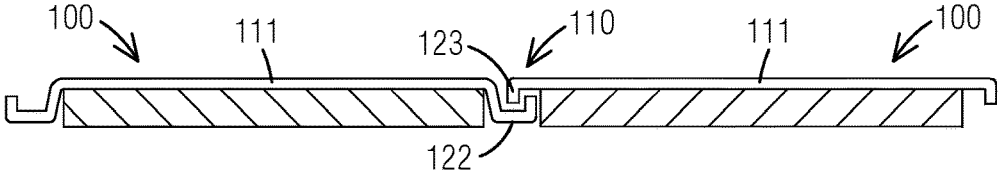

FIG. 5*e* shows roofing panels 100 having top layers 111 with recessed edge features 119 covered by accessory water caps 117 to form an installation in which the water caps 117 are flush with or below the surfaces of the waterproof layer 111. FIG. 5*f* shows roofing panels with over-under, left-right sidelap joint forming water shedding features 121 between roofing panels, wherein each waterproof layer 111 forms a trough 121A and a drip edge 121B on opposite sides thereof. FIG. 5*g* shows roofing panels wherein alternating panels have waterproofing layers 111 that form troughs 122 and the other panels have waterproofing layers that form drip edges 123.

Figure 6A:
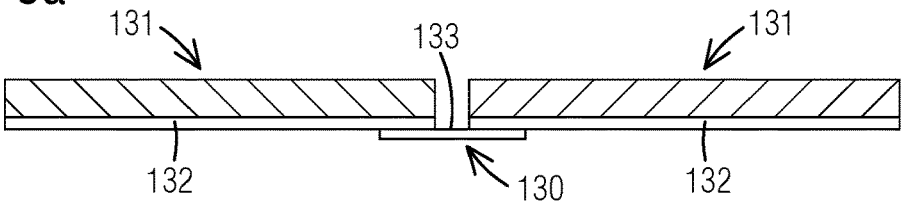
FIGS. 6*a*-6*f* illustrate alternate embodiments of sidelap water shedding features for a roofing panel as shown in FIG. 4.
Figure 6B:
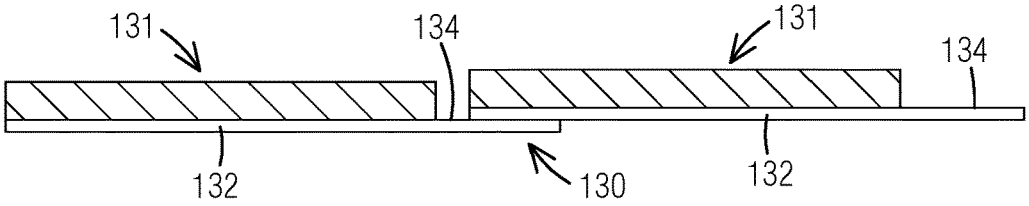
Figure 6C:
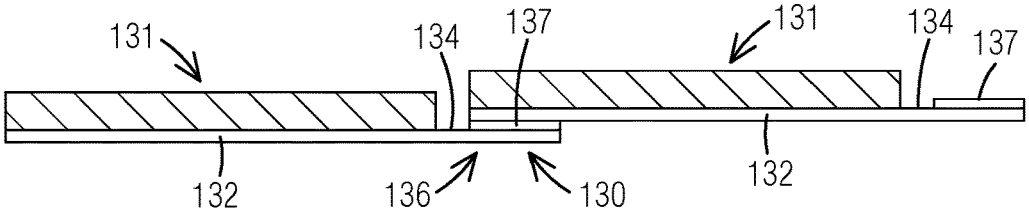
Figure 6D:
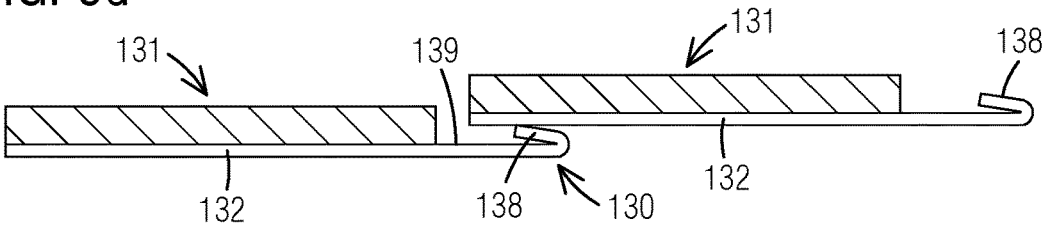

FIGS. 6*a*-6*f* show various embodiments of water shedding features 130 for roofing panels 131 with bottom layer waterproofing 132. FIG. 6*a* shows roofing panels 131 having a construction as illustrated in FIG. 4, with waterproof bottom layers 132, and with taped seams 133 along joints (e.g. handle p or side p joints) between the roofing panels. FIG. 6*b* shows roofing panels 131 with bottom layer projections 134 that are overlapped by adjacent roofing panels and FIG. 6*c* shows a similar concept with the roofing panels having a sealed overlap 136, which sealing can include adhesives or other sealant materials 137 applied as a strip, patch or layer applied between the roofing panels along the overlapping portions 136 thereof. FIG. 6*d* shows roofing panels 131 with bottom layer waterproofing 132 and a folded extension 138 overlapped by adjacent panels. The bottom waterproofing layer can include a TPO or similar polymer membrane, sheet, a metal layer or sheet, or other material sheet, the folded portion 138 of which forms a water trough 139.

Figure 6E:
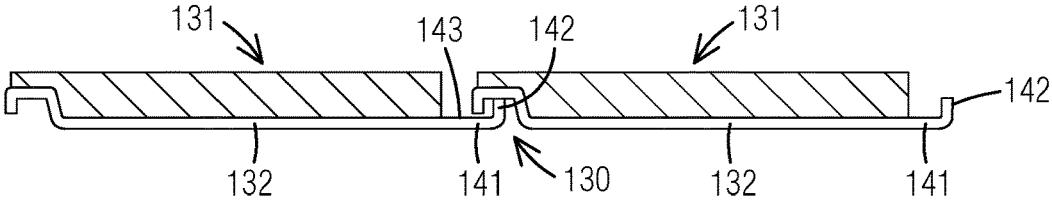
Figure 6F:
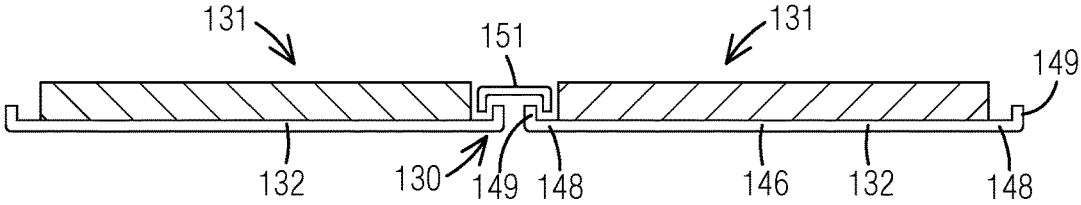

In FIG. 6*e*, waterproof bottom layers 141 of roofing panels 131 have upturned portions 142 shaped to form interacting water troughs 143 between adjacent roofing panels. FIG. 6*f* illustrates roofing panels 131 with bottom layer waterproofing 146 wherein the waterproofing layer 146 has extension portions or projections 147 that extend beyond opposed peripheral or side edges 148 of the roofing panel and are upturned at 149. The upturned edges 149 of the projections 148 projecting between adjacent panels are sealed with an overlapping cap accessory 152.

Figure 7A:
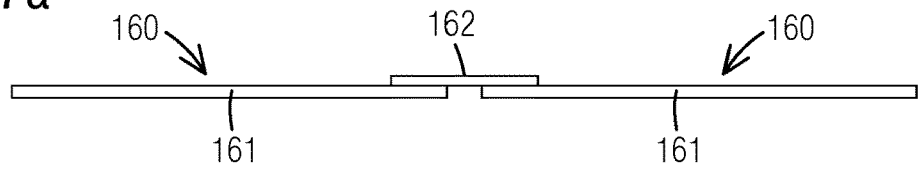
FIGS. 7*a*-7*g* illustrate alternate embodiments of roofing panels as shown in FIG. 2*a*.
Figure 7B:
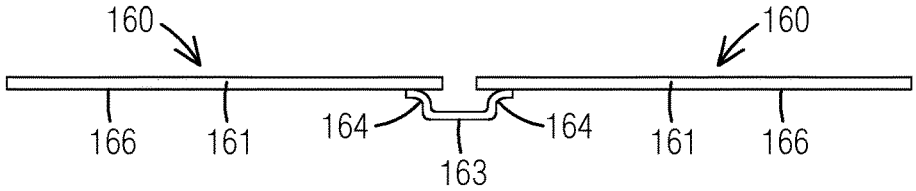
Figure 7C:
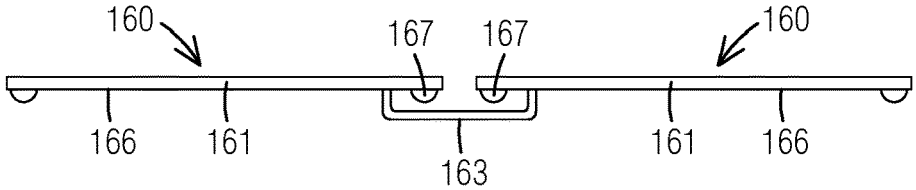
Figure 7D:
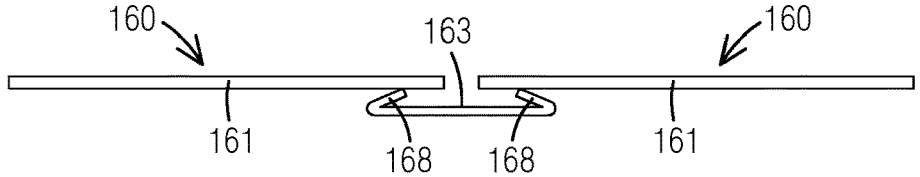

FIGS. 7*a*-7*g* illustrate concepts for sidelap sealing between adjacent roofing panels 160 that can comprise a waterproof layer 161 as shown in FIG. 2*a* (e.g. the panels can be formed from a metal or polymer waterproof material). FIG. 7*a* illustrates adjacent roofing panels 160 with taped seams 162, and FIG. 7*b* illustrates adjacent roofing panels 160 with a water trough 163 having flexible lip seals 164 contacting the bottom or undersides 166 of adjacent roofing panels 160. FIG. 7*c* shows a water trough 163 beneath two adjacent roofing panels 160 having drip edges 167 formed along the bottoms or undersides 166 of the roofing panels, and FIG. 7*d* shows adjacent roofing panels 160 with a thin water trough 163 with inwardly bent edges 168 beneath a seam defined between adjacent ones of the roofing panels.

Figure 7E:
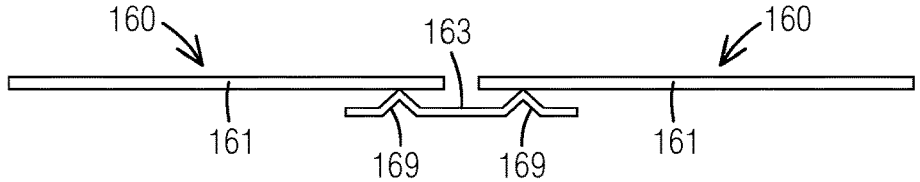
Figure 7F:
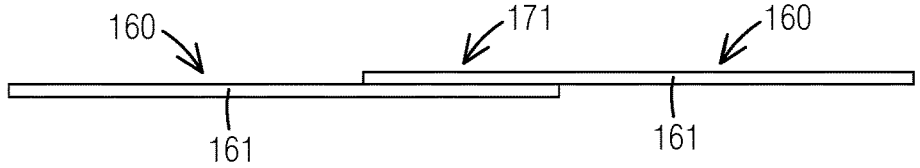
Figure 7G:
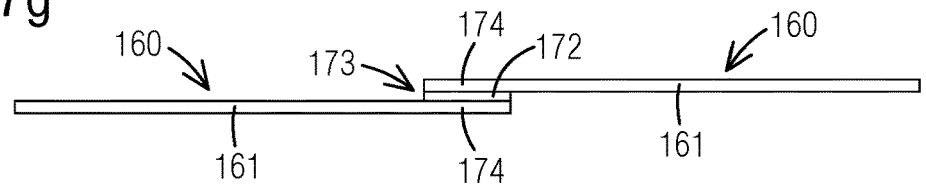

FIG. 7*e* shows adjacent roofing panels 160 with a thin water trough 163 formed by hat-shaped ridges 169 on the water trough 163. FIG. 7*f* illustrates adjacent roofing panels 160 that overlap as indicated at 171 to form a water barrier. The width of the overlap will be sufficient to prevent water migration between the roofing panels. Finally, FIG. 7*g* region 173 shows overlapped roofing panels 160 with a sealant or adhesive 172 applied between the overlapped edges 174, and which can include, for example, a peal-and-stick tape or pressure sensitive adhesive joining the panels in the region of overlap 173.

Figure 8A:
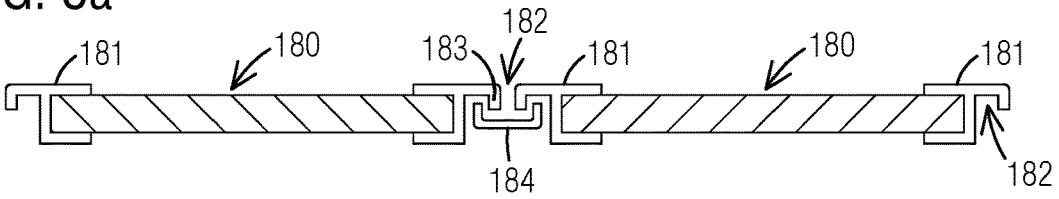
FIGS. 8*a*-8*g* illustrate alternate embodiments of sidelap water shedding features for a roofing panel as shown in FIG. 2*c*.
Figure 8B:
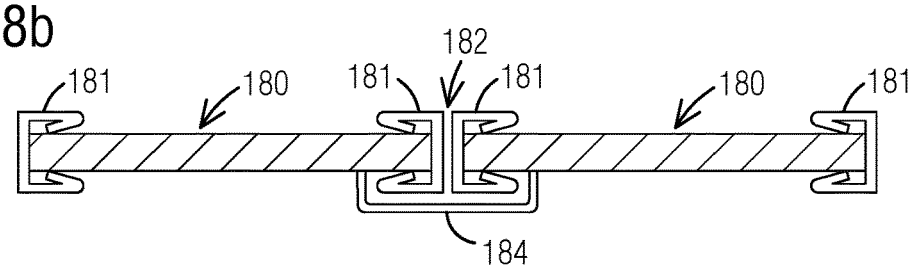
Figure 8C:
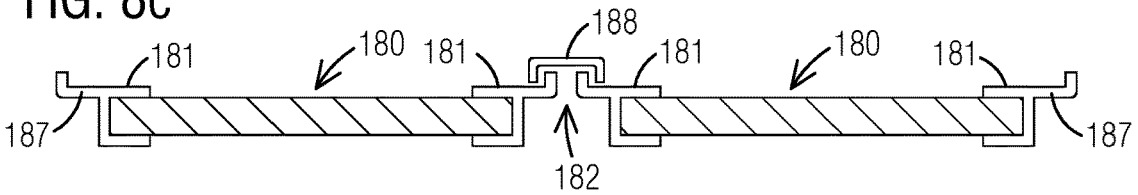

FIGS. 8*a*-8*g* illustrate embodiments of water shedding features for roofing panels 180 having side edge frames 181 with profiles or configurations that form water shedding features 182, such as shown in FIG. 2*c*. In FIG. 8*a*, the side edge frames 181 form drip edges 183 and a water trough 184 that is shown disposed beneath the drip edges. FIG. 8*b* shows a water trough 184 beneath adjacent side edge frames 186 with the water trough spanning substantially across the width of the adjacent extrusions. FIG. 8*c* shows adjacent roofing panels 180 with side edge frames 181 that form upturned flanges 187 and with a cap or cover strip 188 spanning adjacent upturned flanges.

Figure 8D:
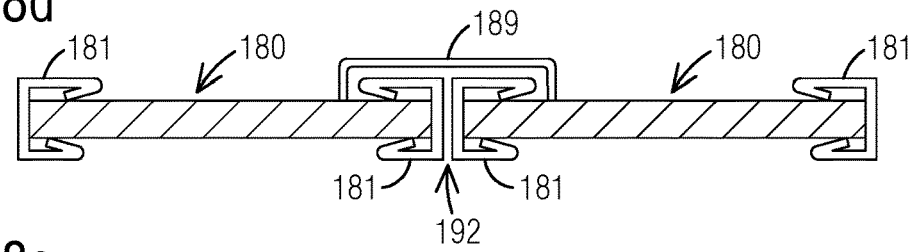
Figure 8E:
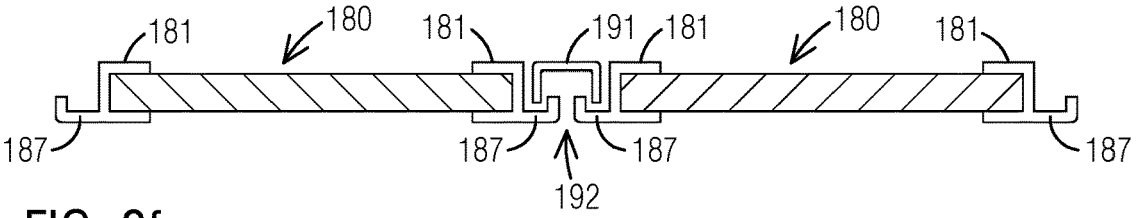
Figure 8F:
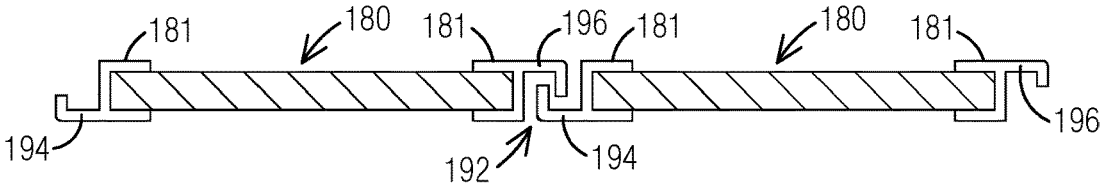
Figure 8G:
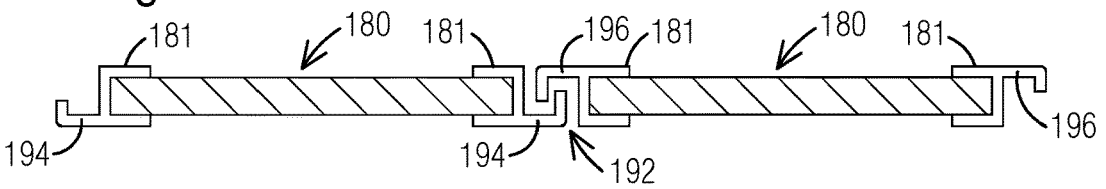

In FIG. 8*d*, two adjacent roofing panels 180 can have edge frames 181 that are abutting, and a cover strip 189 can span the width of both adjacent frame members. FIG. 8*e* shows roofing panels 180 with edge frames 181 that have extension portions that form upturned flanges 187, recessed below the top or upper surfaces 190 of the roofing panels, and which can be covered with a cover strip 191 so that the cover strip is substantially flush with the top surfaces 190 of the panels. In FIG. 8*f*, the edge frames 181 along the peripheral edges of the roofing panels can form over-under left-right sidelap joints 192, wherein each of the edge frames 181 has extension portions forming a water trough 194 and an opposing drip edge 196. The water troughs 194 and the drip edges 196 of adjacent roofing panels are paired to form the sidelap joints 192. FIG. 8*g* shows edge frames 181 with extension portions that form alternating over-under joints 193, wherein one roofing panel can have two water troughs 194 along opposite peripheral edges and the other has two drip edges 196 along opposite peripheral edges of the roofing panel.

Figure 9A:
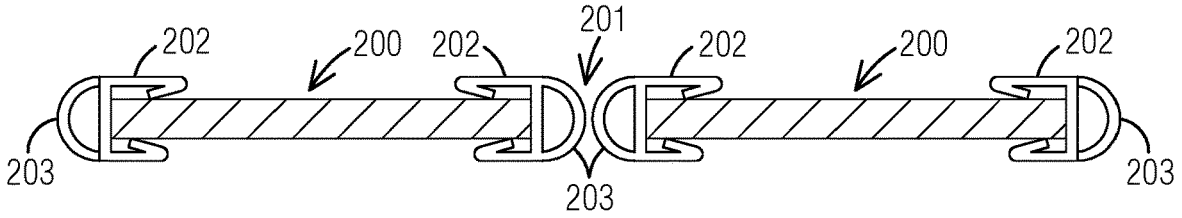
FIGS. 9*a*-9*e* illustrate alternate embodiments of sidelap water shedding features for a roofing panel as shown in FIG. 2*c* using ancillary seals.
Figure 9B:
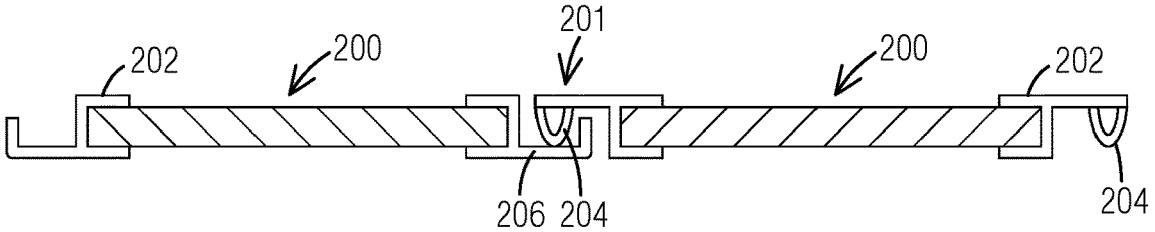
Figure 9C:
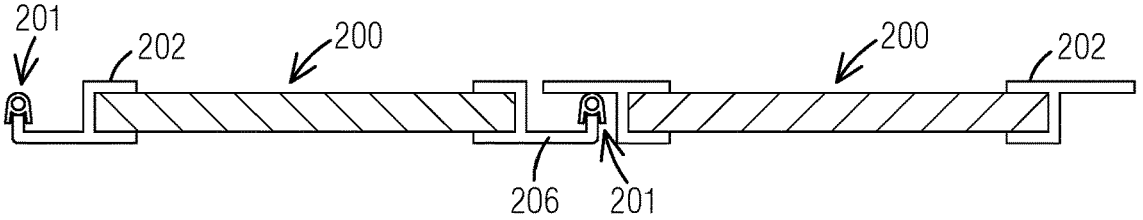
Figure 9D:
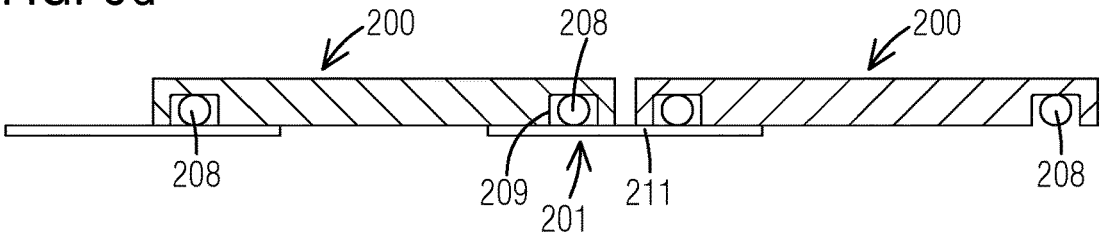
Figure 9E:
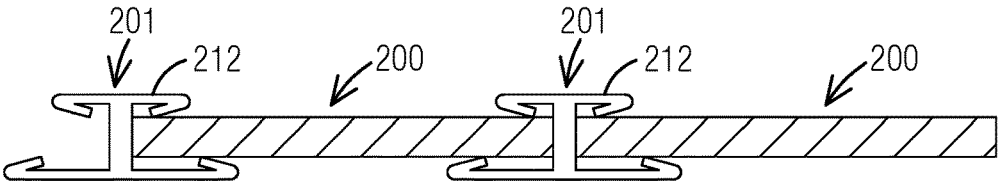

FIGS. 9*a*-9*e* illustrate embodiments of roofing panels 200 that use compressible seals 201 as part of the waterproofing layer/features and water shedding features. FIG. 9*a* shows edge frames 202 with integral horizontally compressible bubble seals 203 positioned along the peripheral edges of the roofing panels, and which form a seal when the bubble seals are compressed together. FIG. 9*b* shows vertically compressible seals 204 that are compressed against a water trough 206, and FIG. 9*c* shows compressible seals along edges of water troughs 206 that are compressed against a bottom surface of drip edges of adjacent roofing panels. FIG. 9*d* shows seal strips or spray foam seals 208 received in channels 209 that are compressed against a flat water channel strip 211 to form waterproof drainage troughs or pathways. FIG. 9*e* shows two roofing panels joined by a single flexible and compressible extrusion 212 that is configured to be applied or engaged along peripheral edges of adjacent roofing panels. Roofing panels may be assembled according to this embodiment on site.

The forgoing embodiments are particularly useful in sidelap joints between horizontally adjacent roofing panels, although some are usable for headlap joints between vertically adjacent roofing panels as well. Following are descriptions of embodiments particularly useful for headlap joints.

Figure 10A:
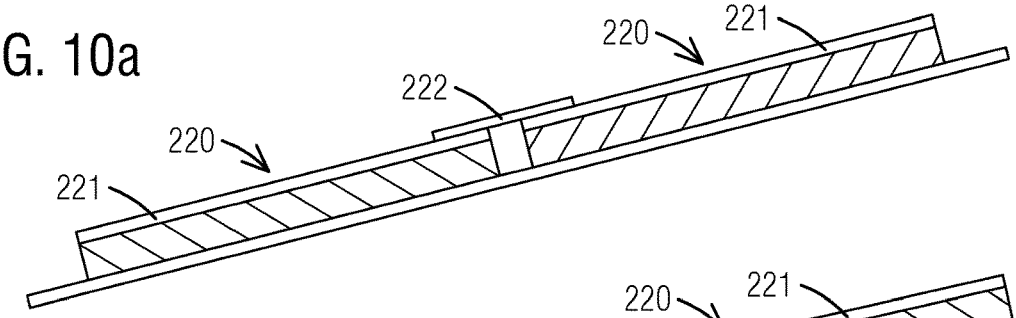
FIGS. 10*a*-10*f* illustrate alternate embodiments of headlap water shedding features for a roofing panel as shown in FIG. 2*b*.
Figure 10B:
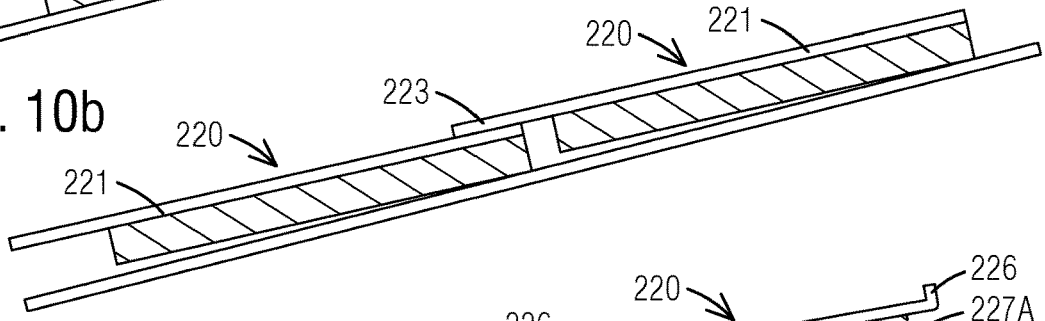
Figure 10C:
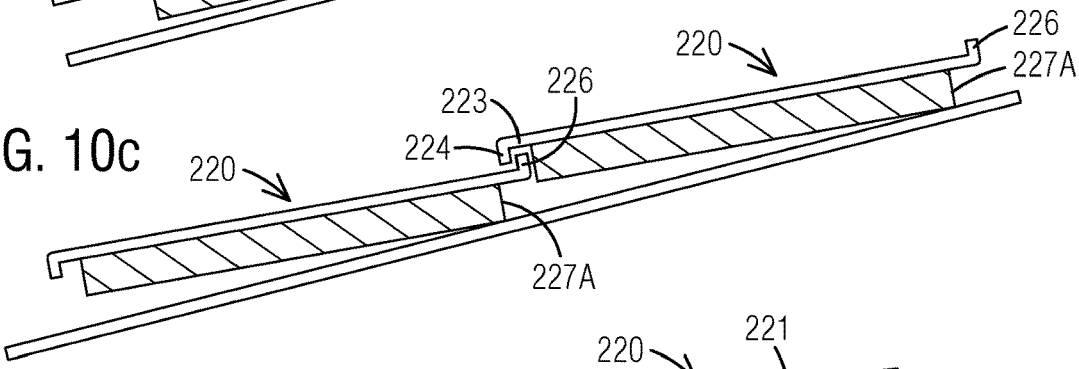
Figure 10D:
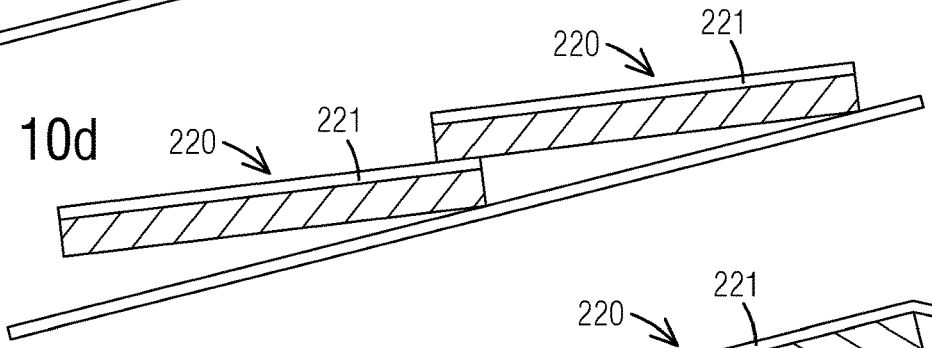
Figure 10E:
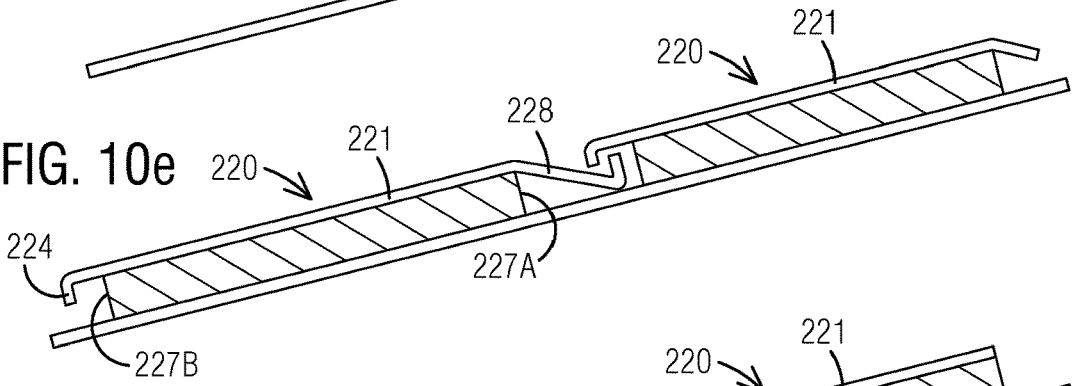
Figure 10F:
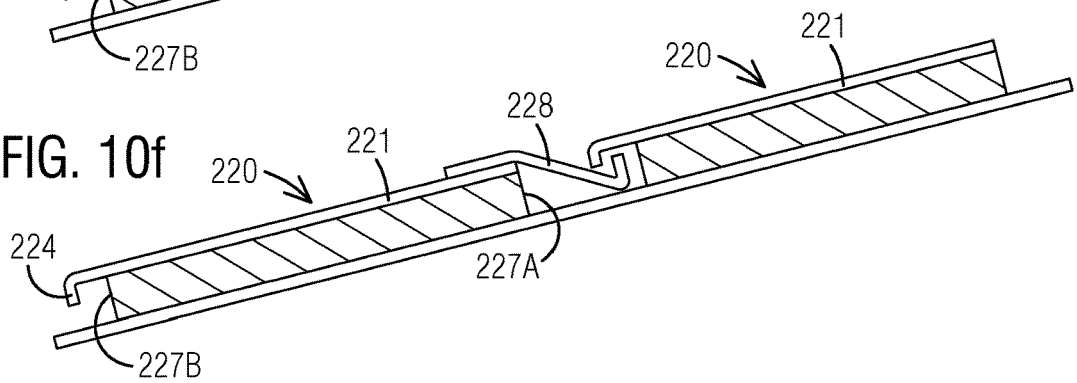

FIGS. 10*a*-10*f* show embodiments of headlap joints between vertically adjacent roofing panels with waterproof top layers. In FIG. 10*a*, the roofing panels 220 have a waterproof top layer 221 with taped headlap seams 222 and in FIG. 10*b* a top layer extension portion or projection 223 of the upper roofing panel overlaps the top layer 221 of the lower roofing panel. FIG. 10*c* shows an overlapping top layer projection 223 with a drip edge 224 downslope of a water stop 226 along a back peripheral edge 227A of the lower roofing panel. In FIG. 10*d*, a portion of the upper roofing panel is overlapped with or positioned onto the lower roofing panel to create a stepped profile. FIG. 10*e* illustrates roofing panels that have a stepped-down water ramp 228 along their upper or back edges 227A and a drip edge 224 along their lower or front edges 227B. These features cooperate to shed water from the upper roofing panel onto the lower roofing panel. In 10*f*, the stepped-down water ramp 228 is shown as a separate transition feature that is adhered to and extends along the upper edges of roofing panels.

Figure 11A:
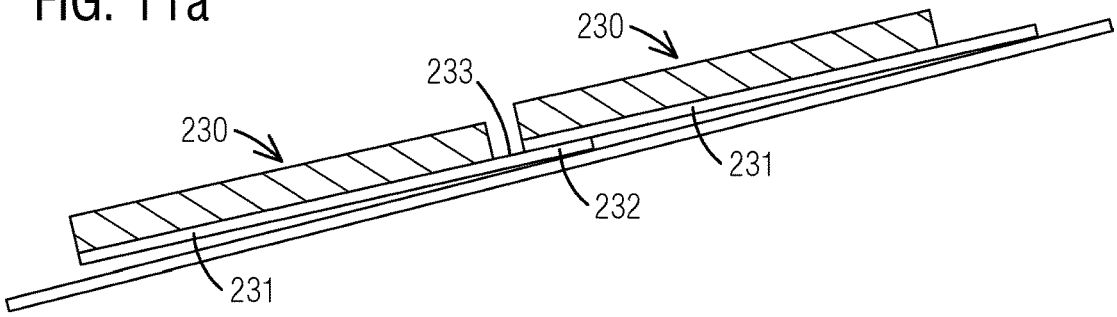
FIGS. 11*a*-11*e* illustrate alternate embodiments of headlap water shedding features for a roofing panel as shown in FIG. 4.
Figure 11B:
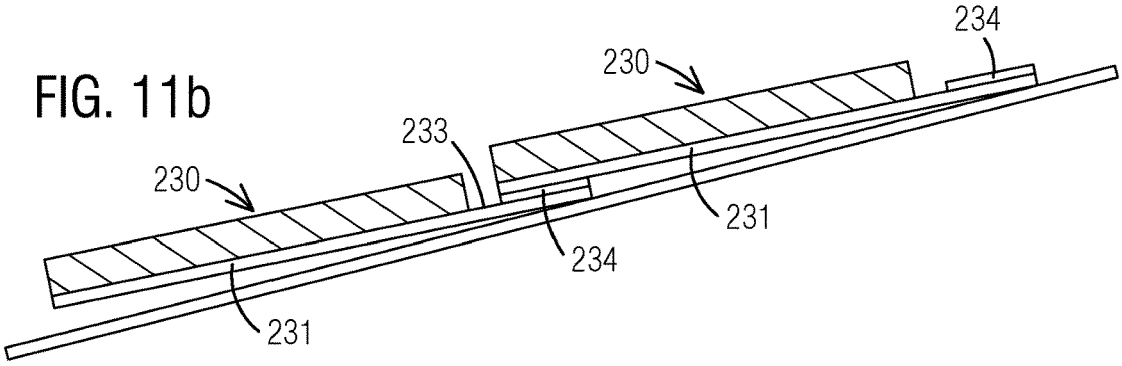
Figure 11C:
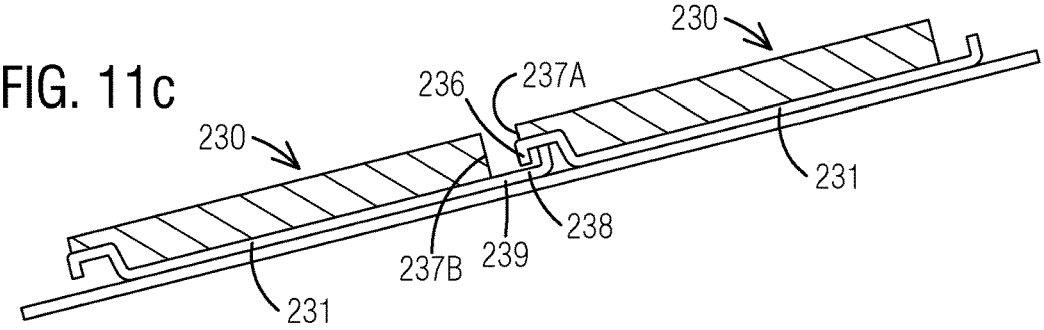
Figure 11D:
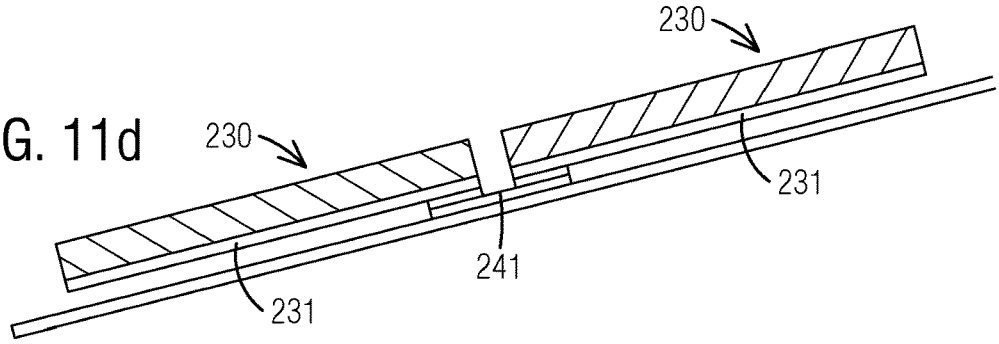
Figure 11E:
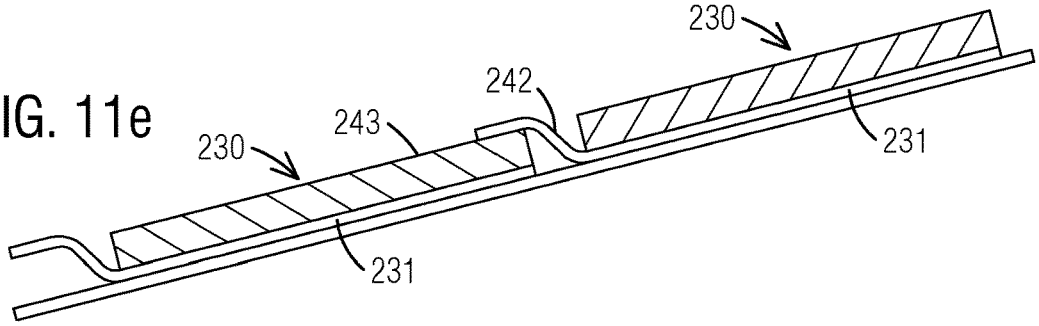

FIGS. 11*a*-11*e* show embodiments of headlap joints between vertically adjacent roofing panels 230 with waterproof bottom layers 231. FIG. 11*a* shows a roofing panel with a bottom layer projection 232 that is overlapped by a vertically adjacent roofing panel. In this embodiment, water is diverted from the headlap joint or seam 233 over to the sidelap seams or joints. FIG. 11*b* shows the region of overlap 234 between the vertically adjacent roofing panel and bottom projection layer is sealed, e.g., with a sealing material or portion. In FIG. 11*c*, the waterproof bottom layer 231 is formed with a drip edge 236 along the front peripheral edge 237A of a panel and a water stop 238 along the back peripheral edge 237B of the panel. The front and back edges overlap to form a water shedding trough 239. In FIG. 11*d*, the waterproof bottom layers of vertically adjacent roofing panels are sealed along their seams with peel-and-stick tape or pressure sensitive adhesive material 241, and in FIG. 11*e*, the upper vertically adjacent panel has a waterproof bottom layer 231 that forms a water ramp 242 up to the top surface 243 of the lower vertically adjacent panel.

Figure 12A:
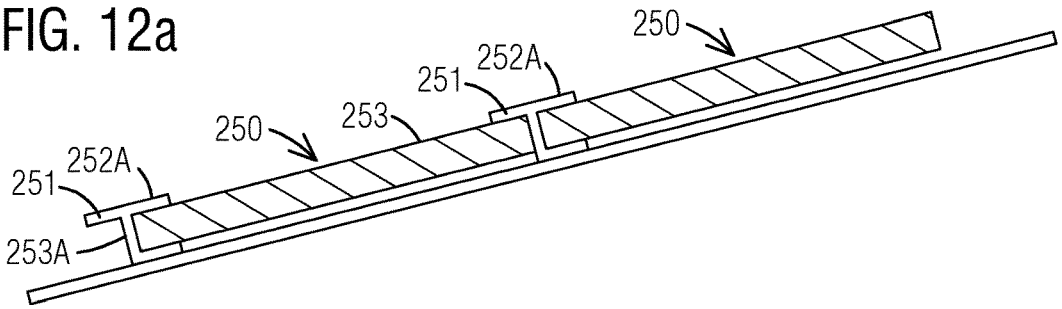
FIGS. 12*a*-12*e* illustrate alternate embodiments of headlap water shedding features for a roofing panel as shown in FIG. 2*c*.
Figure 12B:
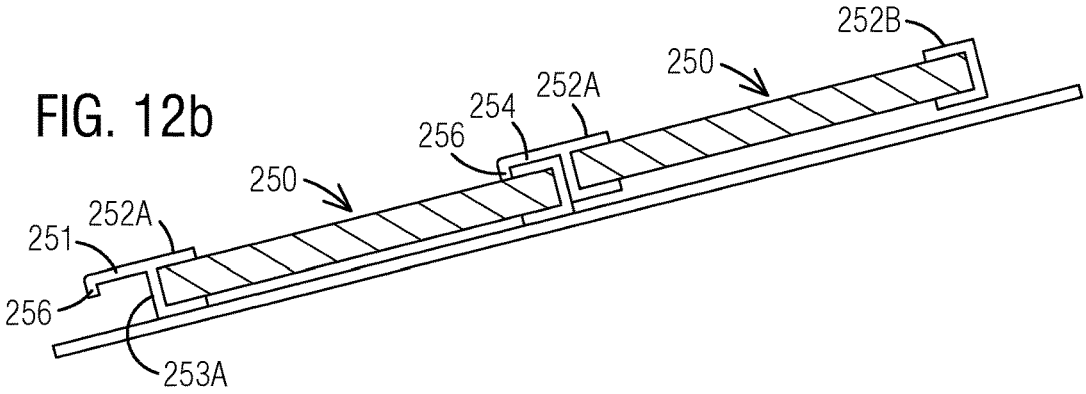

FIGS. 12*a*-12*e* illustrate embodiments of headlap water shedding features for an edge framed roofing panel 250, such as that shown in FIG. 2*c*. In FIG. 12*a*, an extension 251 formed along the downslope edge frame 252A forms an overlap that directs water toward the top surface 253 of the lower vertically adjacent roofing panel. In FIG. 12*b*, an extension portion 254 on the downslope edge frame 252A forms a drip edge 256 and the upslope edge frame 252B forms a water stop.

Figure 12C:
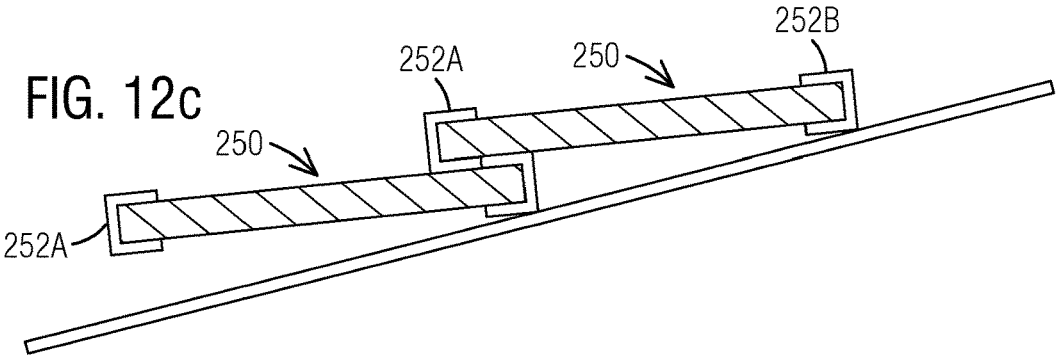
Figure 12D:
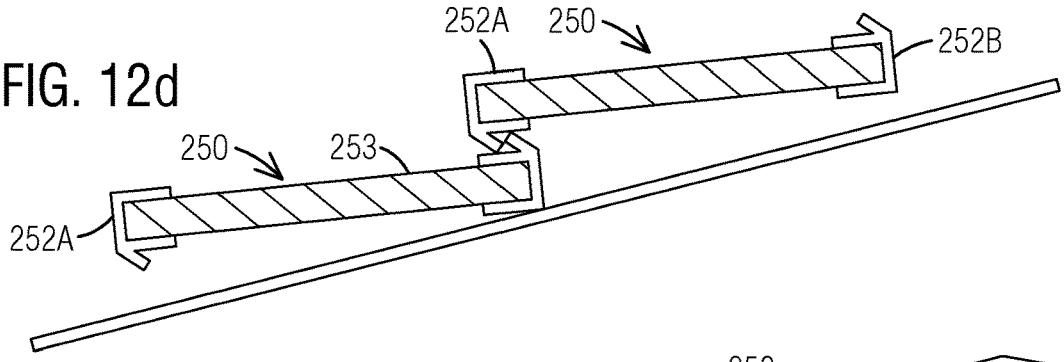
Figure 12E:
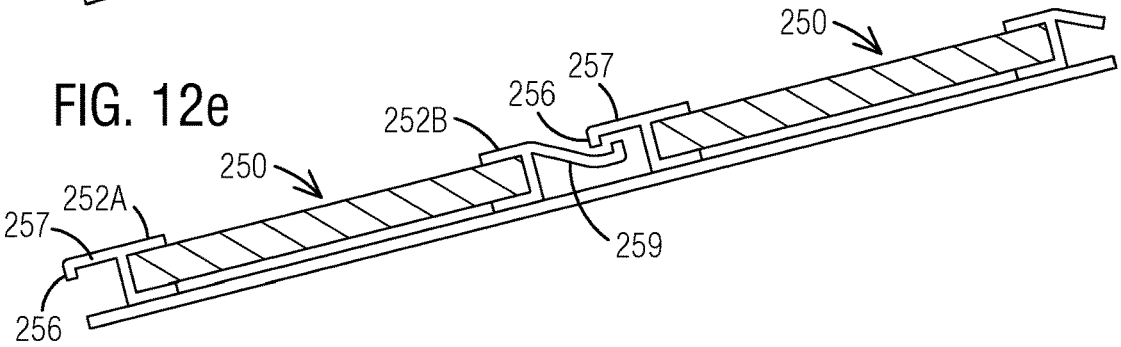

FIG. 12*c* shows entire roofing panels overlapped to form vertical water barriers, and FIG. 12*d* shows downslope and upslope edge frames 252A/252B that overlap and form a drip edge 256 and a water stop respectively. FIG. 12*e* shows flush mounted roofing panels with the downslope edge frames 252A including an extension 257 with a drip edge 256 and with the upslope edge frames 252B forming a water stop and a water ramp 259 to direct vertically flowing water onto the lower roofing panel.

Figure 13A:
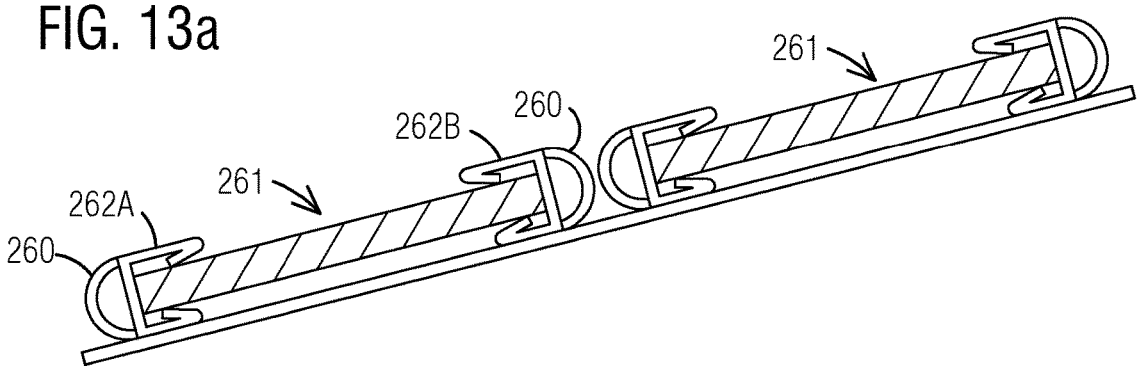
FIGS. 13*a*-13*d* illustrate alternate embodiments of headlap water shedding features that utilize ancillary seals to prevent water penetration.
Figure 13B:
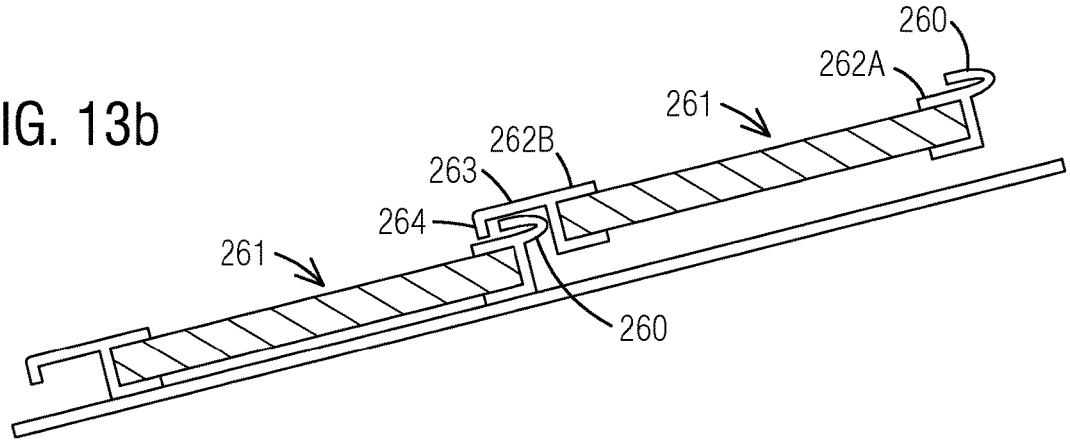

FIGS. 13*a*-13*d* illustrate embodiments of headlap sealing features utilizing flexible seals 260 for water containment and shedding. The roofing panels 261 in FIG. 13*a* have compressible bubble seals 260 along their upslope and downslope edge frames 262A/262B that compress together to form a seal. In FIG. 13*b*, a downslope edge frame 262B on each roofing panel forms includes an extension 263 with drip edge 264 and the upslope edge frame 262A has a flexible lip seal 265 that seals against the bottom of the overlapping extension and forms a water stop.

Figure 13C:
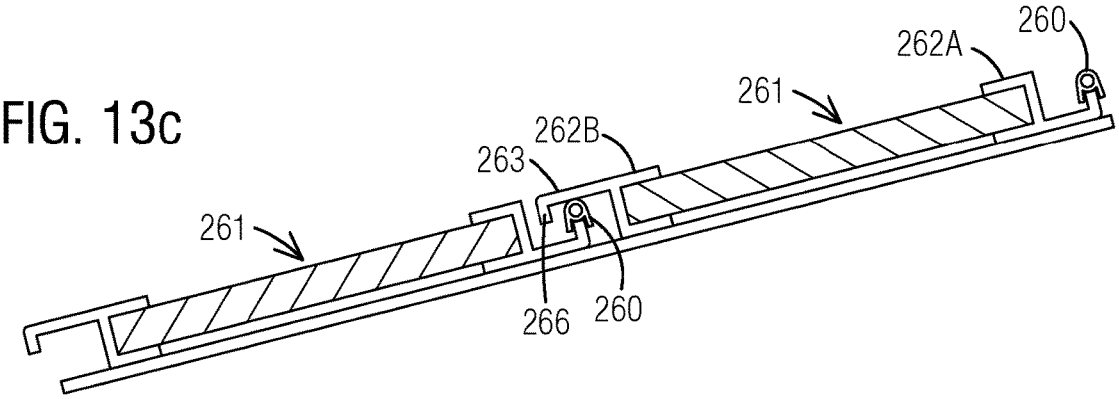
Figure 13D:
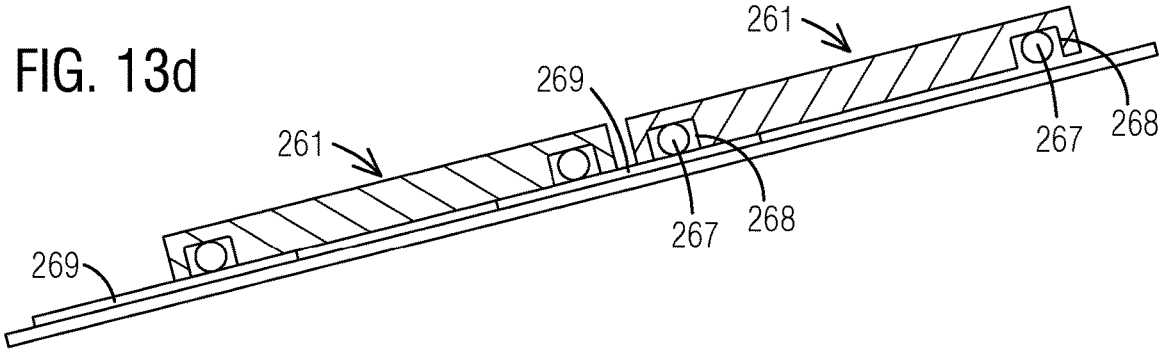

FIG. 13*c* illustrates an embodiment with a downslope edge frame 262B that forms an extension 263 with a drip edge 264 and an upslope edge frame 262A that forms a water trough 266. A flexible bulb seal 260 is disposed along the back of the water trough and compresses against the bottom of the extension of a vertically adjacent roofing panel to form a seal. FIG. 13*d* shows an embodiment wherein a sealant bead or spray foam 267 seals a channel 268 on the underside of roofing panels to an underlying flat water channel strip 269 to direct water horizontally.

Figure 14A:
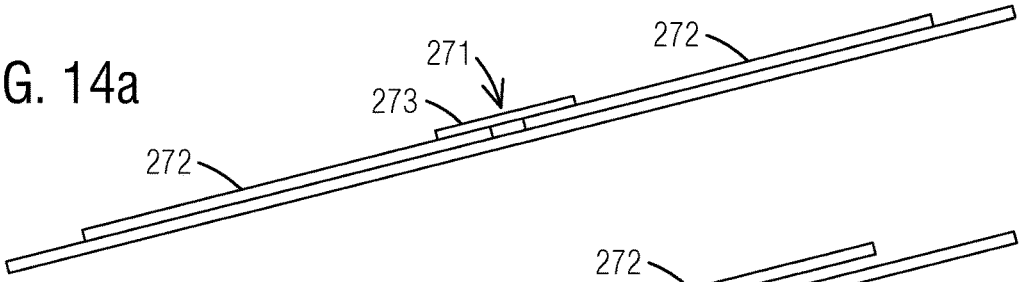
FIGS. 14*a*-14*g* illustrate alternate embodiments of headlap water shedding features for a roofing panel as shown in FIG. 2*a*.
Figure 14B:
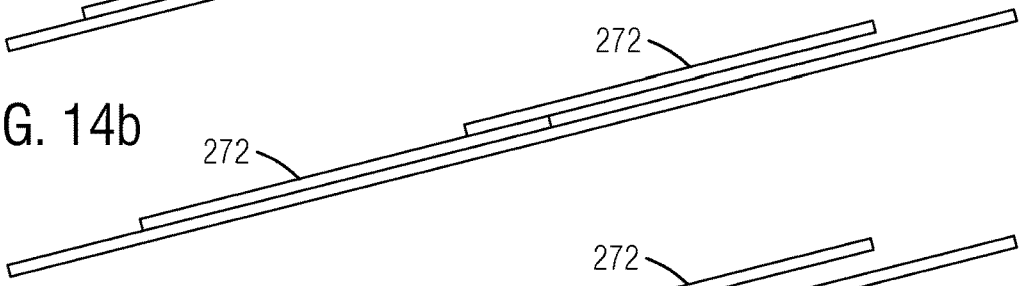
Figure 14C:
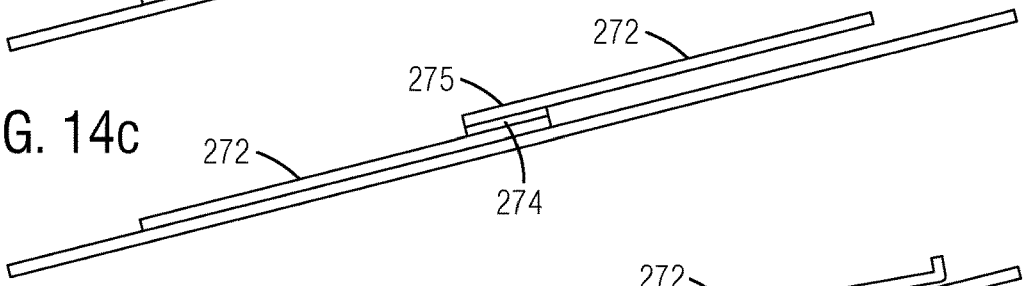
Figure 14D:
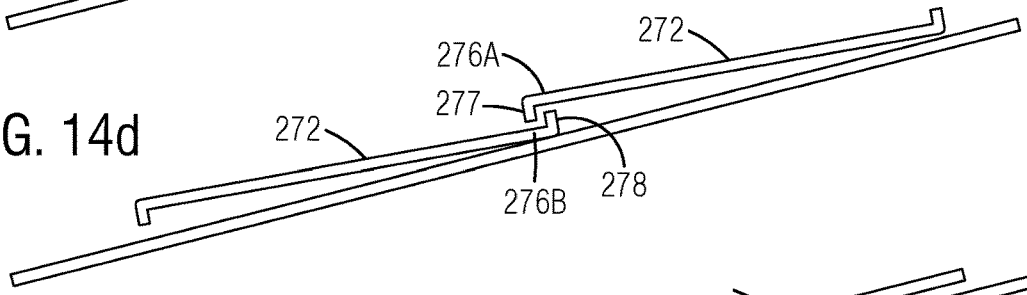
Figure 14E:
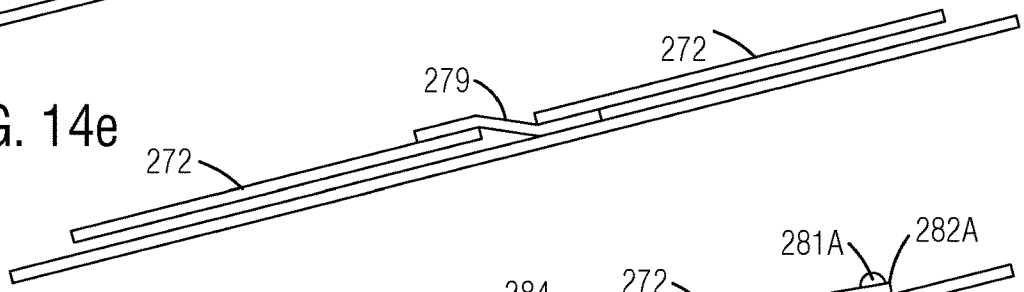

FIGS. 14*a*-14*g* show embodiments of headlap water shedding features 271 for a waterproof layer only panel 272, such as that shown in FIG. 2*a*. FIG. 14*a* shows vertically adjacent panels with taped seams 273, FIG. 14*b* shows overlapping panels, and FIG. 14*c* shows overlapping panels with a sealing adhesive 274 in the regions of overlap 275. FIG. 14*d* shows panels with overlapping edges 276A/276B that form a drip edge 277 and a water stop 278. FIG. 14*e* shows a transition feature 279 between vertically adjacent panels that directs water to the top surface of a next lower vertically adjacent panel.

Figure 14F:
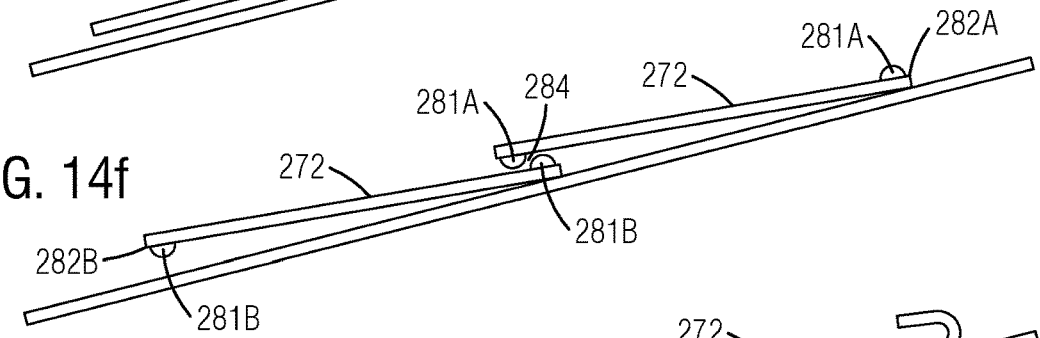
Figure 14G:
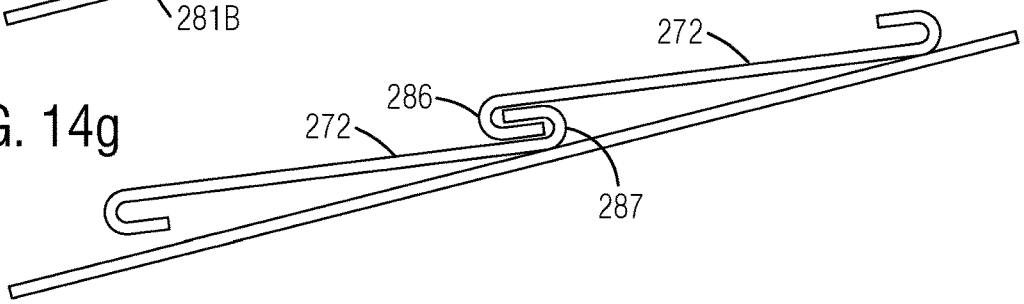

FIG. 14*f* shows roofing panels 280 wherein a top rib or bump 281A is formed along the upper edge portion 282A of each panel and forms a water stop 283, while a bottom rib or bump 281B along the lower edge portion 282B of each panel forms a drip edge 284. In some embodiments, each of the top and bottom ribs or bumps 281A/281B can be created by a bead of caulk or an adhesive. FIG. 14*g* illustrates roofing panels with under-turned hooks 286 along their downslope edges and overturned hooks 287 along their upslope edges. The edges hook together so that the under-turned edges form drip edges and the overturned edges form water stops.

FIGS. 15-61 illustrate various example enhancements of roof installations or roof structures that can be constructed utilizing various types of roofing panels with watershedding features according to any of the foregoing embodiments disclosed above with respect to FIGS. 2*a*-14*g*. The roofs constructed with the various types of roofing panels according to the present disclosures are illustrated for use with sloped roofs, including, but not limited to, residential or other steep sloped roofs. Other types of roofs also can be constructed.

Figure 15:
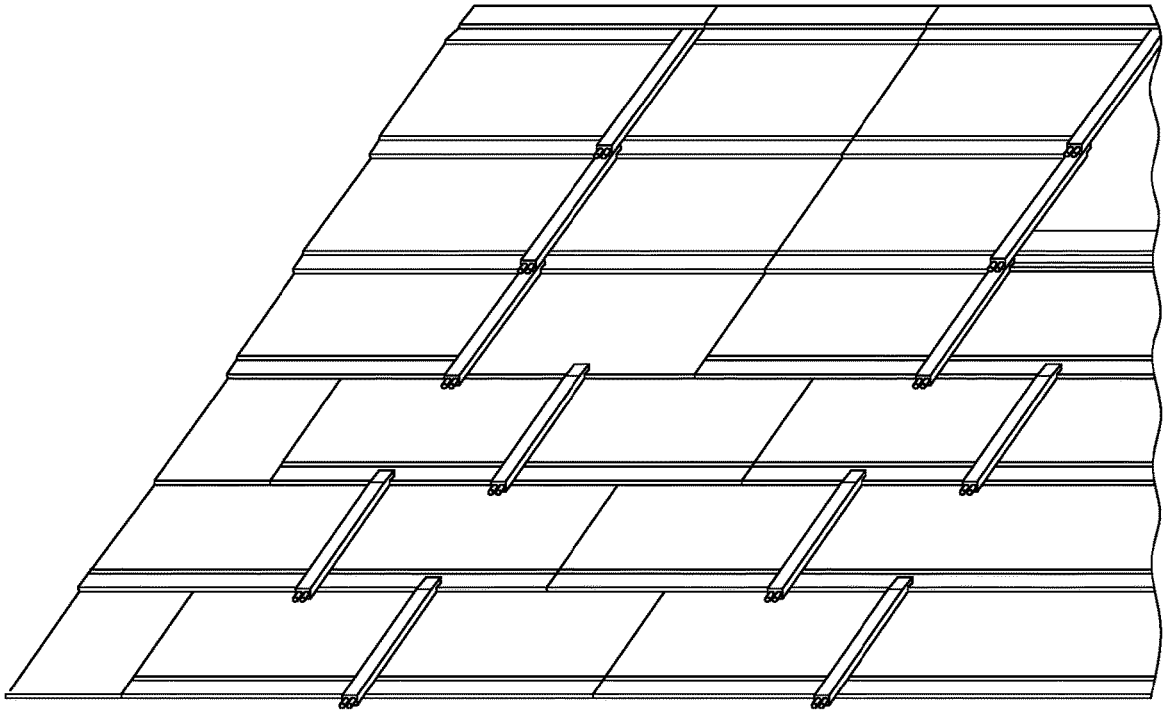
FIG. 15 illustrates the installation of roofing panels of the present disclosure in an offset relationship or in an aligned relationship.
Figure 16:
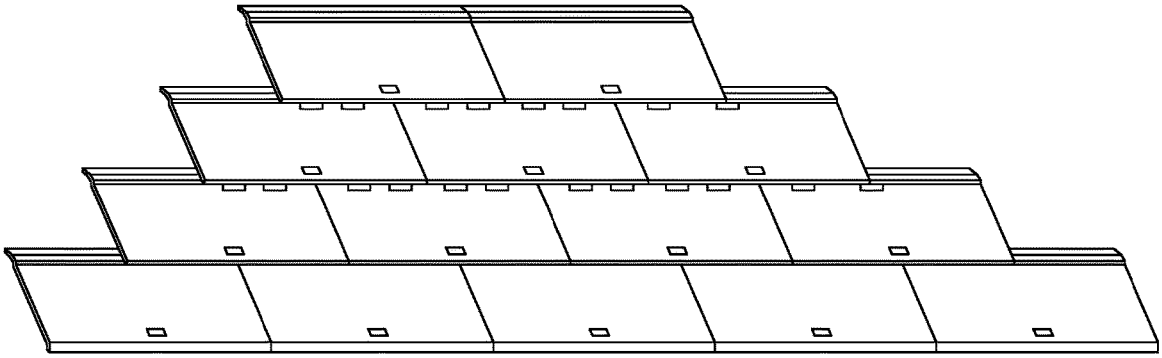
FIGS. 16 and 17 illustrate roofing panels installed in offset relationships.
Figure 17:
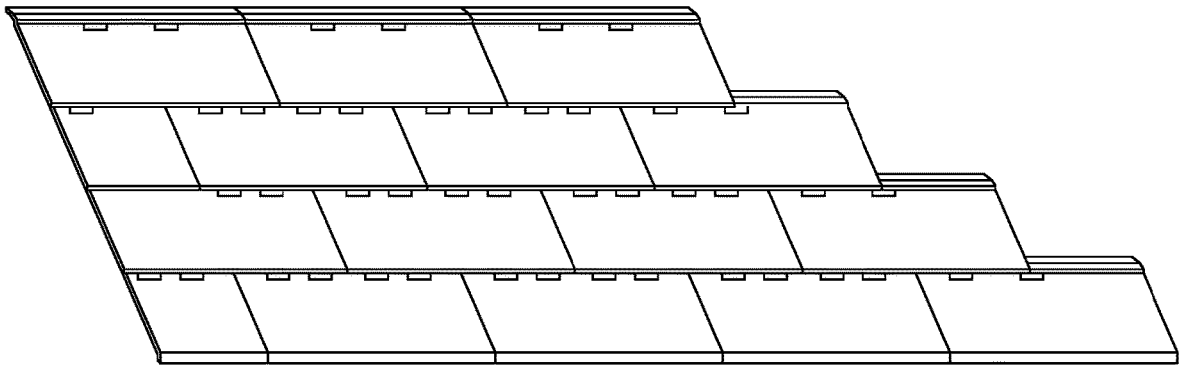

FIG. 15 illustrates an example roofing panel installation wherein some roofing panels at the top of the drawing are installed in parallel relationships to each other and other panels at the bottom of the image are installed in offset relationships to each other. In addition, the roofing panels can be installed in an interlocking or coupled engagement, which can enable removal and replacement or interchanging of roofing panels of different types or panels having varying configurations. Either is possible and within the scope of the present disclosure. FIG. 16 shows a plurality of roofing panels installed in offset relationships with both ends angled. This is primarily beneficial for roof sections with a hip and/or valley on both ends as on the left in FIG. 18. FIG. 17 shows an offset panel installation with half panels filling gaps at one end. Such a configuration is beneficial for a roof section with a hip or valley on one end and a rake on the other end.

Figure 18:
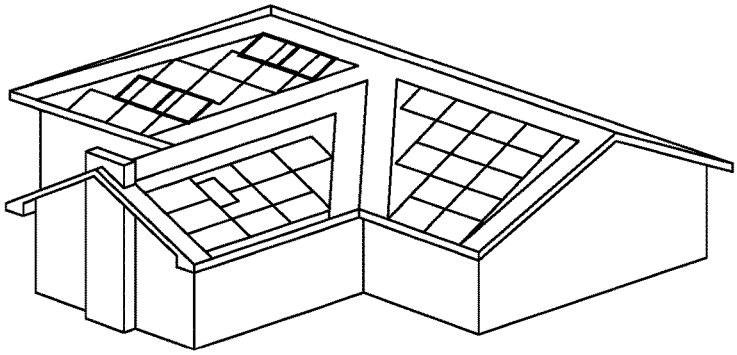
FIG. 18 illustrates an embodiment of roofing panels according to the present disclosures may be installed on the roof of a house in offset relationships.
Figure 19:
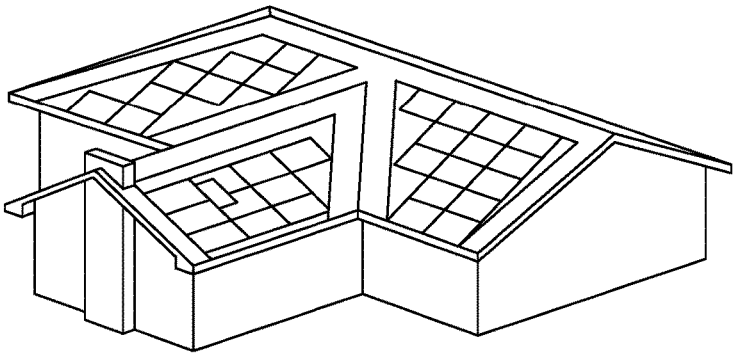
FIG. 19 illustrates how roofing panels according to the present disclosures may be installed on the roof of a house in aligned relationships.

FIG. 18 shows a house with an installation of offset panels on a right roof section having a valley on one side and a hip on the other. FIG. 19 shows a house with installations of parallel aligned roofing panels on each section of the roof. In each case, gaps are left along angled edges of the installations, which can be filled with partial and/or specially shaped roofing panels as discussed in more detail below.

FIG. 20 illustrates the use of very large roofing panels 10/100 that can have a construction and/or configuration according to one or more of the foregoing embodiments, and can be formed with a length sufficient to extend across or over a span or roof section from the ridge or peak of the roof structure all the way to the eave of the roof structure or to an upper end portion of a wall of the building (i.e., along or across substantially the entire distance between eave and peak), as shown in FIG. 20. The panels 10/100 can be constructed to be substantially self-supporting, for example, SIP or other structural roofing panels can be used, configured to and extend along the slope of the roof and across a span or roof section of the roof, as a replacement for portions of the roof deck or substrate and at least a portion of the supporting rafters of the roof, enabling formation of a roof that incorporates the water shedding features of various embodiments of the present disclosure, without requiring supporting rafters, beams or a roof deck or substrate thereunder. The panels 10/100 can be structural, self-supporting panels secured to the ridge or peak of the roof at a first or upper end and to the eave of the roof structure at a second or lower end, and can be coupled to adjacent panels, such as by sealants or adhesives, or by fasteners or other connectors that can enable attachment and detachment of and interchangeability of panels as desired.

The use of such panels can provide numerous benefits including, but not limited to, the elimination of headlaps and consequently the need for headlap water shedding features. Horizontal seams, which may seem unsightly, also can be eliminated. Many of the sidelap water shedding feature embodiments described above may be used between horizontally adjacent panels in this embodiment. Another benefit is that these large roofing panels can be made sufficiently strong to provide their own structural support thus substantially eliminating or greatly reducing the need for trusses, rafters, and/or roof decks.

Figure 21:
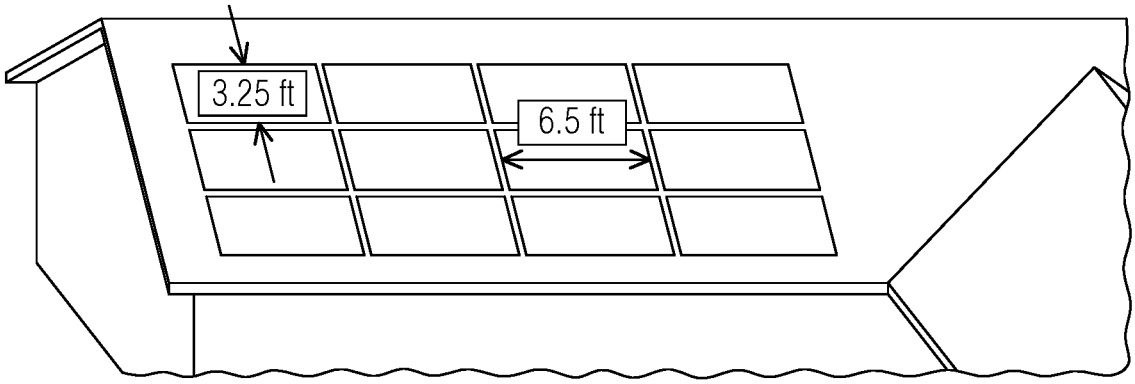
FIG. 21 illustrates the use of roofing panels according to the present disclosure having the size of roofing panels matched to the size of a typical solar panel to create a roof where some or all of the roofing panels may be solar panels.

FIG. 21 illustrates an embodiment wherein the roofing panels can be sized or configured to match the size or configuration of a typical solar panel, for example, 3.25 feet by 6.5 feet for a 72 cell panel. Any or all of the water shedding feature embodiments described above may be used. In addition, the panels can include a frame with releasable connectors, such as clips, snaps, magnets, hooks, fasteners, brackets/battens, or other connectors, enabling removal and replacement or change-out as needed. With such a sizing strategy, a waterproofing layer on the top of a panel can be replaced by a solar panel without changing or disturbing the water shedding capabilities of the installation.

Figure 22:
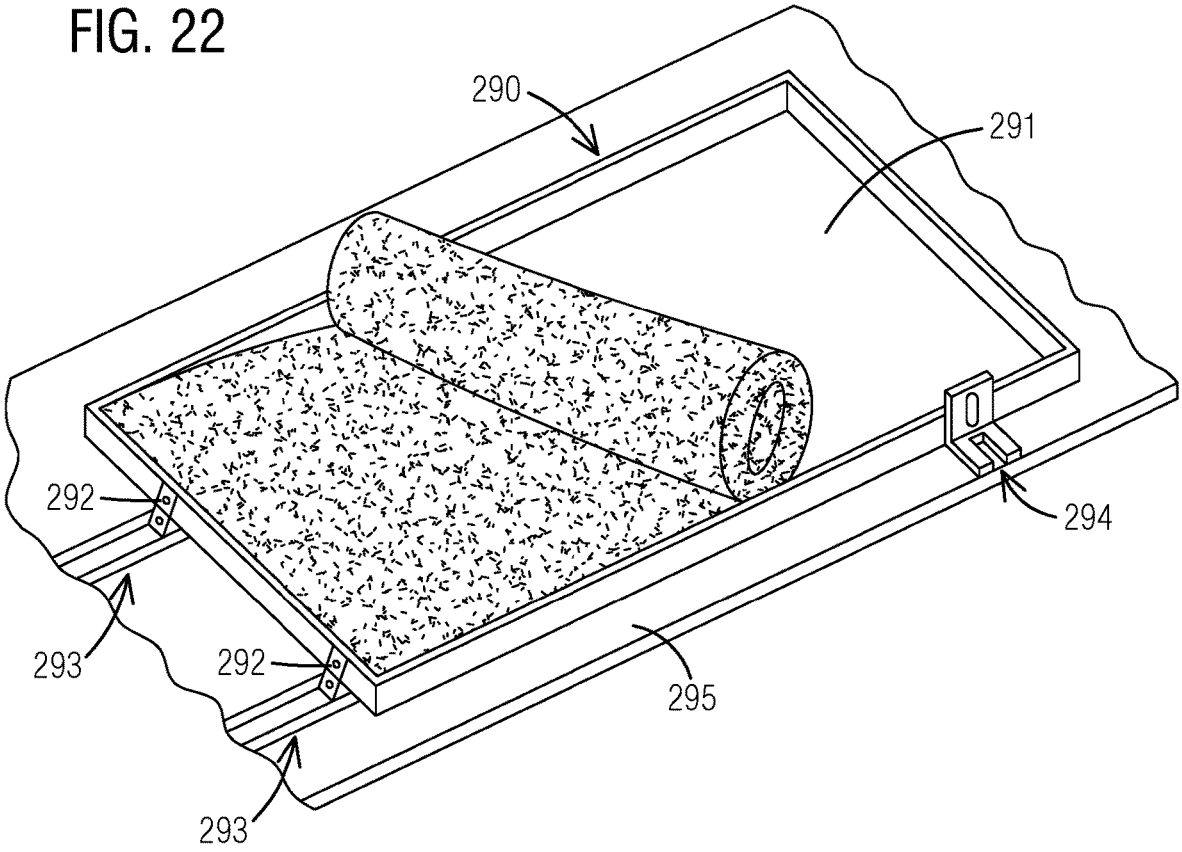
FIGS. 22 and 23 illustrate the concept of a living roof using roofing panels of the present disclosure and which can be interlocked or inter-connected to enable removal and replacement or substitution thereof.
Figure 23:
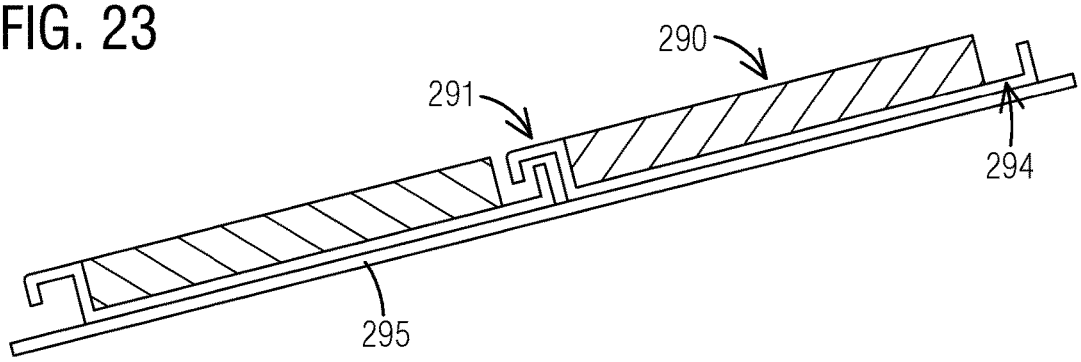

FIGS. 22 and 23 illustrate adaptation of the water shedding feature concepts disclosed herein to a green or living roof, which traditionally has been limited to low slope roofs. A roofing panel 290 forming a framework 291 or a tray sized to contain a layer of biological or vegetative, living material such as grass allows green roofs to be used on the steep slope roofs of residential houses as well. The growing material of each panel can be changed or replaced without disturbing the water shedding features and functions of the roof panel installation. For example, as indicated in FIGS. 22-23 the panel framework 291 can include connectors 292 (FIG. 22) that engage brackets, battens or other cooperative connectors arranged along the underlying roof structure 295 (e.g. a roof deck or substrate, or rafters or other support beams), and also can include connectors 294 (FIG. 23) configured to connect or interlock with adjacent panels. Such connectors can include, but are not limited to hooks, snap, magnets, clips, locking connectors, fasteners and/or other engageable and disengageable connectors.

In addition, the vegetative or "green" panels shown are to be understood as examples of various types of panels, which panels further can be made interchangeable, i.e., they can be snapped or changed by a homeowner, etc . . . , and various other types of panels, including various types of "smart" or functional/decorative panels such as (but not limited to) energy panels configured to collect solar, wind, and heat energy, i.e. solar panels; panels configured for water collection and filtration; panels adapted to provide or configured with an antenna array; illuminating panels or panels with pre-installed lights; panels configured to enable roof access equipment, containing items such as a retractable ladder; skylight panels; panels configured for digital sensing/communications; decorative panels in solid colors, textures, patterns and/or customizable print options; panels incorporating traditional roofing materials and aesthetics; panels with storage chamber for parts and tools for easy repair/replacement; and/or various combinations thereof, can be exchanged or substituted therefor.

Figure 24:
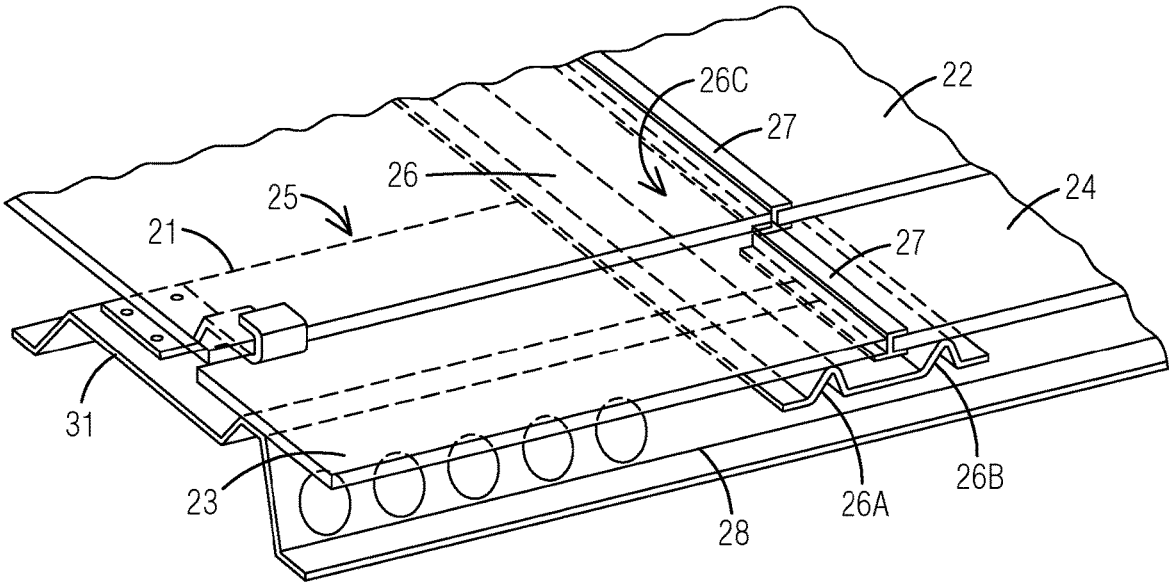
FIGS. 24-26 illustrate the use of full-length water troughs as part of a sidelap water shedding strategy for roofing panels according to the present disclosure.
Figure 25:
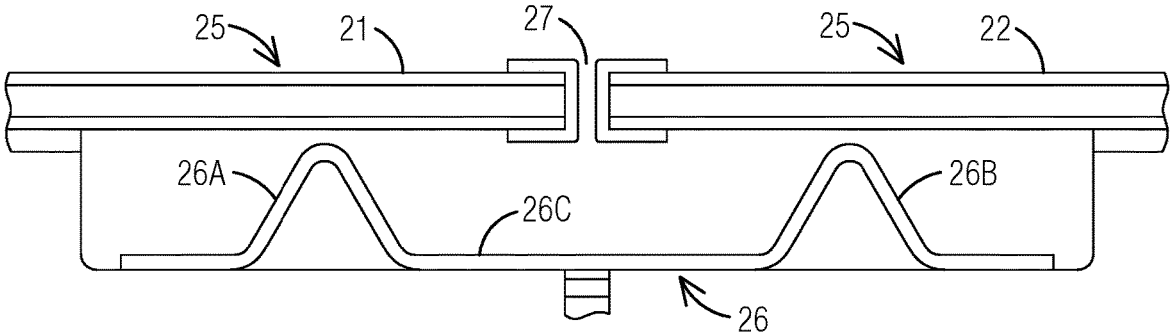
Figure 26:
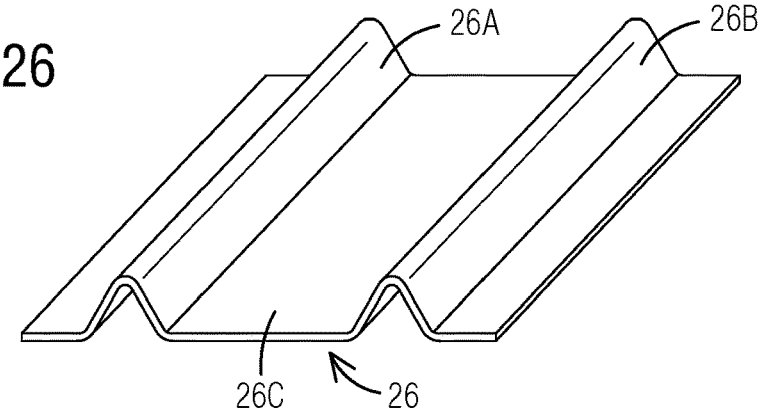

FIGS. 24, 25, 26 illustrate an embodiment of roofing panels 25 such as illustrated in FIGS. 2*a*-2*c* (or any of the other embodiments discussed above), including a full length water trough 26. The water trough is roof profiled with two raised hill features 26A/26B that form a water trough 26C between them. Edge flanges 30 extend outwardly from the hill features to accommodate attachment to a roof deck 31 with screws or other appropriate fasteners. The roof panels 25 can also have a caps, drip edges, or other water shedding features along their peripheral edges to direct rainwater to openings to be collected by the troughs and moved along a drainage path. This embodiment of a full length water trough can enable multiple water troughs can be nested for storage and shipment.

Figure 27:
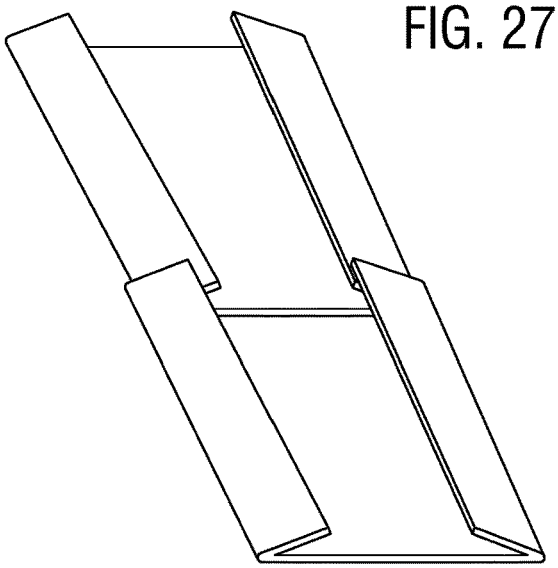
FIGS. 27 and 28 illustrate the use of extruded or sheet metal water troughs as part of a sidelap water shedding strategy for roofing panels according to the present disclosure.

FIG. 27 illustrates another embodiment of a water trough in the form of an extruded or bent sheet metal strip with up and in turned edges to form water containment features. These extruded or bent sheet metal water troughs can be installed in nested sections on a roof deck beneath where horizontally adjacent roof panels will meet.

Figure 28:
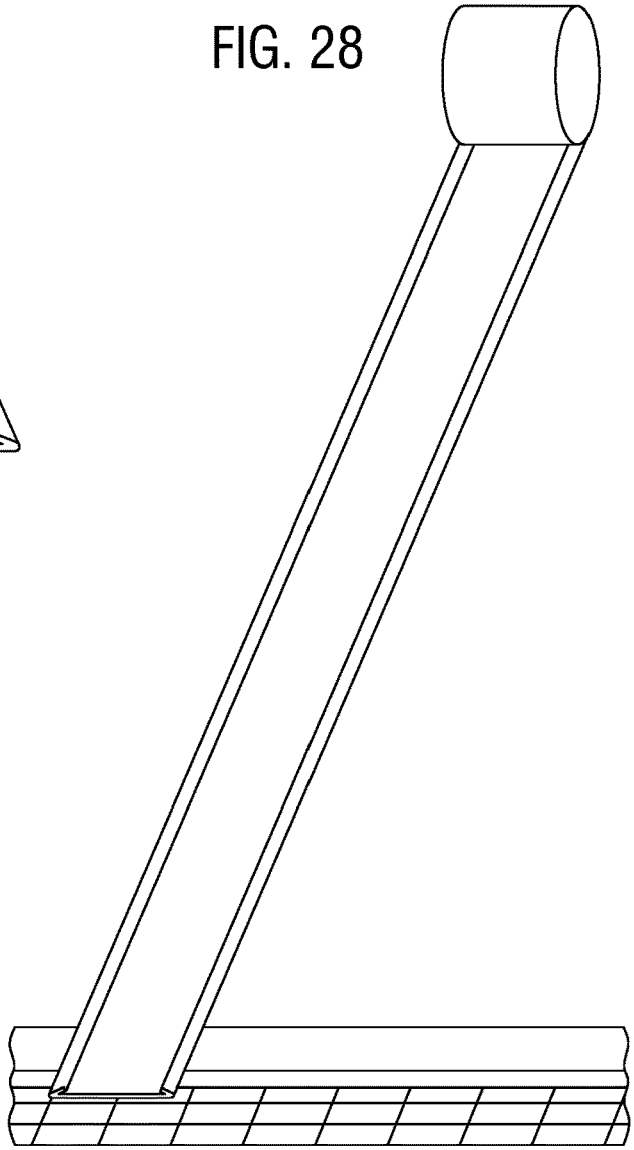

FIG. 28 illustrates an embodiment of an extruded plastic or film material water trough with in-turned edges that can be rolled into a roll for shipping and unrolled and cut to size on a job site.

Figure 29:
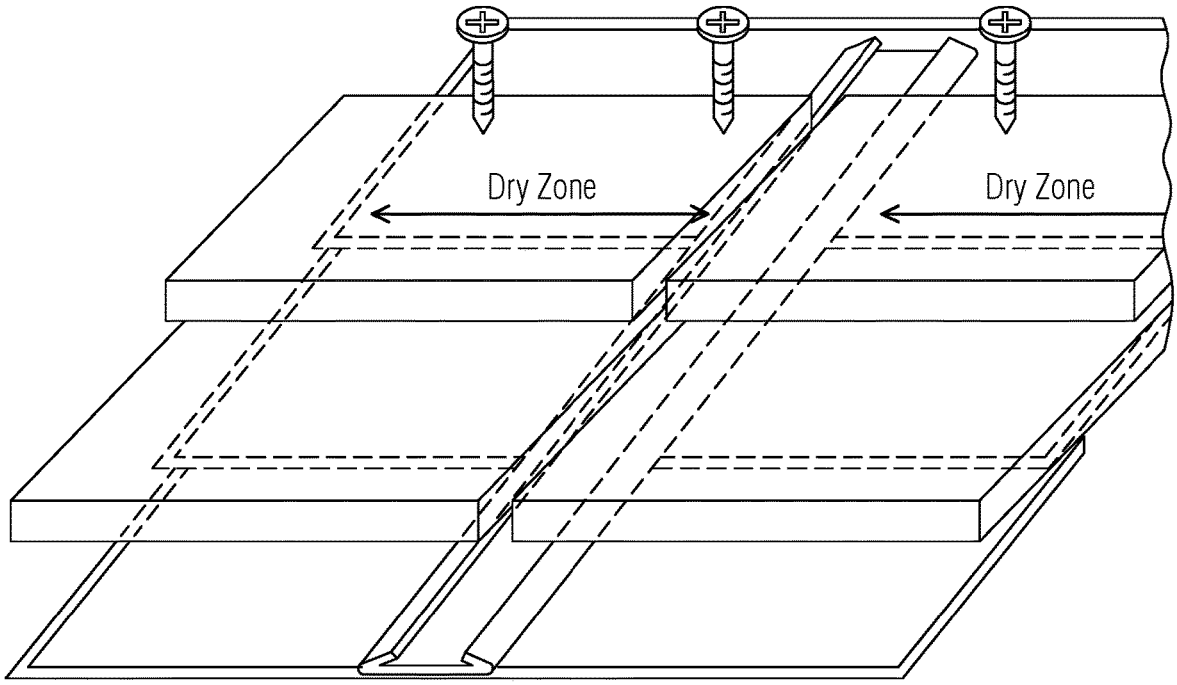
FIG. 29 illustrates roofing panels in the form of rolled out water troughs extending beneath sidelap edges of roofing panels according to the present disclosure.

In FIG. 29, the water trough, such as shown in FIGS. 27-28, has a peel-and-stick backing for attaching it to a roof deck. Here, roofing panels are mounted to the roof deck in overlapping courses, with the water trough along sidelap seams defined between the roofing panels. Fasteners for overlying roofing panels can pierce anywhere in the dry zones as shown in the drawing. Fasteners along the headlap edge are driven through the roofing panel or solar panel grommets.

Figure 30:
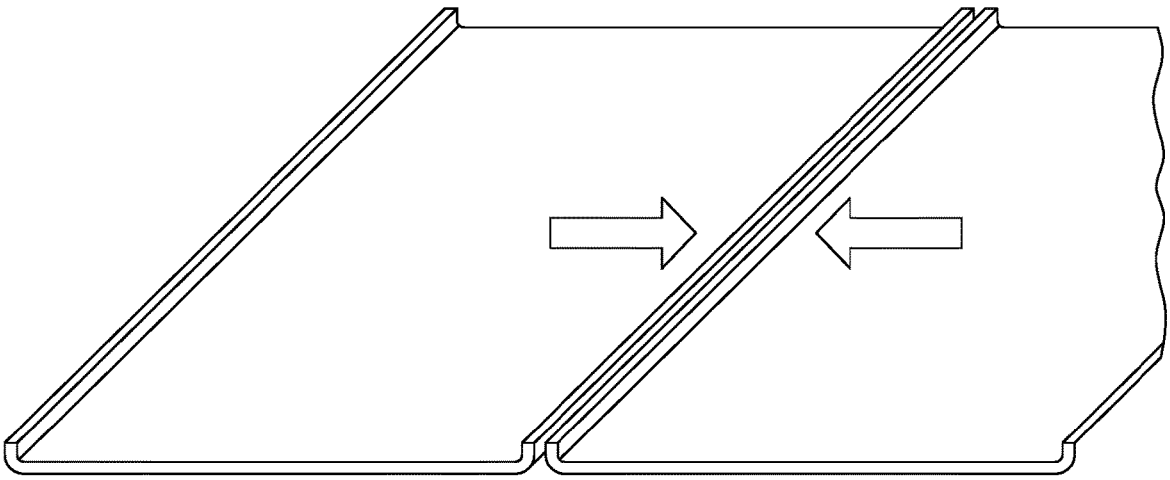
FIGS. 30 and 31 illustrate vertical underlayment strips with adhered or covered edges that together form a standing seam for water shedding features.
Figure 31:
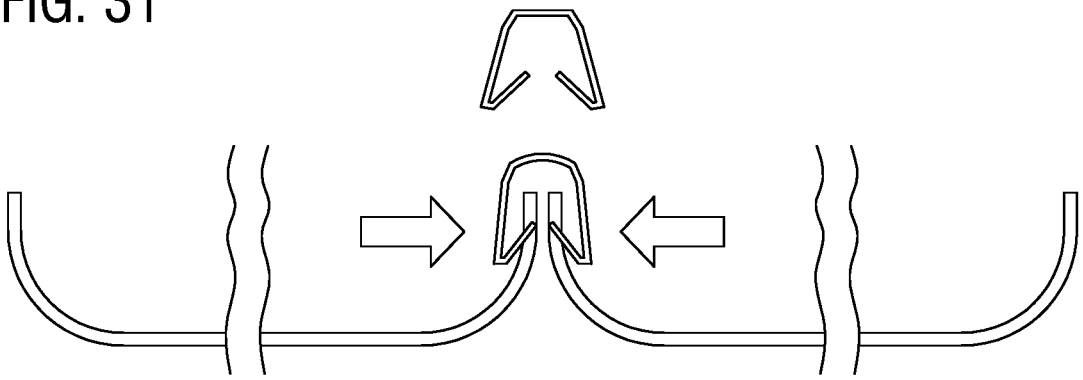

FIGS. 30 and 31 illustrate another embodiment of a water management system beneath an installation of roofing panels. Here, vertically extending underlayment sheets are installed on a roof from a ridge to an eave. The material of the underlayment may be an appropriate membrane such as TPO and the strips abut one another at a standing seam. The abutting seams may be sewn or crimped together or they may be stuck together with an adhesive such as peel and stick strips. FIG. 31 illustrates the option of crimping the standing seams together with long strips of plastic or metal to prevent water migration between adjacent strips.

Figure 32A:
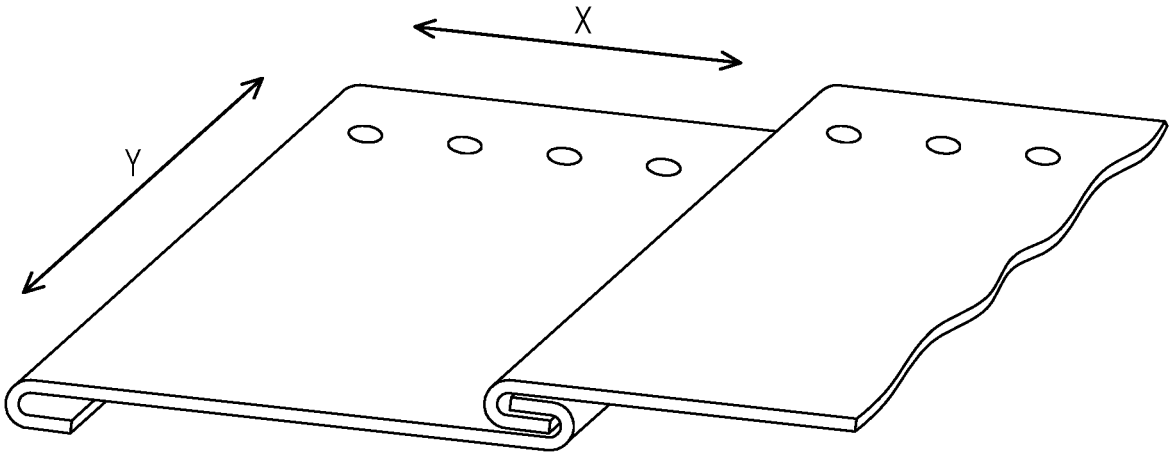
FIGS. 32*a* and 32*b* illustrate roofing panels according to the present disclosure with hooked side edges providing water containment and shedding properties.
Figure 32B:
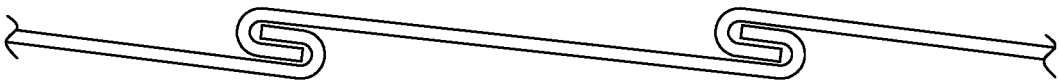

FIGS. 32*a* and 32*b* illustrate another embodiment of water shedding. Here, mating hems on the left and right edges of roofing panels block water penetration between horizontally adjacent panels. Headlap edges can be nailed to the underlying deck and overlapped by vertically adjacent panels by, for example, one to four inches or more to prevent water penetration. The roofing panels of this embodiment may be fabricated of roll formed metal, which can be rolled from the back of a truck on site in a manner similar to the roll forming of seamless gutters.

Figure 33:
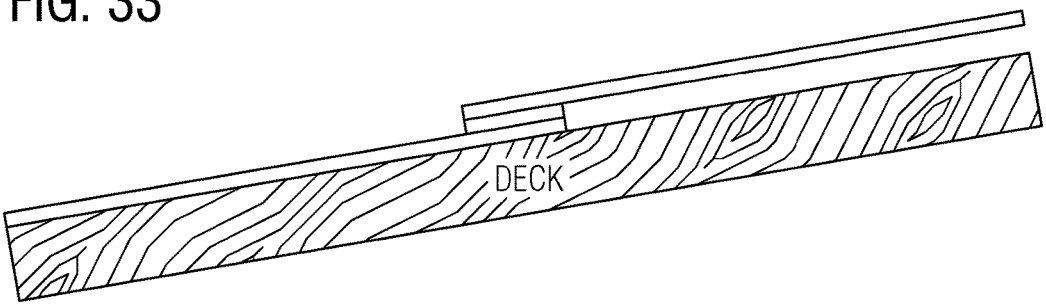
FIG. 33 illustrates a possible headlap edge of the hooked side edge roofing panels according to the present disclosure of FIGS. 32*a* and 32*b*.

FIG. 33 illustrates roofing panels with overlapped headlap sections for providing mechanical water shedding along or across the roofing panels.

Figure 34:
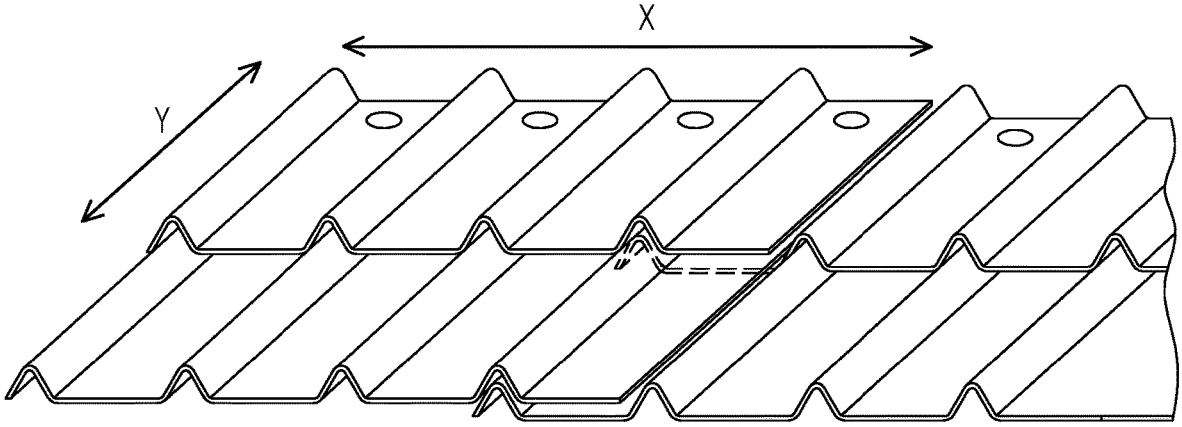
FIGS. 34 and 35 illustrate a roofing panel according to the present disclosure with micro corrugations for water containment and shedding.
Figure 35:
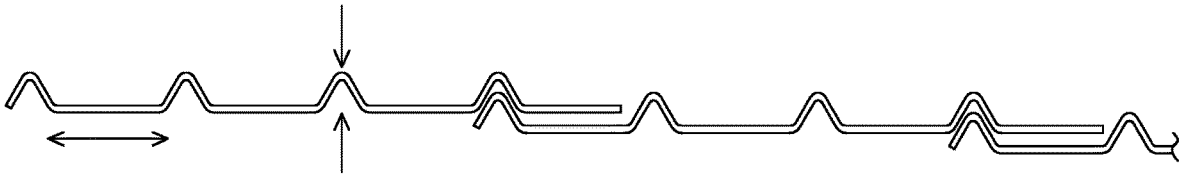

FIGS. 34 and 35 illustrates another embodiment of a water shedding feature in the form of micro corrugated panels. Here, headlap edges may be overlapped by, for example, one to four inches or more after panels are nailed and sealed. The micro corrugated panels may be roll formed or stamped metal, extruded plastic, or formed plastic. The may be made of recycled regrind materials and material choices are not limited by a seam melting operation. As with the previous embodiment, the micro corrugated panels may be roll formed on site from the back of a roll forming truck.

Figure 36:
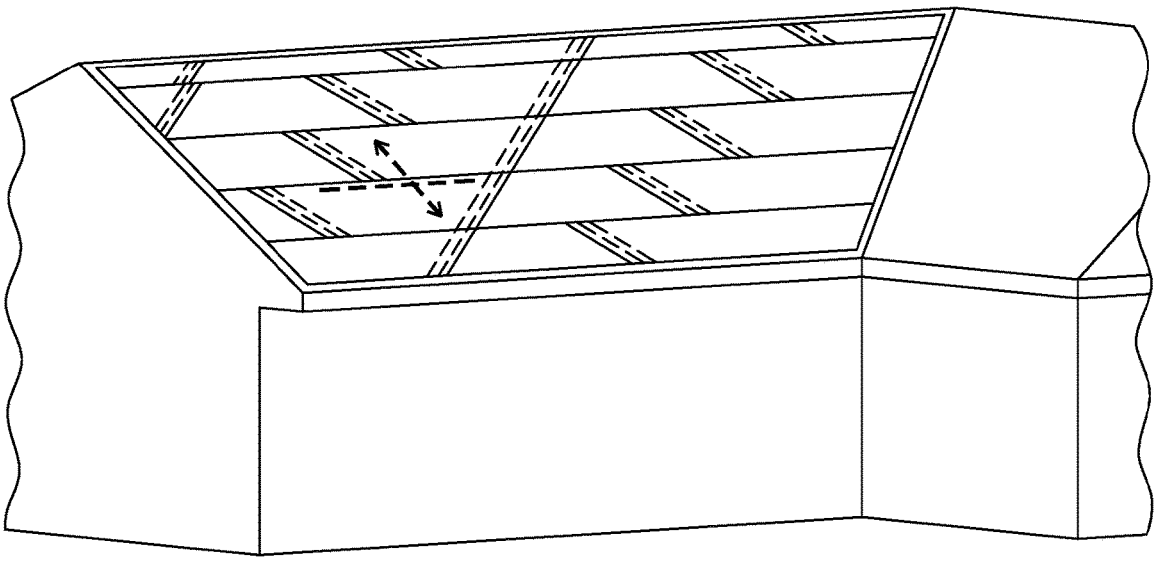
FIG. 36 shows the location of a headlap seam on a roof with roofing panels of the present disclosure.
Figure 37:
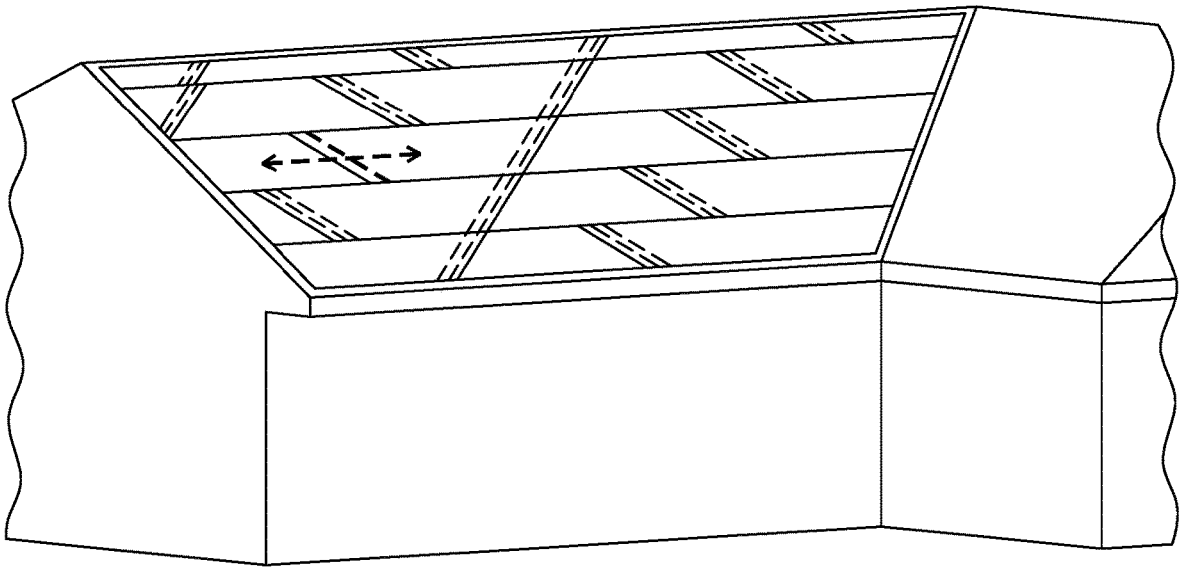
FIG. 37 shows the location of a sidelap seam on a roof with roofing panels of the present disclosure.

Generally, FIGS. 36 through 46 illustrate features of roofing panels with trapezoidal shapes that embody principles of the present disclosure. FIGS. 36, 37, (as well as FIG. 55) show the roof of a home with trapezoidal roofing panels installed and indicate the locations of headlap seams (FIG. 35) and sidelap seams (FIG. 36).

Figure 38:
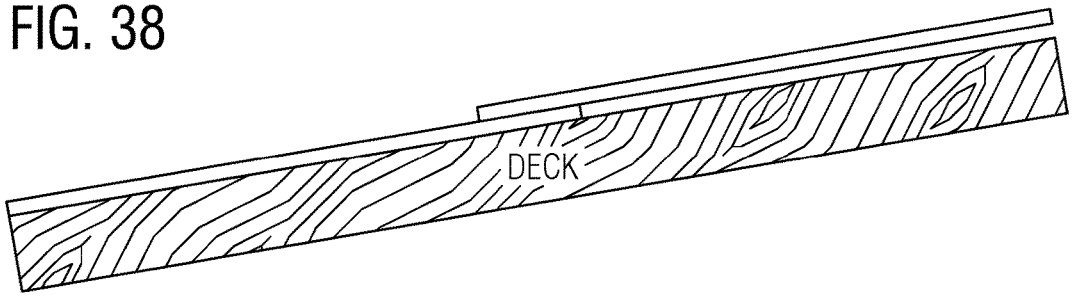
FIGS. 38 and 39 show headlapped roofing panels forming a simple mechanical water shedding feature.
Figure 39:
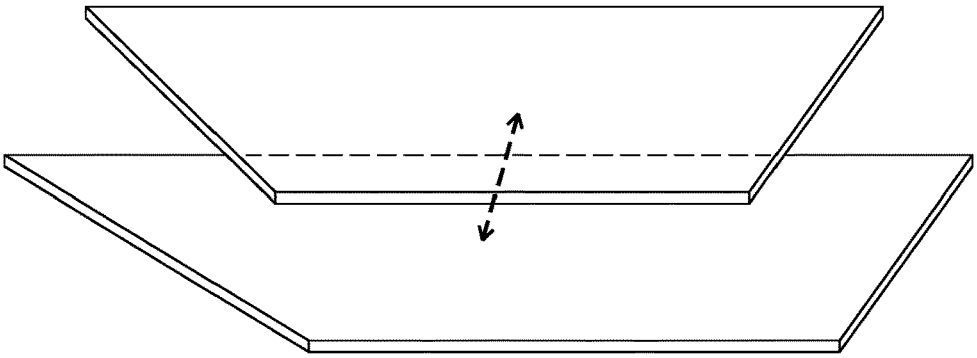
Figure 40:
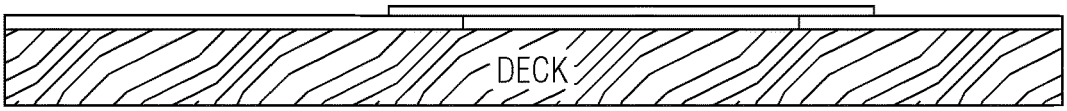
FIGS. 40 and 41 show side-lapped roofing panels forming a simple mechanical water shedding feature.

FIGS. 38 and 39 show vertically adjacent trapezoidal roofing panels with a simple headlap overlap for water management at the headlap. Advantages are that the overlapped regions are substantially flat and bent lips or water dams are not required to make a water stop or a drip edge.

Figure 41:
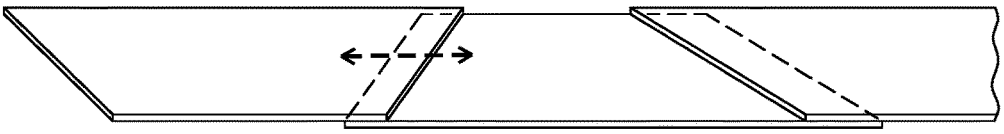
Figure 42:
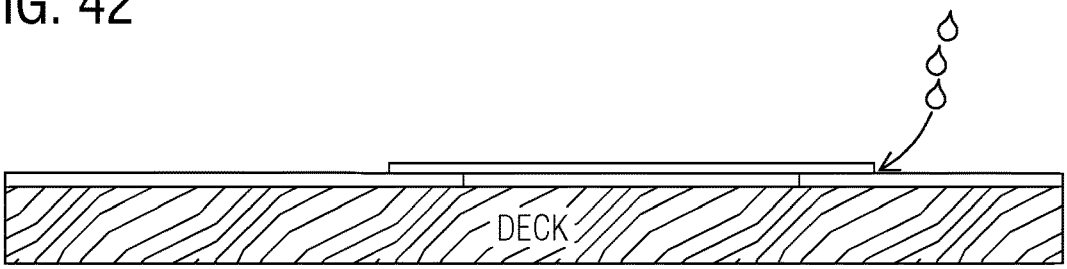
FIGS. 42 and 43 suggest the need for windblown rain testing of the lapped roofing panels of FIGS. 38-41.
Figure 43:
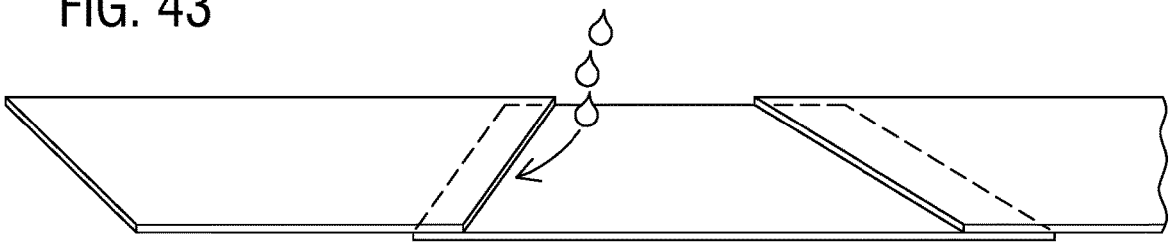

FIGS. 41 and 42 illustrate an embodiment wherein horizontally adjacent trapezoidal roofing panels are overlapped at their side edges to form simple mechanical water shedding features. Advantages are that the installation is substantially flat and there is no need for bent lips to create water stops or drip edges. As suggested in FIGS. 42 and 43, windblown rain testing is needed to ensure that the sidelapped ends do not leak under such conditions.

Figure 44:
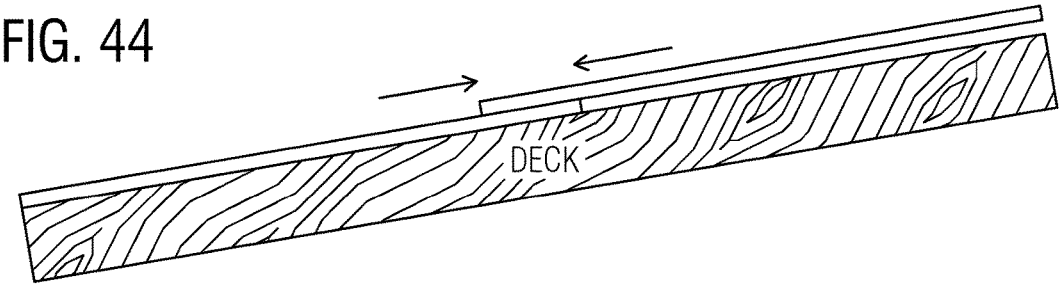
FIGS. 44-46 suggest the use of overlaps between roofing panels, for preventing windblown rain infiltration.
Figure 45:
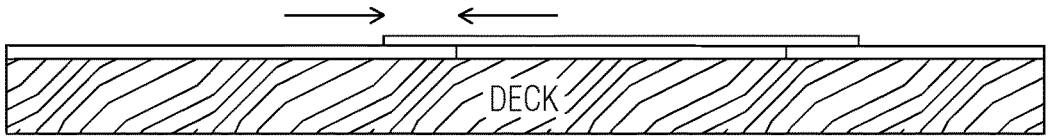
Figure 46:
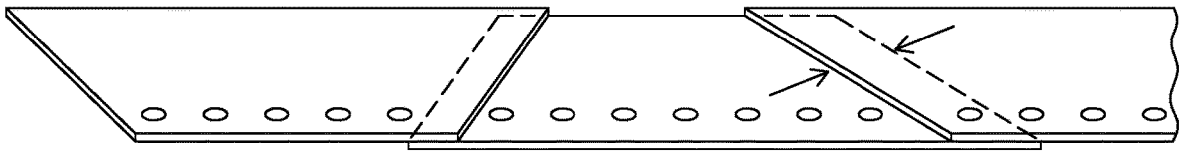
Figure 47:
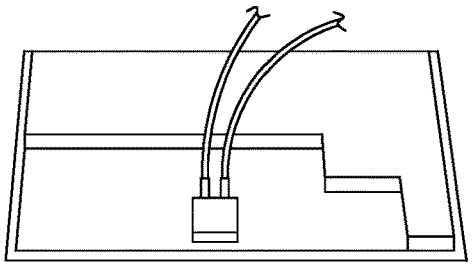
FIGS. 47, 48, 49, and 50 illustrate roofing panels according to the present disclosure with extended back sheets on 2 or more sides as water shedding features.
Figure 48:
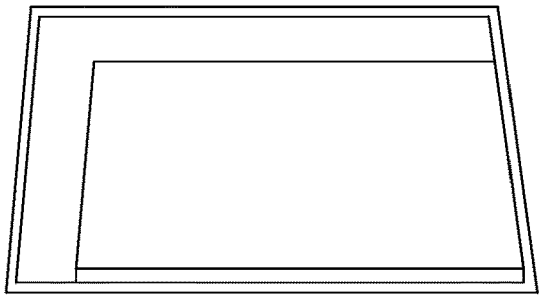

FIGS. 44-46 illustrate embodiments of possible selected overlaps at both the headlap and sidelap of trapezoidal roofing panels. For example, a two-inch overlap between vertically and horizontally adjacent panels generally should be sufficient to prevent water penetration; however, the overlap can be as little as one inch or as great as 4 inches or more if windblown rain testing so indicates.

Figure 49:
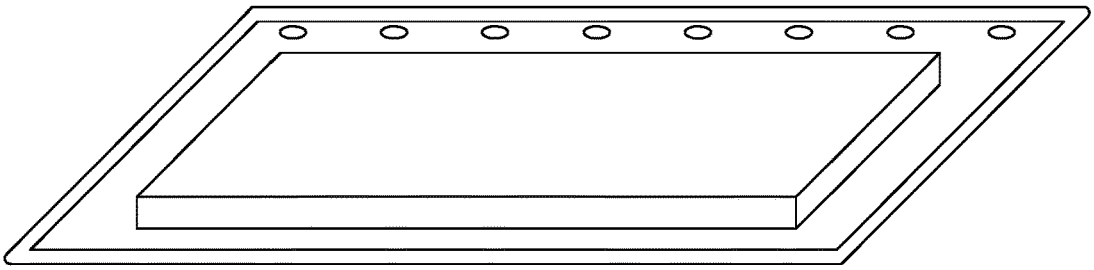
Figure 50:
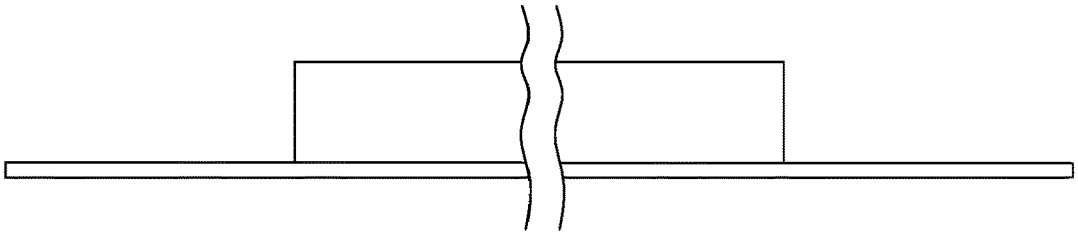

FIGS. 47-50 illustrate another embodiment of a water shedding feature for roofing panels. Here, each panel is provided with a back sheet that extends beyond the edges of the roofing panels on two or three sides or even all four sides. One of the back sheet projections or extensions, in one embodiment the back sheet extension along the top edge of the roofing panel, may have fastening locations as shown in FIG. 49 for securing the panel to a roof deck with fasteners.

Figure 51:
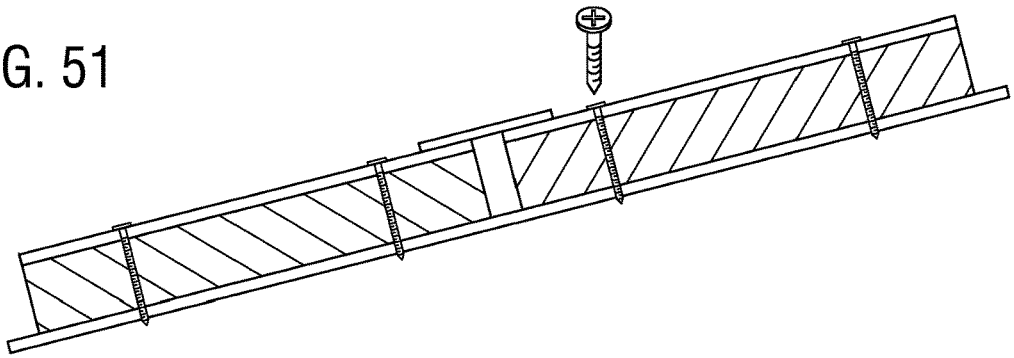
FIG. 51 illustrates the use of panel-tite sealing screws for attaching roofing panels to a roof.
Figure 52A:
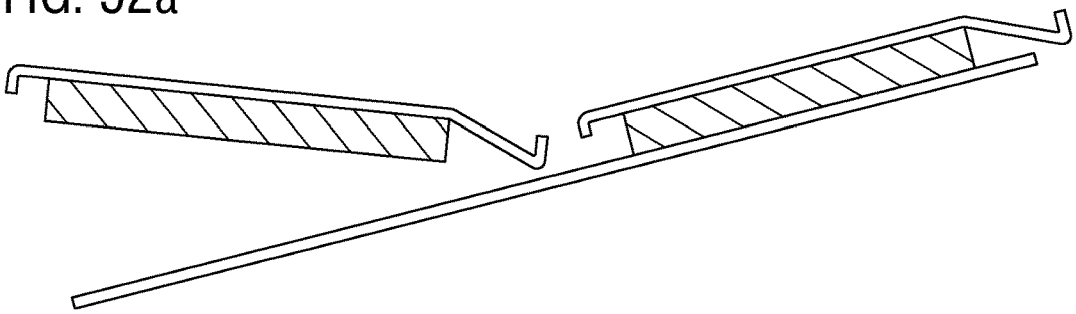
FIGS. 52*a*-52*d* illustrate an installation sequence for a "hook-and-rock-in" headlap attachment for roofing panels according to the present disclosure.
Figure 52B:
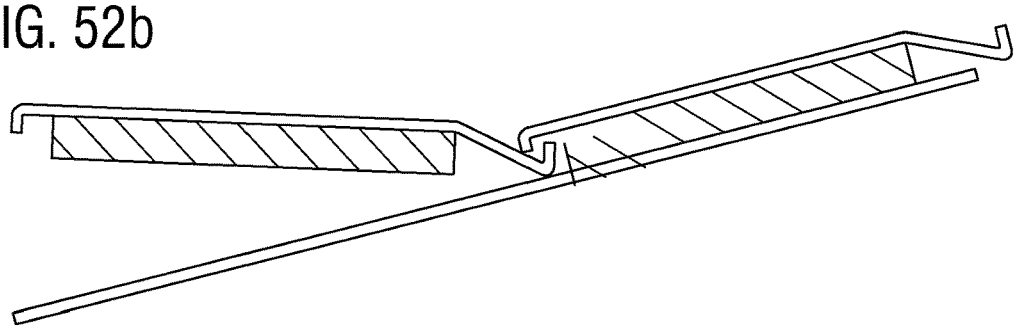
Figure 52C:
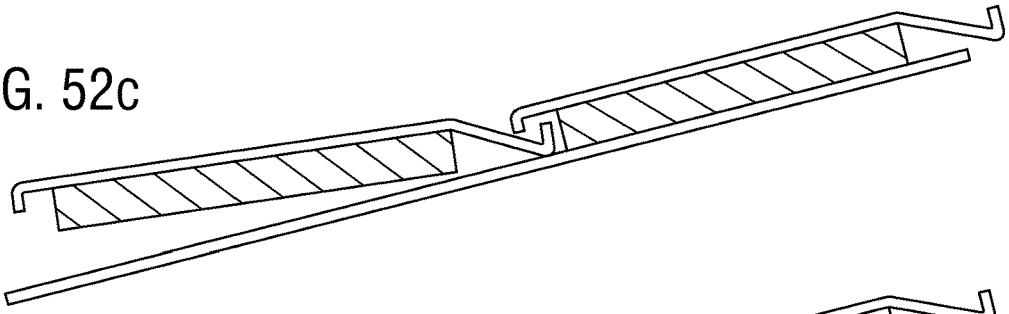
Figure 52D:
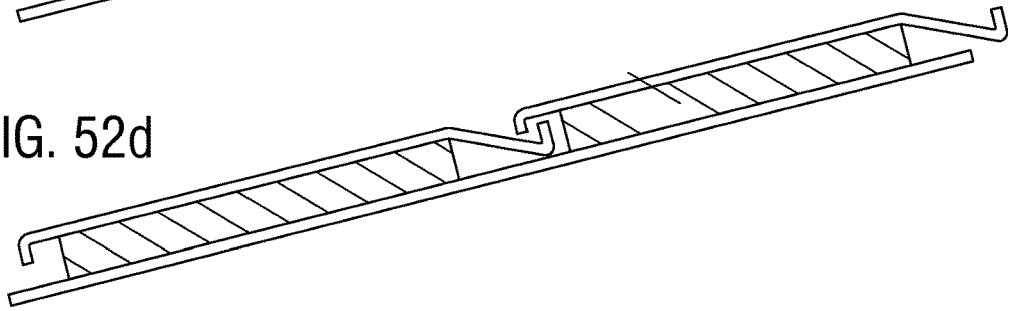

FIG. 51 shows one embodiment for attaching roofing panels according to the present disclosure to a roof deck. Here, "panel-tite" sealing screws similar to those used to fasten tin roofs to buildings are driven through the roofing panels and into the rafters. The resulting screw head will be visible, but this may be acceptable in some cases.

FIGS. 52*a*-52*d* show another embodiment for inter-attaching vertically adjacent roofing panels together. This embodiment is referred to as the "hook and rock-in" embodiment. The top water shedding features of panels are formed with a downturned lip along the forward edges of the panels and an upturned hook along the rear edges of the panels. With one panel installed, the next lower panel may be inter-attached to the installed panel as illustrated in sequence in these figures. First, the lower panel is slid upwardly until its hook moves beneath the downturned lip of the next higher panel (FIGS. 50*a* and 50*b*). Then the panel is progressively rocked down until its hook resides behind the downturned lip of the next higher panel (FIGS. 50*b*, 50*c*, and 50*d*). This forms an interacting drip edge and water dam that sheds water away from the junction between the two panels.

Figure 53:
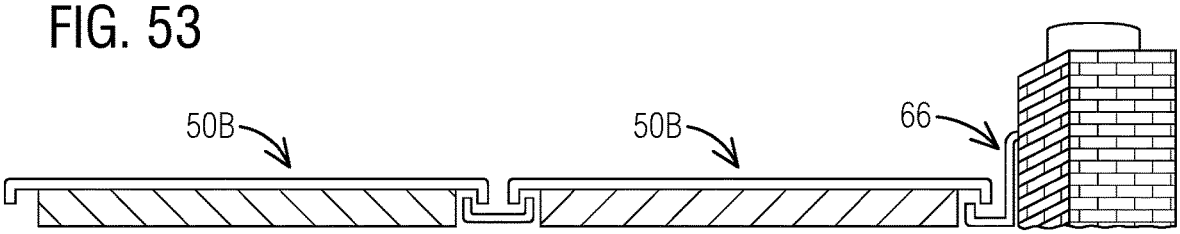
FIG. 53 illustrates one embodiment of flashing that may be used with a roofing panel as shown in FIG. 2*b*.
Figure 54:
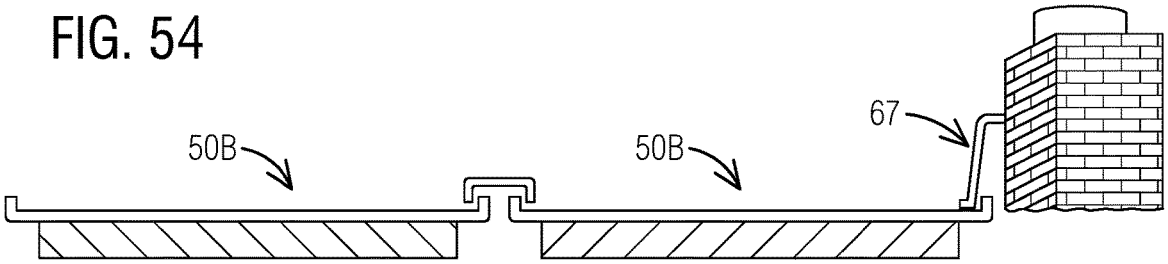
FIG. 54 illustrates one embodiment of flashing that may be used with a roofing panel as shown in FIG. 5*d*.

FIG. 53 shows an embodiment of an installation of roofing panels according to one or more of the embodiments discussed above, such as illustrated in FIGS. 2*b*, 3, 5*a*-5*g*, and 10*a*-10*f*, for example. In FIG. 53, the roofing panels 65 are provided with water troughs as discussed with flashing 66 configured to form a water trough 67 along a protrusion in the roof or other structure such as a chimney. In this embodiment, roofing panels can be replaced without disturbing the water troughs or the flashing. Counter flashings typically are caulked into a groove that is cut into a chimney or other protrusion. In FIG. 54, roofing panels with upturned lips and caps are shown with flashing configured to direct water onto the top of an adjacent roofing panel. Here, the flashings are easily replaceable or reparable without disturbing the roofing panels.

Figure 55:
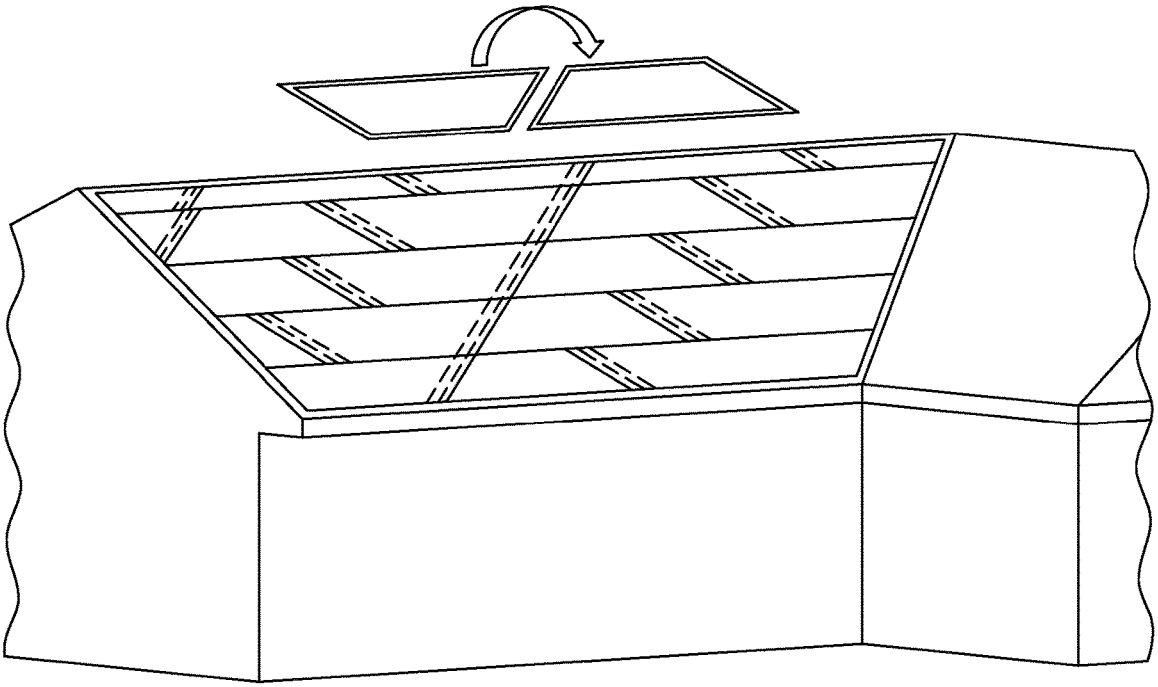
FIG. 55 illustrates trapezoidal-shaped roofing panels with sidelap overlaps that form mechanical water shedding features.
Figure 56A:
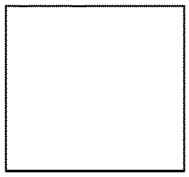
FIGS. 56*a*-56*f* and 57 illustrate roofing panels according to the present disclosure available in various shapes to accommodate angles at hips and valleys.
Figure 56B:
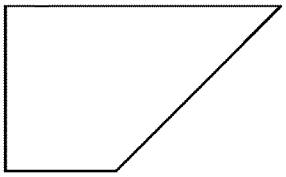
Figure 56C:
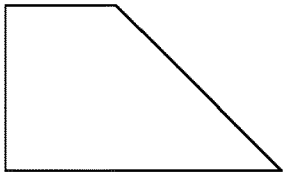
Figure 56D:
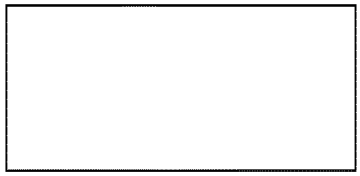
Figure 56E:
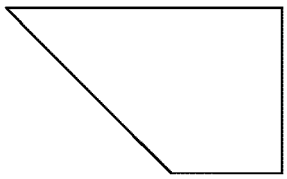
Figure 56F:
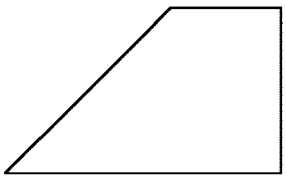

FIG. 55 shows another embodiment wherein roofing panels are fabricated with a trapezoidal shape. These panels can make use of simple overlaps at the headlap edges and at the sidelap edges to obtain mechanical water shedding at a lower cost. In one embodiment, the angled side edges of the panels match the hip and valley angles of the roof and the roofing panels are flippable to reduce the number of panel SKUs needed.

Figure 57:
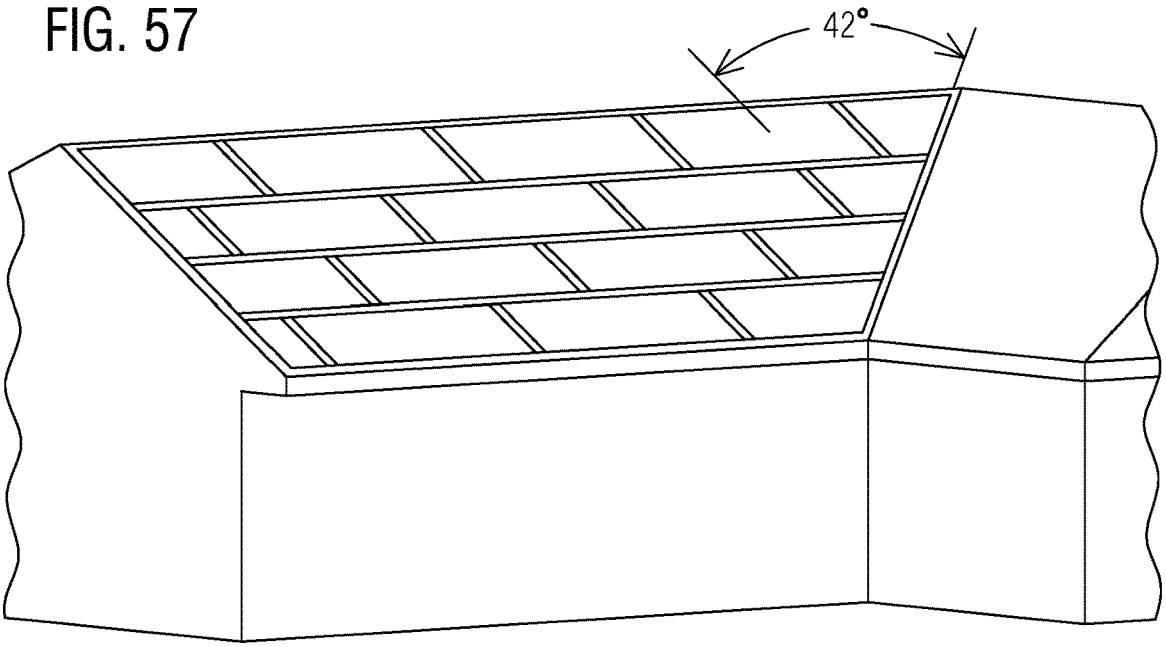

FIGS. 56*a*-56*f* show potential panel shapes to accommodate angles at hips and valleys of a roof plane. For example, FIG. 57 shows a roofing panel installation with trapezoidal panels along the right side of the installation to accommodate an adjacent roof valley.

FIGS. 58*a*-58*l* show various roofing panel installations for accommodating various shapes of roof deck planes.

Figure 58A:
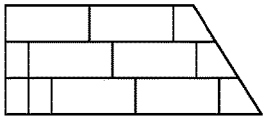
FIGS. 58*a*-58*l* show how roofing panels according to the present disclosure of various shapes can be combined to cover a variety of roof plane shapes.
Figure 58B:
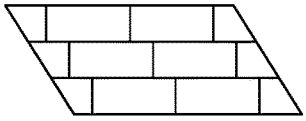
Figure 58C:
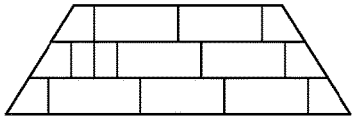
Figure 58D:
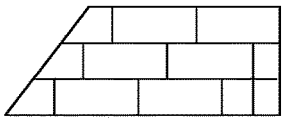
Figure 58E:
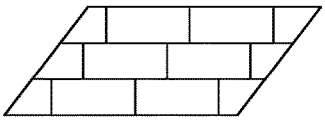
Figure 58F:
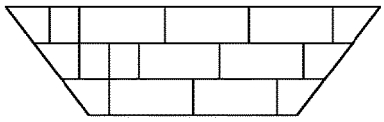
Figure 58G:
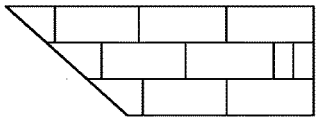
Figure 58H:
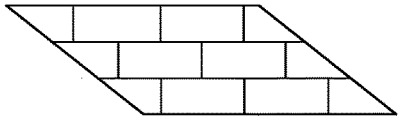
Figure 58I:
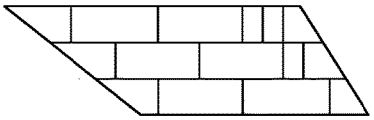

FIGS. 58*a*, 58*d*, and 58*g* show example installations using trapezoidal panels and rectangular panels for roofs of different pitches. FIG. 58*a* shows an installation on a relatively lower pitched roof and FIGS. 58*d* and 58*g* shows similar installations on increasingly higher pitched roofs. FIGS. 58*b*, 58*e*, and 58*h* show an installation on increasing pitched parallelogram-shaped roof decks using trapezoidal roofing panels of different configurations. FIGS. 58*c*, 58*f* and 58*i* show example installations non-parallel trapezoid-shaped roof decks of increasing pitch.

Figure 58J:
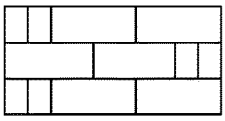
Figure 58K:
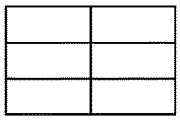
Figure 58L:
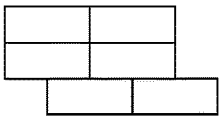

FIG. 58*j* illustrates a roofing panel installation with a running bond brick layout configuration. FIG. 58*k* shows an installation with a row and column panel configuration and FIG. 58*l* shows an installation with an offset panel configuration. Installations other and different from these are of course possible and within the scope of the present disclosure.

Figure 59A:
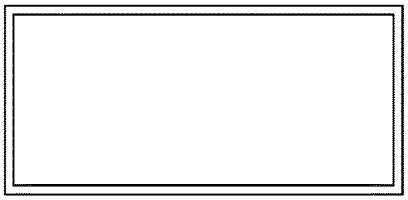
FIGS. 59*a* and 59*b* illustrate how roofing panels according to the present disclosure may be oriented in a landscape or a portrait orientation.
Figure 59B:
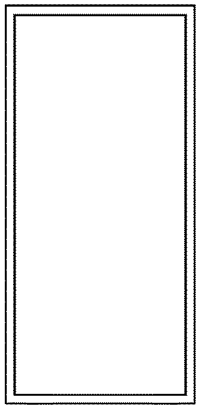
Figure 60A:
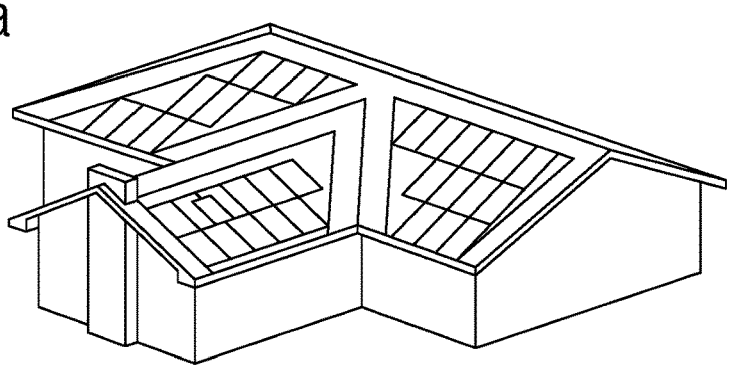
FIG. 60*a* illustrates roofing panels according to the present disclosure installed on the roof of a home in a portrait orientation.
Figure 60B:
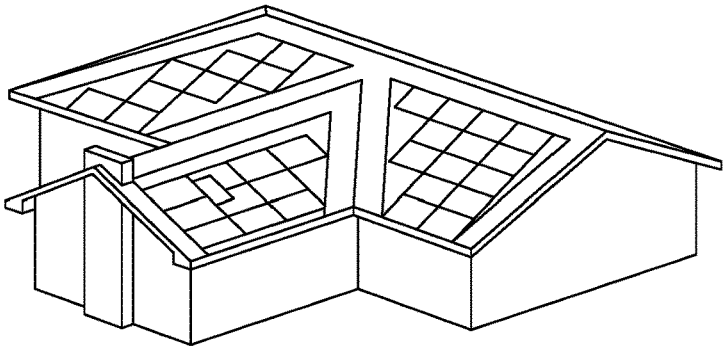
FIG. 60*b* illustrates roofing panels according to the present disclosure installed on the roof of a home in a landscape orientation.
Figure 61:
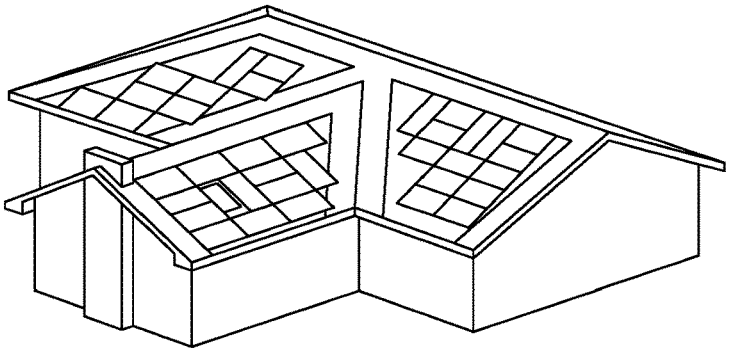
FIG. 61 illustrates roofing panels according to the present disclosure installed in combinations of portrait and landscape orientations on the roof of a home.

FIGS. 59*a* and 59*b* illustrate that roofing panels according to this disclosure can be installed in landscape orientation or in portrait orientation as desired. FIG. 60*a* shows a house with roofing panels installed in portrait orientation and 60*b* shows a house with roofing panels installed in landscape orientation. FIG. 61 illustrates a house with a hybrid roofing panel installation wherein some panels are installed in landscape orientation and others are installed in portrait orientation.

Figure 62A:
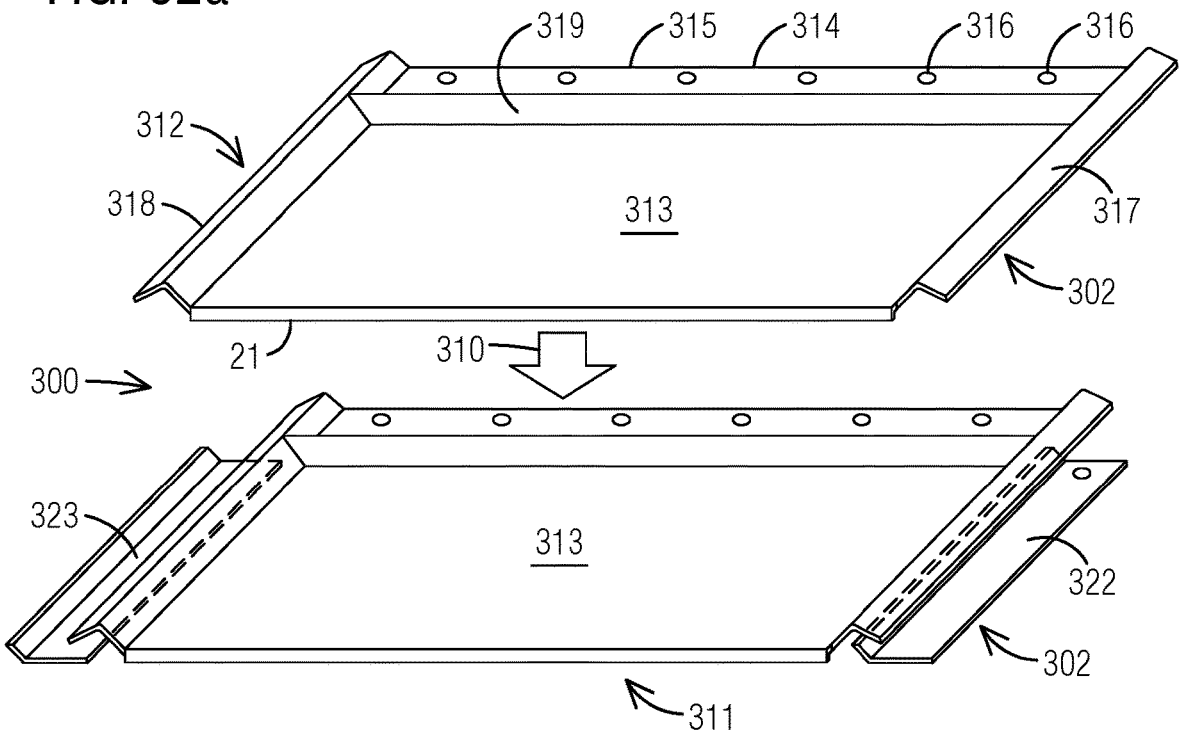
FIG. 62*a* is an isometric view of roofing panels according to still further embodiments of the present disclosure, illustrating the overlapping installation of the roofing panels in adjacent courses and the use of water shedding accessories for water shedding between adjacent panels.

FIGS. 62*a*-63*c* illustrate still further embodiments of a roof system or roof structure 300 that can be constructed using roofing panels 311 installed in overlapping courses 301A/301B (FIGS. 62*b*-62*c*) and that can incorporate various water shedding features 302, including any of the water shedding features and panel constructions discussed above with respect to any of the foregoing embodiments. For example, FIG. 62A illustrates two roofing panels 311 and 312 of the roofing system 300 according to one embodiment.

The roofing panels may be formed of a thermoplastic or thermo-formable, or compression moldable polymer sheet material, which may or may not include additives such as UV blockers, fire retardants, and compatibilizers as well as organic or inorganic fillers. For example, the roofing panels can comprise a base or sheet formed from a glass mat, a fabric base sheet, binders, adhesives, starch, lignin, virgin or recycled plastics such as low density polyethylene (LDPE) film, agricultural film, high density polyethylene (HDPE), polypropylene (PP), and polyvinylbutyral (PVB), sand, granules, shredded asphalt shingles, dust byproduct, cement, aggregates, bentonite clay, rice hulls, perlite, hemp, foaming agent, cellulose, among others. The roofing panels also may be formed of pressed sheet metal if desired.

Each roofing panel 311A/311B (FIG. 62A) is formed to define a substantially flat main exposure region 313 flanked on its side edges by upwardly projecting V-shaped ridges 317 and 318. An upwardly projecting lip 319 extends transversely between the V-shaped ridges 317 and 318 along the top of the main exposure region 313. The thickness of the panel could range from 0.1 inches to 0.75 inches, from 0.1 inches to 0.65 inches, 0.1 inches to 0.55 inches, 0.1 inches to 0.45 inches, 0.1 inches to 0.35 inches, 0.1 inches to 0.25 inches, 0.2 inches to 0.020 inches, 0.2 inches to 0.30 inches, 0.2 inches to 0.40 inches, 0.2 inches to 0.50 inches, 0.2 inches to 0.60 inches, or 0.2 inches to 0.70 inches. Other thicknesses also can be used. The size of the panels could range from a small panel the size of a 12"×36" shingle or the size of a clay tile, to a large panel approximately 48"×96", and/or various other sizes and/or configurations, for example, ranging from approximately 20"×44" to 50"×100", although other sizes also can be used.

Figure 62B:
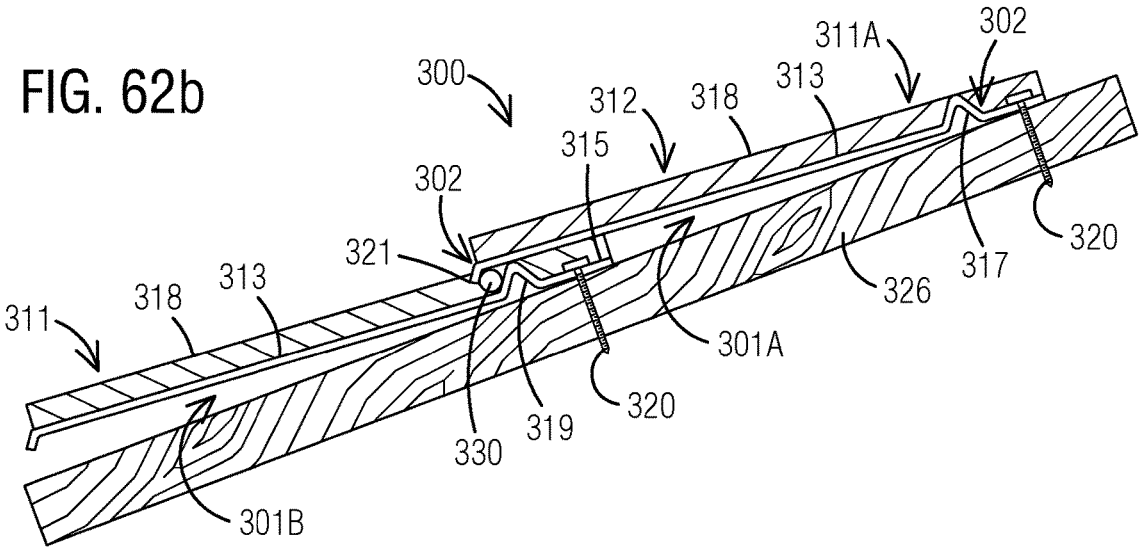
FIG. 62*b* is a side elevational view of two installed panels illustrating the overlap of the upper panel over the headlap portion of the lower panel.

A nailing flange 315 projects rearwardly from the lip 319 and may be configured with an array of holes 316 along a nail zone to accept fasteners such as roofing nails 320 (FIGS. 62*b*-62*c*) for fastening the panel to a roof deck 326 (FIG. 62*b*). Screws may be used instead of nails. Some materials allow nailing without pre-drilled holes. Alternative methods of fastening can include utilizing hooks, brackets or cleats. The forward edge of the exposure region 313 is characterized by a downturned lip 321, which can form a drip edge 320. The roofing panels also can include accessories that may include drain troughs 322 and 323 as shown in FIG. 62*a*. The drain troughs are configured to be attached to a roof deck 326 underlying the V-shaped ridges of two horizontally adjacent roofing panels. In this way, rainwater that might seep between the horizontally adjacent roofing panels is captured and contained by the drain troughs and shed downslope to an eave of a roof deck where it is shed away from the roof.

FIG. 62*a* indicates via arrow 310 that during installation, a roofing panel 312 in one course 301A is overlapped onto a previously installed roofing panel 311 in a next lower course 301B and so on up the roof. As shown in FIG. 62*b*, the panels are positioned so that the lower edge portion of the upper course panel overlaps the nailing flange 315 and the lip 319 of the lower course panel. A bead of adhesive or sealant 330 may be disposed between the lower edge of the upper course panel and the lower course panel to adhere the two roofing panels together and resist wind lift of the forward edges of the installed panels.

Figure 62C:
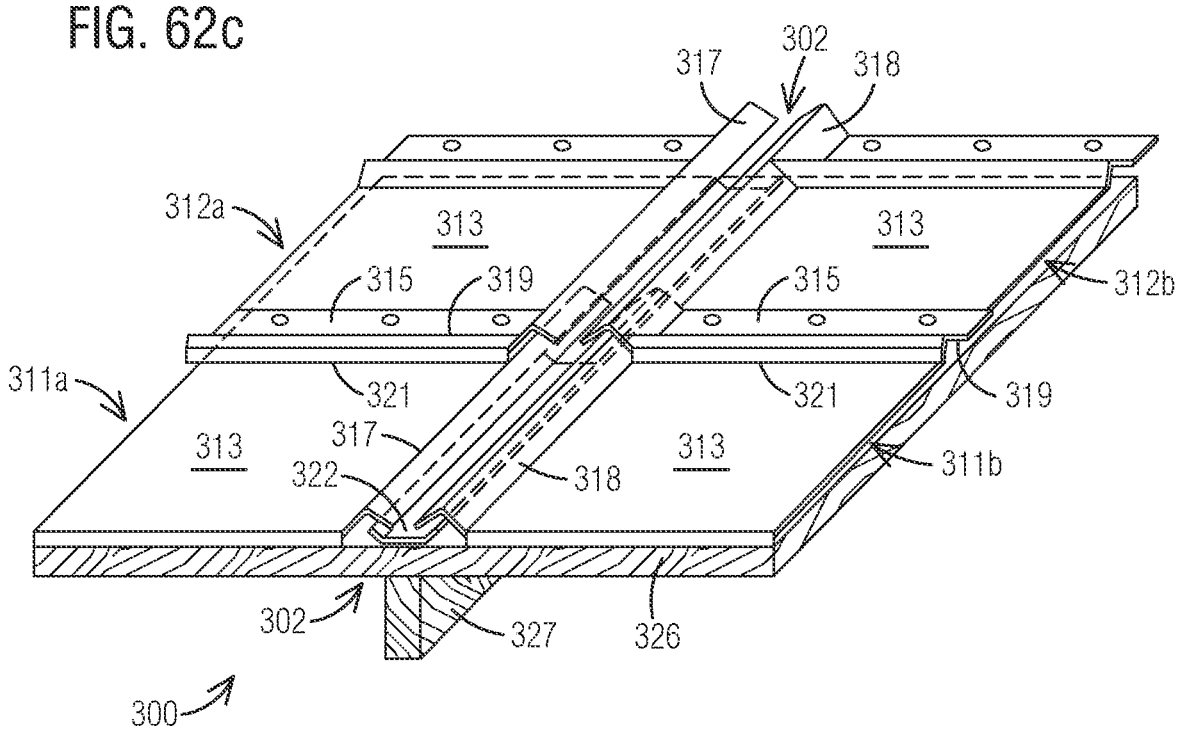
FIG. 62*c* is an isometric view showing four roofing panels of an installation of roofing panels on a roof deck using water trough accessories between horizontally adjacent panels.

FIG. 62*c* illustrates sections of four roofing panels 311*a*, 311*b*, 312*a*, and 312*b* installed on a roof deck 326 supported by rafters 327. Roofing panels 311*a* and 311*b* are arranged horizontally adjacent to each other in a lower course 301B of panels and roofing panels 312*a* and 312*b* are arranged horizontally adjacent to each other in an upper course 301A of roofing panels. The forward edge portions of roofing panels 312 and 312*a* are seen to overlap the nailing flanges 315 and the transverse lips 319 of panels 311*a* and 311*b* as described above. In this way, drip edges 321 of the roofing panels 312*a* and 312*b* deposit rainwater onto the main exposure portions of roofing panels 311*a* and 311*b* to be shed down the roof 300. Further, the raised lip 319 of roofing panels 311*a* and 311*b* form water shedding features 302, here shown as water dams that reduce or prevent migration of rainwater to the roof deck 326, especially during wind-blown rains. The nailing flanges 315 and fasteners also are covered and protected from corrosion by moisture and the elements.

With continued reference to FIG. 62*c*, the forward edge portions of the V-shaped ridges 317 and 318 of horizontally adjacent roofing panels 312*a* and 312*b* overlap the rear edge portions of the V-shaped ridges 317 and 318 of roofing panels 311*a* and 311*b* respectively. This serves to reduce rainwater from seeping to the underlying roof deck in these regions. Further illustrated in FIG. 62*c* are water shedding features 302 in the form of accessories that can be provided as part of a system or kit for forming the roof using the roofing panels. Such water shedding accessories can be in the form water troughs 322 disposed beneath the abutting V-shaped ridges of horizontally adjacent panels. The water troughs 322 may be attached to the roof in overlapping sections as shown in FIG. 62*c*, or they may be a continuous length of formed material extending from the top of a roof deck to its eave, e.g. extending along or between substantially self-supporting panels such as illustrated in FIG. 20. The water troughs 322 capture and contain rainwater that seeps between horizontally adjacent roofing panels and sheds the captured water downslope to be shed away at the eave.

Figure 63A:
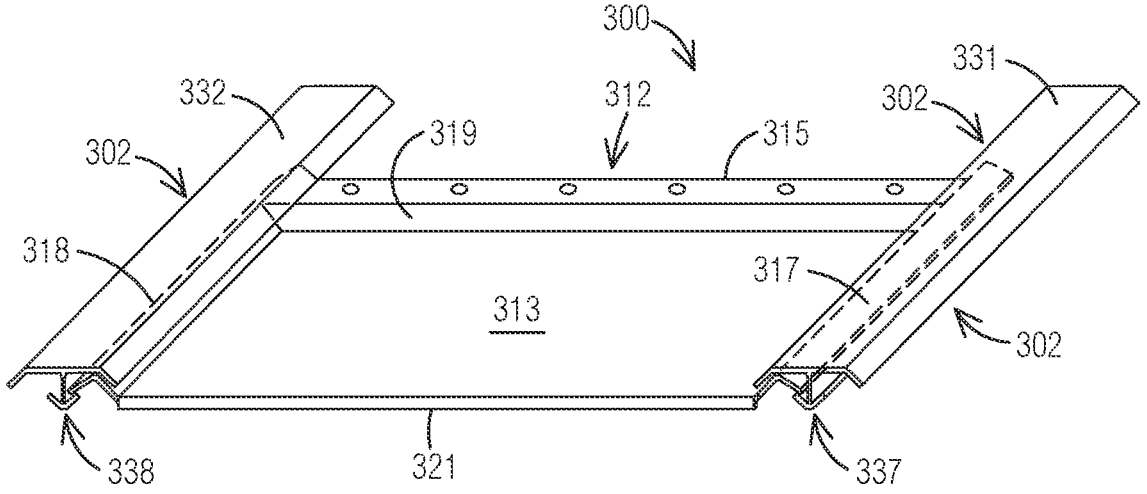
FIG. 63*a* is an isometric view of a roofing panel system according to still another embodiment, with overlying accessory caps to shed water along horizontally adjacent panels.
Figure 63B:
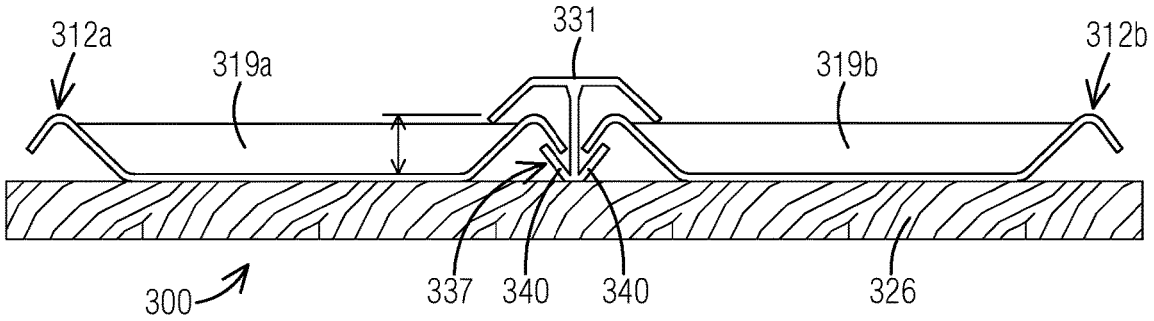
FIG. 63*b* is a front elevational view of the panels shown in FIG. 63A illustrating attachment of an overlying accessory cap to adjacent panels.
Figure 63C:
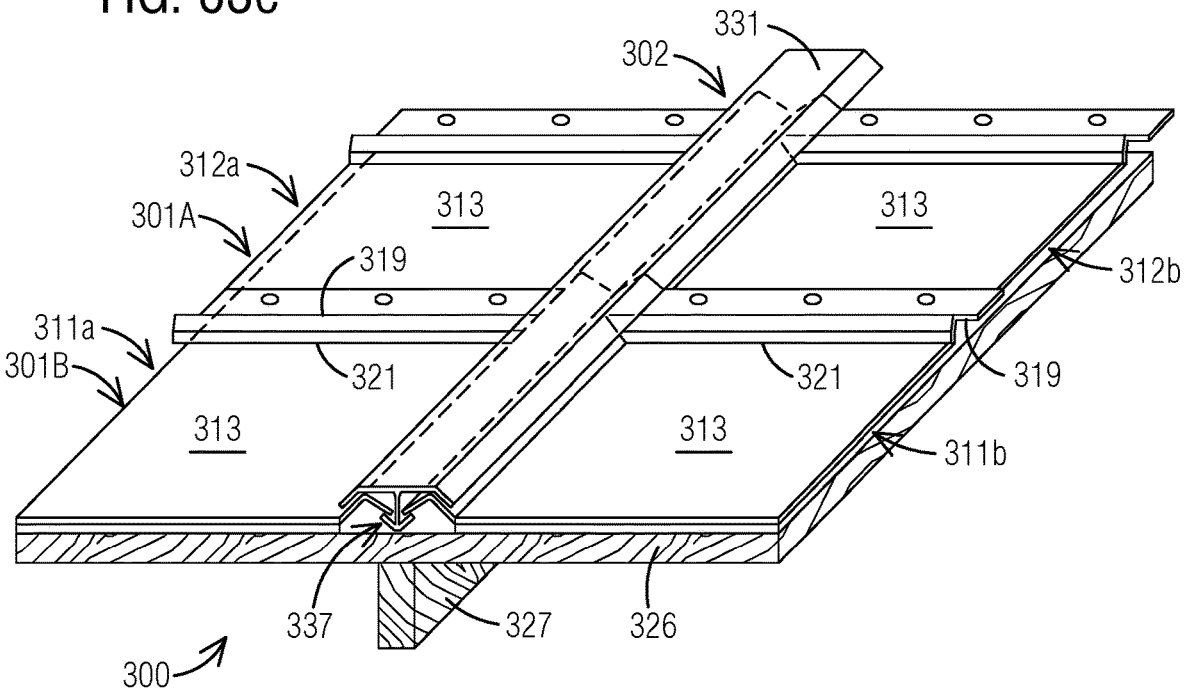
FIG. 63*c* is an isometric view of four roofing panels of an installation of roofing panels according to the embodiment of FIG. 63A installed on a roof deck.

FIGS. 63*a*-63*c* illustrate another embodiment of the system and kit of this invention. In this embodiment, the roofing panels themselves are of the same configuration as the panels in the above embodiment. However, the accessories for managing rainwater at the junctions of horizontally adjacent panels are different. Referring to FIG. 63*a*, roofing panel 312 has a main exposure portion 313, V-shaped ridges along its side edges, a transverse lip 319, and a nailing flange 315. Water shedding features 302, which can include accessories 331 and 332, in this embodiment comprising caps, can be provided in positions that overlie the junctions between horizontally adjacent panels and overlie the abutting V-shaped ridges of the panels.

The sides of the caps are downturned to form drip edges that deposit rainwater falling on the caps onto adjacent exposure portions of panels inside their V-shaped ridges. The caps 331 and 332 are formed with depending splines 337 and 338 respectively. The splines 337 and 338 are sized and configured to be pressed into a space between horizontally adjacent panels. As shown in FIG. 63*b*, once the splines are pressed into the space between panels, the barbs 340 of the splines spread out and become captured beneath the outermost edges of the V-shaped ridges. This secures the cap 331 in place with a mechanical interference fit.

FIG. 63*c* is an isometric view showing portions of four panels in two courses of panels on a roof deck that incorporate the cap accessories 331 according to the invention. The panels in the upper course overlap the panels in the lower course as discussed above and the panels in each course are horizontally adjacent to one another. Accessory caps 331 are pressed into spaces between horizontally adjacent roofing panels and held in place by splines 331. In the illustration, the accessory cap of the upper course of roofing panels overlaps the accessory cap of the lower course of roofing panels for water shedding. It will be understood, however, that the accessory caps can comprise one long unitary extrusion that extends from the top of an installation to the bottom. The caps may also serve to hold down the roofing panels during wind, by virtue of the fact that the caps are trapping the edge of one roofing panel as well as the roofing panel directly uphill of that roofing panel. The downhill edge of a roofing panel can be held down by the caps, and the caps held down by the fact that they are hooked under the next panel which is directly fastened to the roof deck. This approach may be used to eliminate the aforementioned adhesive or sealant joining two neighboring roofing panels.

In addition, a kit or other pre-constructed or packaged roof system or structure can be provided. The kit can include a plurality of roofing panels constructed in accordance with one or more of the foregoing embodiments discussed above, and including one or more water shedding features or various combinations thereof as discussed above, that can be assembled and shipped as a roofing system for assembly on-site for construction of a building roof.

The present disclosure has been disclosed herein through various embodiments and examples that illustrate principles, aspects and features of the present disclosure. The skilled artisan will realize, of course, that a wide gamut of additions, deletions, and modifications, both subtle and gross, may be made to the illustrated embodiments without departing from the spirit and scope of the present disclosure of which they are examples.

The invention claimed is:

1. A roof structure, comprising:

a plurality of roofing panels, each comprising:

a base having an upper surface, lower surface, and peripheral edge portions; and at least one water shedding feature extending along at least one of the peripheral edge portions of the base and configured to convey water along at least one drainage path away from the base;

wherein each of the plurality of roofing panels comprises a rectangular roofing panel and includes an exposure region with a nailing flange extending along a portion of the exposure region;

wherein the peripheral edge portions of each roofing panel comprise a pair of first peripheral edges extending parallel to each other in a first direction, and a pair of second peripheral edges extending parallel to each other in a second direction, the first peripheral edges having a length greater than a length of the second peripheral edges;

wherein each roofing panel is configured to extend across a section of the roof structure with the first peripheral edges of each roofing panel extending in a horizontal direction across the section of the roof structure and the second peripheral edges of each roofing panel extending in a vertical direction along the section of the roof structure;

wherein the roofing panels are configured to be installed in overlapping courses of roofing panels along a roof;

wherein the at least one water shedding feature of each of the roofing panels in a higher course of panels includes a downturned edge configured to cooperate with corresponding water shedding features of the panels of a lower course of roofing panels to define pathways for directing and reducing migration of water through seams between adjacent roofing panels of the overlapping courses of roofing panels, and between the roofing panels and the adjacent roofing panels;

wherein the nailing flange of each roofing panel is configured to receive a fastener therethough for securing the roofing panel to a roof deck of the roof; and wherein the downturned edge of each of the roofing panels in the higher course of roofing panels is configured to overlap the nailing flange of an adjacent roofing panel in the lower course of roofing panels and the fastener inserted through the nailing flange of the adjacent roofing panel without engagement of the downturned edge by the fastener, the overlap between the downturned edge and the nailing flange being sufficient to enable application of a sealant material behind the downturned edge.

2. The roof structure of claim 1, further comprising a waterproof layer positioned along at least one of the upper and lower surfaces of the base.

3. The roof structure of claim 2, wherein the waterproof layer comprises a polymer membrane, and includes at least one projection that overlaps the adjacent roofing panel to define a headlap or sidelap seam between the roofing panel and the adjacent roofing panel.

4. The roof structure of claim 3, wherein the at least one water shedding feature is formed along the at least one projection of the waterproof layer of each of the roofing panels and is configure to direct water along at least one of the headlap or sidelap seam between the roofing panel and the adjacent roofing panel.

5. The roof structure of claim 1, further comprising an edge frame positioned about the peripheral edge portions of the base; and wherein the at least one water shedding feature is at least partially formed by edge frames of the adjacent ones of the roofing panels.

6. The roof structure of claim 5, wherein each edge frame includes an extension portion defining a water shedding feature configured as a water stop or drip edge; and wherein the extension portions of the edge frames of the adjacent ones of the roofing panels are configured to overlap along a seam between the adjacent ones of the roofing panels and form the at least one water shedding feature therebetween.

7. The roof structure of claim 1, wherein the base comprises a waterproof material.

8. The roof structure of claim 1, wherein the at least one water shedding feature comprises at least one of a flexible strip, a trough, a ramp, or a cover located along a seam between the adjacent roofing panels of the overlapping courses.

9. The roofing structure of claim 1, wherein the base comprises an oriented strand board (OSB), polyisocyanurate (ISD) plywood, foam board, structural foam, polystyrene, polyvinyl chloride (PVC) plastic, concrete, a solar panel, a solar tile, pressed recycled materials, structural insulated panel materials, or combinations thereof.

10. The roofing structure of claim 1, wherein the waterproofing layer is positioned along the lower surface of the base, and further comprising a roof deck on which the roofing panels are received, and vapor barrier layer positioned along the roof deck and configured to enable passage of moisture therethrough.

11. The roofing system of claim 1, comprising an edge frame extending about the peripheral edge portions of the base and wherein the at least one water shedding feature comprises seals positioned along the edge frame, wherein the seals of edge frames of the adjacent ones of the roofing panels are configured to engage and compress together sufficient to substantially restrict passage of water therebetween.

12. A roof system, comprising:

a plurality of panels;

wherein each of the panels comprises:

a base having upper and lower surfaces and a plurality of peripheral edges; and at least one water shedding feature positioned adjacent at least one of the plurality of peripheral edges of the base;

wherein each of the panels of the plurality of panels comprises a rectangular roofing panel;

wherein the peripheral edges of each panel comprise a pair of first peripheral edges extending parallel to each other in a first direction, and a pair of second peripheral edges extending parallel to each other in a second direction, the first peripheral edges having a length greater than a length of the second peripheral edges;

wherein each of the panels is configured to extend across a section of a roof with the first peripheral edges of each panel extending in a horizontal direction across the roof and with the second peripheral edges of each panel extending in a vertical direction along the section of the roof;

wherein headlap seams are defined between the first peripheral edges of vertically adjacent ones of the panels arranged along the roof, and sidelap seams are defined between the second peripheral edges of horizontally adjacent ones of the panels arranged across the roof, each of the headlap seams and the sidelap seams having a length;

wherein the at least one water shedding feature of each panel comprises a downturned edge extending along at least one of the first and second peripheral edges of the panel; and a cover or trough extending along the length of the sidelap or headlap seams between adjacent panels, the cover or trough configured to underlie or overlap the downturned edges of the water shedding features of adjacent panels and collect water from the water shedding features of the adjacent panels and direct the water along a drainage path defined along the sidelap or headlap seams between the adjacent panels.

13. The roof system of claim 12, wherein the at least one water shedding feature of each panel comprises a compressible seal member received in a channel defined along the lower surface of each panel adjacent the peripheral edges of the base, and wherein the cover or trough comprises a water channel strip positioned along the sidelap or headlap seams between the adjacent panels and projecting across the lower surface of adjacent panels sufficient to cover the compressible seal member.

14. The roof system of claim 12, wherein each panel further comprises an edge frame, and wherein the at least one water shedding feature and the cover are integrated with the edge frame of each panel.

15. The roof system of claim 12, further comprising an edge frame positioned along the peripheral edges of the base, and wherein the edge frame of each panel comprises connectors for releasably coupling the panel to the roof and/or to the adjacent panels such that each panel is removable.

16. The roof system of claim 15, wherein the panels comprise interchangeable panels, including solar panels, biologic and vegetative panels, lighting panels, roof access panels, patterned or decorative panels, panels having roofing shingles, or combinations thereof.

17. The roof system of claim 15, wherein the connectors comprise hooks, clips, magnets, snap connectors, locking brackets or battens, or combinations thereof.

18. The roof system of claim 12, wherein each of the panels is formed from a waterproof material comprising at least one of a thermo-formable polymer, metal, foam, structured insulated panel materials, or combinations thereof; and comprises an exposure region with a nailing flange extending along a portion of the exposure region; and wherein the panels are configured to be installed in overlapping courses of panels along a sloped roof, with the at least one water shedding feature of each of the panels in a higher course of panels is configured to cooperate with corresponding water shedding features of the panels of a lower course of panels to define pathways for directing and reducing migration of water through seams between adjacent panels of the overlapping courses of panels.

19. The roof system of claim 18, wherein the water shedding features comprise V-shaped ridges along the peripheral side edges of the panels flanking the exposure region.

20. The roof system of claim 18, wherein the water shedding features comprise at least one of ridges, drip edges, drain troughs, caps or combinations thereof.

21. The roof system of claim 12, wherein a first panel of the plurality of panels comprises a projection with a drip edge overlapping a water stop positioned along an edge of a second panel located downslope of the first panel.

* * * * *